US012618343B2

(12) United States Patent
O'Donnell et al.

(10) Patent No.: US 12,618,343 B2
(45) Date of Patent: May 5, 2026

(54) THERMAL ENERGY STORAGE SYSTEM WITH A HEAT PUMP FOR IMPROVED EFFICIENCY

(71) Applicant: Rondo Energy, Inc., Alameda, CA (US)

(72) Inventors: John Setel O'Donnell, Oakland, CA (US); Yusef Desjardins Ferhani, Menlo Park, CA (US)

(73) Assignee: Rondo Energy, Inc., Alameda, CA (US)

( * ) Notice: Subject to any disclaimer, the term of this patent is extended or adjusted under 35 U.S.C. 154(b) by 0 days.

(21) Appl. No.: 18/913,979

(22) Filed: Oct. 11, 2024

(65) Prior Publication Data

US 2025/0146428 A1 May 8, 2025

Related U.S. Application Data

(60) Provisional application No. 63/678,465, filed on Aug. 1, 2024, provisional application No. 63/544,106, filed on Oct. 13, 2023.

(51) Int. Cl.

| | |
|---|---|
| ***F01K 23/10*** | (2006.01) |
| ***F24D 18/00*** | (2022.01) |
| ***F24D 101/10*** | (2022.01) |

(52) U.S. Cl.

CPC ..... *F01K 23/10* (2013.01); *F24D 18/00* (2022.01); *F24D 2101/10* (2022.01); *F24D 2220/10* (2013.01)

(58) Field of Classification Search

CPC ..... F01K 23/10; F01K 13/00; F01K 17/02; F01K 3/186; F24D 18/00; F24D 2101/10; F24D 2220/10; Y02E 20/14

See application file for complete search history.

(56) References Cited

U.S. PATENT DOCUMENTS

| | | |
|---|---|---|
| 1,089,951 A | 3/1914 | Otto |
| 1,700,542 A | 1/1929 | O'Donnell |

(Continued)

FOREIGN PATENT DOCUMENTS

| | | |
|---|---|---|
| AU | 2012292959 B2 | 2/2016 |
| AU | 2016100264 A4 | 4/2016 |

(Continued)

OTHER PUBLICATIONS

International Search Report and Written Opinion mailed on Dec. 20, 2024 for International Application No. PCT/US2024/024156, 29 pages.

(Continued)

*Primary Examiner* — Hoang M Nguyen

(74) *Attorney, Agent, or Firm* — Procopio, Cory, Hargreaves & Savitch LLP; Matt Rainey

(57) ABSTRACT

An energy storage system converts variable renewable electricity (VRE) to continuous heat. Intermittent electrical energy heats a solid medium. Heat from the solid medium is delivered continuously on demand. An array of bricks incorporating internal radiation cavities is directly heated by thermal radiation. The cavities facilitate rapid, uniform heating via reradiation. Heat delivery via flowing gas establishes a thermocline which maintains high outlet temperature throughout discharge. Gas flows through structured pathways within the array, delivering heat which may be used for processes including calcination, hydrogen electrolysis, steam generation, and thermal power generation and cogeneration. Low temperature waste heat from energy production can be recovered and used to improve overall system efficiency.

97 Claims, 34 Drawing Sheets

(56) References Cited

U.S. PATENT DOCUMENTS 1,700,642 A 1/1929 Meindersma
2,833,532 A 5/1958 Ries
3,103,917 A 9/1963 Bauer et al.
3,381,113 A 4/1968 Jacques et al.
3,549,136 A 12/1970 Baab et al.
3,788,066 A 1/1974 Nebgen
3,908,381 A 9/1975 Barber et al.
3,995,434 A 12/1976 Kato et al.
4,011,430 A 3/1977 Witkin et al.
4,028,884 A 6/1977 Martz et al.
4,110,987 A 9/1978 Cahn et al.
4,123,909 A 11/1978 French
4,124,061 A 11/1978 Mitchell et al.
4,127,161 A 11/1978 Clyne et al.
4,146,057 A 3/1979 Friedman et al.
4,172,442 A 10/1979 Boblitz
4,200,783 A 4/1980 Ehret
4,222,365 A 9/1980 Thomson
4,234,782 A 11/1980 Barabas et al.
4,237,692 A 12/1980 Ahrens et al.
4,312,324 A 1/1982 Ross et al.
4,329,592 A 5/1982 Wagner et al.
4,397,962 A 8/1983 Schockmel
4,438,630 A 3/1984 Rowe
4,524,756 A 6/1985 Ahrens et al.
4,651,810 A 3/1987 Triessnig
4,809,523 A * 3/1989 Vandenberg ..... F25B 27/005 62/235.1
4,874,034 A 10/1989 Hirata et al.
4,979,374 A 12/1990 Kabakov et al.
5,154,224 A 10/1992 Yasui et al.
5,286,472 A 2/1994 Fulford
5,384,489 A 1/1995 Bellac
5,416,416 A 5/1995 Bisher
5,419,388 A 5/1995 Hickel et al.
5,553,604 A 9/1996 Frei
5,634,313 A 6/1997 Mögling
5,924,477 A 7/1999 Doru
6,274,855 B1 8/2001 Tatematsu et al.
6,302,188 B1 10/2001 Ruhl et al.
6,322,356 B1 11/2001 Gupta et al.
6,631,754 B1 10/2003 Bremont et al.
7,213,409 B1 5/2007 Nuckols
7,693,402 B2 4/2010 Hudson et al.
7,800,024 B2 9/2010 Duguay et al.
8,226,917 B2 7/2012 Fan et al.
8,544,275 B2 10/2013 Shinnar
8,701,773 B2 4/2014 O'Donnell et al.
8,960,182 B2 2/2015 Magaldi et al.
9,370,044 B2 6/2016 McDonald
9,512,826 B2 12/2016 Rodionov et al.
9,556,708 B2 1/2017 Schneider et al.
9,642,188 B2 5/2017 Bach et al.
9,816,490 B2 11/2017 Conlon
9,816,491 B2 11/2017 Perry
9,948,140 B2 4/2018 Pietsch et al.
9,989,271 B1 6/2018 Becker
10,113,535 B2 10/2018 Conlon
10,221,726 B2 3/2019 Balczunas et al.
10,334,881 B1 7/2019 Conley et al.
10,345,050 B2 7/2019 Pietsch et al.
10,527,026 B2 1/2020 Muir et al.
10,767,935 B2 9/2020 Bergan et al.
10,775,111 B2 9/2020 Kerth
10,876,521 B2 12/2020 Anderson et al.
11,038,431 B2 6/2021 Ness et al.
11,352,951 B2 6/2022 Apte et al.
11,459,944 B2 10/2022 Robinson
11,480,160 B1 10/2022 Mokheimer et al.
11,603,776 B2 3/2023 O'Donnell et al.
11,809,153 B1 11/2023 Kearns et al.
11,994,347 B2 5/2024 Ponec et al.
2003/0101728 A1 6/2003 Wakana et al.
2003/0113255 A1 6/2003 Harlan
2004/0062063 A1 4/2004 Siri
2004/0099261 A1 5/2004 Litwin
2004/0148922 A1 8/2004 Pinkerton
2004/0182081 A1 9/2004 Sim et al.
2004/0211215 A1 10/2004 Maier-Laxhuber et al.
2005/0095500 A1 5/2005 Corless et al.
2005/0126172 A1 6/2005 Hudson et al.
2006/0107664 A1 5/2006 Hudson et al.
2006/0165908 A1 7/2006 Fey et al.
2006/0174622 A1 8/2006 Skowronski
2006/0179840 A1 8/2006 Murphy et al.
2006/0211777 A1 9/2006 Severinsky
2006/0231466 A1 10/2006 Nuber
2006/0266039 A1 11/2006 Skowronski et al.
2006/0277910 A1 12/2006 Hoetger
2007/0209365 A1 9/2007 Hamer et al.
2007/0220889 A1 9/2007 Nayef et al.
2008/0000231 A1 1/2008 Litwin et al.
2008/0066736 A1 3/2008 Zhu
2008/0127647 A1 6/2008 Leitner
2008/0134681 A1 6/2008 Nayef et al.
2008/0279761 A1 11/2008 Kimura et al.
2008/0318143 A1 12/2008 Nakayama et al.
2009/0038668 A1 2/2009 Plaisted
2009/0090109 A1 4/2009 Mills et al.
2009/0117633 A1 5/2009 Bradley et al.
2009/0125152 A1 5/2009 Skowronski et al.
2009/0208402 A1 8/2009 Rossi
2009/0320828 A1 12/2009 Koketsu et al.
2010/0005966 A1 1/2010 Wibberley
2010/0101462 A1 4/2010 Hayashi et al.
2010/0132391 A1 6/2010 Barot
2010/0178156 A1 7/2010 Rivas Cortes et al.
2010/0195357 A1 8/2010 Fornage et al.
2010/0229523 A1 9/2010 Holt et al.
2010/0251711 A1 10/2010 Howes et al.
2010/0295306 A1 11/2010 Ridnik et al.
2011/0083443 A1 4/2011 Jockenhoevel et al.
2011/0226440 A1 9/2011 Bissell et al.
2011/0247335 A1 10/2011 Schmid et al.
2011/0277469 A1 11/2011 Brenmiller et al.
2011/0286902 A1 11/2011 Fan et al.
2011/0289924 A1 12/2011 Pietsch
2012/0067047 A1* 3/2012 Peterson ..... F03G 6/001 60/659
2012/0097151 A1 4/2012 Matsuno et al.
2012/0102950 A1 5/2012 Turchi
2012/0131898 A1 5/2012 Mokheimer et al.
2012/0151926 A1 6/2012 Labbe
2012/0167559 A1 7/2012 Havel
2012/0167567 A1 7/2012 Kleine
2012/0227926 A1 9/2012 Field et al.
2012/0241677 A1 9/2012 Perkins et al.
2012/0255309 A1 10/2012 Venetos et al.
2012/0286524 A1 11/2012 Bronicki
2013/0025817 A1 1/2013 Callaghan
2013/0047976 A1 2/2013 Kaftori
2013/0056170 A1 3/2013 Klemencic
2013/0081394 A1 4/2013 Perry
2013/0081395 A1 4/2013 Frey et al.
2013/0118169 A1 5/2013 Milam et al.
2013/0175006 A1 7/2013 Robinson et al.
2014/0004469 A1 1/2014 Recourt et al.
2014/0053554 A1 2/2014 Tartibi et al.
2014/0074314 A1 3/2014 Niknafs et al.
2014/0102073 A1 4/2014 Pang et al.
2014/0116069 A1 5/2014 Peterson et al.
2014/0190469 A1 7/2014 O'Donnell et al.
2014/0216717 A1 8/2014 O'Donnell et al.
2014/0223906 A1 8/2014 Gee et al.
2014/0224469 A1 8/2014 Mirmobin et al.
2014/0366536 A1 12/2014 Muren
2015/0007577 A1 1/2015 Li et al.
2015/0027122 A1 1/2015 Brunhuber
2015/0033740 A1 2/2015 Anderson et al.
2015/0053266 A1 2/2015 Chen et al.
2015/0134120 A1 5/2015 Sun et al.
2015/0143806 A1* 5/2015 Friesth ..... F03G 7/04 220/592.2
2015/0143811 A1 5/2015 Pang et al.

(56) References Cited

U.S. PATENT DOCUMENTS

| | | | |
|---|---|---|---|
| 2015/0167489 | A1 | 6/2015 | Heiligenstein et al. |
| 2015/0176920 | A1 | 6/2015 | Vendeirinho |
| 2015/0224850 | A1 | 8/2015 | Bank et al. |
| 2015/0267566 | A1 | 9/2015 | Vamvas |
| 2015/0276234 | A1 | 10/2015 | Muro et al. |
| 2015/0295508 | A1 | 10/2015 | Conry |
| 2015/0354545 | A1 | 12/2015 | Conlon |
| 2015/0369125 | A1 | 12/2015 | Reiter et al. |
| 2016/0130709 | A1 | 5/2016 | Hong et al. |
| 2016/0146110 | A1 | 5/2016 | Hackstein et al. |
| 2016/0164451 | A1 | 6/2016 | Lenert et al. |
| 2016/0208657 | A1 | 7/2016 | Brückner et al. |
| 2016/0214910 | A1 | 7/2016 | King |
| 2016/0281607 | A1 | 9/2016 | Asati et al. |
| 2016/0301093 | A1 | 10/2016 | Bosmann et al. |
| 2016/0355932 | A1 | 12/2016 | Reytier et al. |
| 2017/0051949 | A1 | 2/2017 | Uselton |
| 2017/0058768 | A1 | 3/2017 | Bergins et al. |
| 2017/0093163 | A1 | 3/2017 | Johnson et al. |
| 2017/0204741 | A1 | 7/2017 | Hogen et al. |
| 2017/0241649 | A1 | 8/2017 | Cave |
| 2017/0241669 | A1 | 8/2017 | von Behrens |
| 2017/0283713 | A1 | 10/2017 | Stephens et al. |
| 2017/0362090 | A1 | 12/2017 | Melsert et al. |
| 2017/0362724 | A1 | 12/2017 | Planque et al. |
| 2018/0003445 | A1 | 1/2018 | Bergan et al. |
| 2018/0028967 | A1 | 2/2018 | Balfe et al. |
| 2018/0038352 | A1 | 2/2018 | Conlon |
| 2018/0073777 | A1 | 3/2018 | O'Donnell et al. |
| 2018/0083449 | A1 | 3/2018 | Green |
| 2018/0106739 | A1 | 4/2018 | Esmaili et al. |
| 2018/0163574 | A1 | 6/2018 | Bailey et al. |
| 2018/0179955 | A1 | 6/2018 | Apte et al. |
| 2018/0207557 | A1 | 7/2018 | Nellis |
| 2018/0216010 | A1 | 8/2018 | Hong |
| 2018/0231316 | A1 | 8/2018 | Watremetz et al. |
| 2018/0238563 | A1 | 8/2018 | Stepa et al. |
| 2018/0245485 | A1 | 8/2018 | Conlon |
| 2018/0278439 | A1 | 9/2018 | Cox |
| 2018/0292097 | A1 | 10/2018 | Specter |
| 2018/0347406 | A1 | 12/2018 | Friesth |
| 2018/0372337 | A1* | 12/2018 | Walker ..... F28D 20/0034 |
| 2018/0372420 | A1 | 12/2018 | Ahadi et al. |
| 2019/0003308 | A1 | 1/2019 | Laughlin |
| 2019/0043624 | A1 | 2/2019 | Fork et al. |
| 2019/0045617 | A1 | 2/2019 | Fork et al. |
| 2019/0096535 | A1 | 3/2019 | Olshansky et al. |
| 2019/0140477 | A1 | 5/2019 | Yang et al. |
| 2019/0162482 | A1 | 5/2019 | Kerth |
| 2019/0170436 | A1 | 6/2019 | De et al. |
| 2019/0186786 | A1 | 6/2019 | Neiser |
| 2019/0226462 | A1 | 7/2019 | Conlon |
| 2019/0245224 | A1 | 8/2019 | Lacroix et al. |
| 2019/0331098 | A1 | 10/2019 | von Behrens et al. |
| 2019/0359894 | A1 | 11/2019 | Heidel et al. |
| 2020/0095984 | A1 | 3/2020 | Karni et al. |
| 2020/0124356 | A1 | 4/2020 | Ma et al. |
| 2020/0172815 | A1 | 6/2020 | Stephens et al. |
| 2020/0217518 | A1 | 7/2020 | Field et al. |
| 2020/0232345 | A1 | 7/2020 | Zwinkels |
| 2020/0332201 | A1 | 10/2020 | Koseoglu et al. |
| 2020/0346165 | A1 | 11/2020 | Lu et al. |
| 2020/0358112 | A1 | 11/2020 | Chatroux et al. |
| 2020/0378599 | A1 | 12/2020 | Risseeuw et al. |
| 2020/0386447 | A1 | 12/2020 | Wang |
| 2021/0053689 | A1 | 2/2021 | Lynn et al. |
| 2021/0094834 | A1 | 4/2021 | Chen et al. |
| 2021/0143446 | A1 | 5/2021 | Ponec et al. |
| 2021/0172685 | A1 | 6/2021 | Bergan et al. |
| 2021/0190044 | A1 | 6/2021 | Anderson et al. |
| 2021/0207527 | A1 | 7/2021 | Robinson |
| 2021/0211066 | A1 | 7/2021 | Vavilpalli et al. |
| 2021/0325069 | A1* | 10/2021 | Cotton ..... F24F 5/0021 |
| 2021/0328544 | A1 | 10/2021 | Johnson et al. |
| 2021/0389056 | A1 | 12/2021 | Calvet et al. |
| 2022/0049615 | A1 | 2/2022 | Truong |
| 2022/0049631 | A1 | 2/2022 | Deng |
| 2022/0060142 | A1 | 2/2022 | Akhavan-Tafti |
| 2022/0085603 | A1 | 3/2022 | McNamara et al. |
| 2022/0090827 | A1 | 3/2022 | Magaldi et al. |
| 2022/0132633 | A1 | 4/2022 | Forsberg et al. |
| 2022/0146205 | A1 | 5/2022 | Eronen et al. |
| 2022/0170386 | A1 | 6/2022 | O'Donnell et al. |
| 2022/0228271 | A1 | 7/2022 | Ashok et al. |
| 2022/0228772 | A1 | 7/2022 | Murata et al. |
| 2022/0268179 | A1 | 8/2022 | O'Donnell et al. |
| 2022/0290929 | A1 | 9/2022 | Doerbeck |
| 2022/0307386 | A1 | 9/2022 | Savic et al. |
| 2022/0403759 | A1 | 12/2022 | Stapp, III et al. |
| 2022/0412228 | A1 | 12/2022 | Ponec et al. |
| 2023/0052951 | A1 | 2/2023 | Migl et al. |
| 2023/0086892 | A1 | 3/2023 | Robertson et al. |
| 2023/0216297 | A1 | 7/2023 | Peri et al. |
| 2023/0287808 | A1 | 9/2023 | Conlon |
| 2023/0407186 | A1 | 12/2023 | Sundaram et al. |
| 2024/0092646 | A1 | 3/2024 | Isobe et al. |
| 2024/0418106 | A1 | 12/2024 | Bostick et al. |
| 2025/0026986 | A1 | 1/2025 | Zellhuber et al. |

FOREIGN PATENT DOCUMENTS

| | | | |
|---|---|---|---|
| AU | 2016204109 | B2 | 5/2018 |
| CH | 703751 | A1 | 3/2012 |
| CN | 1559893 | A | 1/2005 |
| CN | 101799200 | A | 8/2010 |
| CN | 101592439 | B | 4/2011 |
| CN | 102897812 | A | 1/2013 |
| CN | 104242433 | A | 12/2014 |
| CN | 104296577 | B | 4/2016 |
| CN | 105575659 | A | 5/2016 |
| CN | 105605957 | A | 5/2016 |
| CN | 105948037 | A | 9/2016 |
| CN | 106052451 | A | 10/2016 |
| CN | 106247836 | A | 12/2016 |
| CN | 107246732 | A | 10/2017 |
| CN | 107872196 | A | 4/2018 |
| CN | 108167034 | A | 6/2018 |
| CN | 108204760 | A | 6/2018 |
| CN | 108362151 | A | 8/2018 |
| CN | 108362152 | A | 8/2018 |
| CN | 108612634 | A | 10/2018 |
| CN | 106767074 | B | 12/2018 |
| CN | 109883241 | A | 6/2019 |
| CN | 110411260 | A | 11/2019 |
| CN | 111256364 | A | 6/2020 |
| CN | 210802160 | U | 6/2020 |
| CN | 211183438 | U | 8/2020 |
| CN | 111655989 | A | 9/2020 |
| CN | 110725725 | B | 12/2020 |
| CN | 112113203 | A | 12/2020 |
| CN | 212157096 | U | 12/2020 |
| CN | 113835372 | A | 12/2021 |
| CN | 114754617 | A | 7/2022 |
| CN | 109445511 | B | 3/2024 |
| DE | 19808810 | C1 | 6/1999 |
| DE | 10029732 | A1 | 1/2002 |
| DE | 102008051384 | B3 | 2/2010 |
| DE | 102009020531 | B3 | 4/2011 |
| DE | 102012024526 | B4 | 9/2014 |
| DE | 102013212981 | A1 | 1/2015 |
| DE | 102017212684 | A1 | 1/2019 |
| DE | 102019210737 | A1 | 1/2021 |
| EP | 79247 | A1 | 5/1983 |
| EP | 794161 | B1 | 2/2003 |
| EP | 1930587 | A2 | 6/2008 |
| EP | 2372116 | A1 | 10/2011 |
| EP | 2722496 | A2 | 4/2014 |
| EP | 3081770 | A1 | 10/2016 |
| EP | 3324018 | A1 | 5/2018 |
| EP | 3486594 | A1 | 5/2019 |
| EP | 2837086 | B1 | 11/2019 |
| EP | 3245388 | B1 | 11/2019 |
| EP | 3574191 | A1 | 12/2019 |
| EP | 3725917 | A1 | 10/2020 |

(56) References Cited

FOREIGN PATENT DOCUMENTS

| | | | |
|---|---|---|---|
| EP | 2909547 | B1 | 9/2021 |
| EP | 3642296 | B1 | 1/2022 |
| GB | 2109026 | A | 5/1983 |
| GB | 2152652 | A | 8/1985 |
| GB | 2477801 | A | 8/2011 |
| IL | 284451 | | 8/2021 |
| JP | S63-119874 | U | 8/1988 |
| JP | 2006145200 | A | 6/2006 |
| KR | 2001-0100320 | A | 11/2001 |
| KR | 102308531 | B1 | 10/2021 |
| MA | 40029 | A | 12/2015 |
| TW | 202100240 | A | 1/2021 |
| WO | WO 1980/000170 | | 2/1980 |
| WO | WO 2007/108014 | A1 | 9/2007 |
| WO | WO 2008/052249 | A1 | 5/2008 |
| WO | WO 2008/108870 | A1 | 9/2008 |
| WO | WO 2009/152562 | A1 | 12/2009 |
| WO | WO 2011/066039 | A1 | 6/2011 |
| WO | WO 2011/077248 | A2 | 6/2011 |
| WO | WO 2011/109514 | A1 | 9/2011 |
| WO | WO 2012/123853 | A1 | 9/2012 |
| WO | WO 2012/127178 | A1 | 9/2012 |
| WO | WO 2012/150969 | A1 | 11/2012 |
| WO | WO 2013/020176 | A1 | 2/2013 |
| WO | WO 2014/063191 | A1 | 5/2014 |
| WO | WO 2014/151843 | A2 | 9/2014 |
| WO | WO 2015/149124 | A1 | 10/2015 |
| WO | WO 2015/187423 | A2 | 12/2015 |
| WO | 2016/062425 | A1 | 4/2016 |
| WO | WO 2016/065191 | A1 | 4/2016 |
| WO | WO 2016/150455 | A1 | 9/2016 |
| WO | WO 2017/001710 | A1 | 1/2017 |
| WO | WO 2017/049320 | A1 | 3/2017 |
| WO | WO 2017/147022 | A1 | 8/2017 |
| WO | WO 2018/011363 | A1 | 1/2018 |
| WO | 2018/024409 | A1 | 2/2018 |
| WO | WO 2018/101989 | A1 | 6/2018 |
| WO | WO 2018/164647 | A1 | 9/2018 |
| WO | WO 2019/020562 | A1 | 1/2019 |
| WO | WO 2019/149623 | A1 | 8/2019 |
| WO | WO 2019/224538 | A1 | 11/2019 |
| WO | WO 2020/068758 | A1 | 4/2020 |
| WO | 2020/136456 | A1 | 7/2020 |
| WO | WO 2020/254001 | A1 | 12/2020 |
| WO | WO 2022/086630 | A1 | 4/2022 |
| WO | WO 2022/187903 | A1 | 9/2022 |
| WO | 2023/219610 | A1 | 11/2023 |
| ZA | 201603514 | B | 11/2018 |

OTHER PUBLICATIONS

Song, Jian, et al., "Combined supercritical CO2 (SCO2) cycle and organic Rankine cycle (ORC) system for hybrid solar and geothermal power generation: Thermoeconomic assessment of various configurations", (Year: 2021), in 16 pages.

"Ethylene Production via Cracking of Ethane-Propane", Chemical Engineering, Nov. 1, 2015, Total pp. 4.

"Matching Time of Use Periods With Grid Conditions Maximizes Use of Renewable Resources", California ISO, Outcropping Way, Folsom, 2015, Total pp. 2.

"Miscibility Gap Alloys", University of Newcastle, accessed at https://miscibilitygapalloy.blogspot.com/p/how-did-it-stater-ted.html on Apr. 2, 2022.

Aaron Rimpel et al., "Liquid Air Combined Cycle (LACC) for Power and Storage", Thermal-Mechanical-Chemical Energy Storage (TMCES) Workshop, Aug. 10-11, 2021, Total pp. 6.

Alexis McKittrick, "Low Temperature & Coproduced Resources Reservoir Thermal Energy Storage (RTES) Portfolio", Geothermal Technologies Office, U.S. Department of Energy, dated Feb. 2022. Total pp. 4.

Anthony Rawson et al., "Effective conductivity of Cu—Fe and Sn—Al miscibility gap alloys", International Journal of Heat and Mass Transfer, vol. 77, Oct. 2014, pp. 395-405, Total pp. 11.

Antoni Gil et al., "State of the art on high temperature thermal energy storage for power generation. Part 1—Concepts, materials and modellization", Renewable and Sustainable Energy Reviews, vol. 14, Issue 1, Jan. 2010, pp. 31-55, Total pp. 25.

Audrey Barucchi, "Calix files a new patent for zero emissions iron and steel", https://www.calix.global/co2-mitigation-focus-area/new-patent-for-zero-emissions-iron-and-steel/, Nov. 23, 2021, Total pp. 5.

Bao Truong, "Malta Pumped Heat Energy Storage System Green Heat & Power Application", Energy Storage for Manufacturing and Industrial Decarbonization Workshop, Feb. 9, 2022, Total pp. 5.

Ben Bollinger, "Malta Pumped Heat Energy Storage", Malta, Aug. 10, 2021, Total pp. 9.

Cédric Philibert, "Renewable Energy for Industry", Renewable Energy Division, International Energy Agency, Nordic Pavillion, COP23, Fidji—Bonn, Nov. 15, 2017, Total pp. 17.

Charles Forsberg et al., "Coupling heat storage to nuclear reactors for variable electricity output with baseload reactor operation", The Electricity Journal, vol. 31, Issue 3, Apr. 2018, pp. 23-31, Total pp. 9.

Charles Forsberg et al., "Variable Electricity from Base-load Nuclear Power Plants Using Stored Heat", International Congress on Advances in Nuclear Power Plants (ICAPP 2015), May 2015, Total pp. 12.

Charles Forsberg, "Heat Storage and the Electricity Grid Integrating Nuclear and Renewables into a Low-Carbon Economic Grid", Massachusetts Institute of Technology, Jan. 2017, Massachusetts, Cambridge, Total pp. 114.

Charles Forsberg, "Hybrid systems to address seasonal mismatches between electricity production and demand in nuclear renewable electrical grids", Energy Policy, vol. 62, Nov. 2013, pp. 333-341, Total pp. 9.

Charles W Forsberg et al., "Converting excess low-price electricity into high-temperature stored heat for industry and high-value electricity production", The Electricity Journal, vol. 30, Issue 6, Jul. 2017, pp. 42-52, Total pp. 11.

Christopher Fraughton, "Electro-Thermal Energy Storage General Presentation", MAN Energy Solutions, Aug. 2021, Total pp. 23.

CK-12 Foundation, "Saturated Hydrocarbon", Apr. 2, 2022, Total pp. 8.

Clifford K. Ho, "High-Temperature Thermal Storage in Moving and Fixed Particle Beds", Thermal-Mechanical-Chemical Energy Storage (TMCES) Workshop, San Antonio, TX, dated Aug. 10, 2021. Total pp. 13.

Cowper Stove an Overview ScienceDirect Topics, Sep. 13, 2021, Total pp. 25.

D. Fernandes et al., Thermal energy storage: "How previous findings determine current research priorities", Energy, vol. 39, Issue 1, Mar. 2012, pp. 246-257, Total pp. 12.

Daniel C Stack et al., "Performance of firebrick resistance-heated energy storage for industrial heat applications and round-trip electricity storage", Applied Energy, vol. 242, May 15, 2019, pp. 782-796, Total pp. 15.

Daniel Christopher Stack, "Conceptual Design and Performance Characteristics of Firebrick Resistance-Heated Energy Storage for Industrial Heat Supply and Variable Electricity Production", Thesis, Master of Science in Nuclear Science and Engineering, Massachusetts Institute of Technology, Feb. 2017, Total pp. 166.

Daniel Christopher Stack, "Development of high-temperature firebrick resistance-heated energy storage (FIRES) using doped ceramic heating system", Thesis, Doctor of Philosophy in Nuclear Science and Engineering, Massachusetts Institute of Technology, Feb. 2021, Total pp. 121.

Daniel Stack et al., "Joule Hive-Replacing fire with renewable heat", Aug. 28, 2021, Total pp. 15.

David Bierman, "Clean, affordable, and reliable heat & electricity", Antora Energy, Feb. 2022, Total pp. 9.

David L. Chandler "MIT News: Turning desalination waste into a useful resource" MIT News Office, Feb. 13, 2019 (Cited in NFOA dated Sep. 14, 2022 in related U.S. Appl. No. 17/650,522.).

David Roberts, "Solar power's greatest challenge was discovered 10 years ago. It looks like a duck", www.vox.com, Aug. 29, 2018, Total pp. 19.

(56) References Cited

OTHER PUBLICATIONS

Dr. Avi Shultz, "Concentrating Solar-thermal Power and Thermal Energy Storage", U.S. Department of Energy, dated Feb. 8, 2022. Total pp. 7.
Dr. Avi Shultz, "Industrial Decarbonization:Renewable Process Heating from Concentrating Solar Thermal", U.S. Department of Energy, dated Feb. 8, 2022. Total pp. 6.
Dr. Eric L. Miller, "The Hydrogen Energy Earthshot and H2@Scale: Importance to Industrial Decarbonization", Energy StorM Panel, Feb. 8, 2022, Total pp. 9.
Dr. Gianluca Ambrosetti et al., "Cement Production", Energy Storage for Manufacturing and Industrial Decarbonization Workshop "Energy StorM", Feb. 8, 2022, Total pp. 10.
Dr. Jeffrey Goldmeer, "Power to Gas: Hydrogen for Power Generation Fuel Flexible Gas Turbines as Enablers for a Low or Reduced Carbon Energy Ecosystem," GE Power, Feb. 2019, 19 pages.
Echogen, "CO2-Based Pumped-Thermal Energy Storage Technical Overview & Status", Echogen Power System, Total pp. 20, Aug. 10-11, 2021.
Elizabeth Endler, "Energy Storage for Manufacturing Petrochemical Industry Perspective", Feb. 8, 2022, "Energy StorM" Workshop, US Department of Energy, Total pp. 14.
Elliott Group, "Materials for Hydrogen Compression", Thermo-Mechanical-Chemical Energy Storage Workshop, Elliott, Aug. 10-11, 2021, Total pp. 25.
Emiliano Bellini, "Long-duration thermal storage system based on silica sand", pv magazine International, Nov. 5, 2021, Total pp. 6.
Emiliano Bellini, "Storing wind, solar power with silica sands", pv magazine International, Sep. 1, 2021, Total pp. 10.
GE Energy Storage Unit RSU-4000, Modular, Scalable Energy Storage Solution for Utility-Scale Applications; www/ge.com/energystorage; 2020, 1 page.
Gregory C Staple, "California's Grid Geeks: Flattening the 'duck curve'", Jan. 25, 2017, www.greenbiz.com, Total Page Count 9.
Grid Energy Storage, U.S. Department of Energy, Dec. 2013, Total pp. 67.
Haisheng Chen et al., "Progress in electrical energy storage system: A critical review", Progress in Natural Science, vol. 19, Issue 3, Mar. 10, 2009, pp. 291-312, Total pp. 22.
Hamish Andrew Miller, et al. "Green hydrogen from anion exchange membrane water electrolysis: a review of recent developments in critical materials and operating conditions," rsc.li/sustainable-energy; DOI: 10.1039/c9se01240k; Received Dec. 14, 2019; Accepted Mar. 4, 2020; 20 pages.
Heber Sugo, "Miscibility gap alloys with inverse microstructures and high thermal conductivity for high energy density thermal storage applications", Applied Thermal Engineering, vol. 51, Issues 1-2, Mar. 2013, pp. 1345-1350, Total pp. 6.
Hélder Da Silva, "Energy Storage for Manufacturing and Industrial Decarbonization Workshop "Energy StorM"", Feb. 8, 2022, Total pp. 11.
Hitesh Bindra et al., "Sliding flow method for exergetically efficient packed bed thermal storage", Applied Thermal Engineering, vol. 64, Issues 1-2, Mar. 2014, pp. 201-208, Total pp. 8.
Hitesh Bindra et al., "Thermal analysis and exergy evaluation of packed bed thermal storage systems", Applied Thermal Engineering, vol. 52, Issue 2, Apr. 15, 2013, pp. 255-263, Total pp. 9.
"How thermal power plants can benefit from the energy transition", The Future of Energy 2019, Siemens Gamesa Renewable Energy, 10 pages.
Ilievski D, "New Two-Stage Calcination Technology", Proceedings of the 9th International Alumina Quality Workshop, Alcoa World Alumina, Technology Delivery Group, Western Australia, 2012, Total pp. 7.
Industrial Decarbonization using Electric Thermal Energy Storage (ETES), Jan. 25, 2022, Total pp. 11.
International Search Report mailed on Sep. 14, 2022 for International Application No. PCT/US2021/061041, 41 pages.
International Search Report and Written Opinion mailed on Mar. 1, 2024 for International Application No. PCT/US2023/034488, 14 pages.
International Search Report and Written Opinion mailed on May 17, 2024 for International Application No. PCT/US2023/085826, 14 pages.
International Search Report and Written Opinion mailed on Aug. 23, 2024 for International Application No. PCT/US2024/024158, 9 pages.
Jaume Gasia et al., "Review on system and materials requirements for high temperature thermal energy storage. Part 1: General requirements", Renewable and Sustainable Energy Reviews, vol. 75, Aug. 2017, pp. 1320-1338, Total pp. 19.
Jay Fitzgerald, "Bioenergy and Chemical Energy Storage", Energy Storage for Manufacturing & Industrial Decarbonization Workshop, Feb. 8-9, 2022, Total pp. 6.
Jeff Moore, "Development of sCO2 Turbomachinery and its Application to Energy Storage", Thermal Mechanical-Chemical-Energy-Storage Workshop, Aug. 10-11, 2021, San Antonio, TX, Total pp. 41.
Jeff Moore, "Oxygen Storage Incorporated into the Allam OxyFuel Power Cycle", Southwest Research Institute, Total pp. 8, Aug. 10-11, 2021.
Ji, Huichao, et al., "Electricity Consumption Prediction of Solid Electric Thermal Storage with a Cyber-Physical Approach", Energies 2019, 12, 47441 doi: 10.3390/en12244744, www.mdpi.com/journal/energies, published on Dec. 12, 2019, in 18 pages.
Joe Cresko, "Energy Storage for Manufacturing", Energy Storage for Manufacturing & Industrial Decarbonization Workshop, Feb. 8-9, 2022, Total pp. 11.
Joe Paladino, "Transformation of the Electric Grid", Energy StorM Workshop, Feb. 4, 2022, Total pp. 5.
Joe Stekli, "LCRI Update TMCES 2021", Low-Carbon Resources Initiative, Electric Power Research Institute, Aug. 2021, Total pp. 31.
Joshua Schmitt, "Development of an Advanced Hydrogen Energy Storage System Using Aerogel in a Cryogenic Flux Capacitor (Cfc)", Southwest Research Institute, Aug. 10, 2021, Total pp. 8.
Lion Hirth, "The market value of variable renewables: The effect of solar wind power variability on their relative price", Energy Economics, vol. 38, Jul. 2013, pp. 218-236, Total pp. 19.
Lion Hirth, "The Optimal Share of Variable Renewables: How the Variability of Wind and Solar Power affects their Welfare-optimal Deployment", The Energy Journal, vol. 36, No. 1, p. 149-184, (2015). Total pp. 36.
Lori Schaefer-Weaton, "Solar & Battery Energy Solution Agri-Industrial Plastics Co.", Agri-Industrial Plastics Company, Feb. 2022, Total pp. 12.
Luisa F Cabeza, "Advances in Thermal Energy Storage Systems Methods and Applications", Woodhead Publishing Series in Energy, No. 66, 2015, Total pp. 592.
M Gajendiran et al., "Application of Solar Thermal Energy Storage for Industrial Process Heating", Advanced Materials Research, vols. 984-985, Jul. 2014, Total pp. 7.
Marc Medrano et al., "State of the art on high-temperature thermal energy storage for power generation. Part 2—Case studies", Renewable and Sustainable Energy Reviews, vol. 14, Issue 1, Jan. 2010, pp. 56-72, Total 17.
Mathieu Hubert, "Lecture 3: Basics of industrial glass melting furnaces", IMI-NFG Course in Processing of Glass, Spring 2015, Total pp. 75.
Mecys Palsauskas, et al.: ""Device ensuring effective usage of photovoltaics for water heating"", Electrical Engineering, 101 (1), 189-202, Apr. 8, 2019 (Apr. 8, 2019), DOI: 10.1007/s00202-019-00766-0.
Michael Pesin, "The Office of Electricity Grid Modernization R&D Portfolio", Aug. 2, 2021, Total pp. 18.
Mike Gravely, "The Role of Energy Storage in Helping California Meet the State's Future Zero Carbon Energy Goals", Energy Research and Development Division, California, 2021, Total pp. 23.
Natalie Smith et al., "Integration of Pumped Heat Energy Storage with a Fossil-Fired Power Plant", U.S. Department of Energy, 2021, Total pp. 6.

(56) References Cited

OTHER PUBLICATIONS

PCT; Invitation to Pay Additional Fees issued in International Patent Application No. PCT/US2021/061041; mailed Mar. 24, 2022; 21 Pages.
Pintail Power LLC, "Liquid Air Combined Cycle Hybrid Energy Storage", Pintail Power LLC, TMCES Workshop, Aug. 10-11, 2021, San Antonio, TX, Total pp. 12.
Office Action in U.S. Appl. No. 17/650,519 mailed Apr. 20, 2022, 10 pages.
Office of Fossil Energy and Carbon Management, "U.S. Department of Energy Selects 12 Projects to Improve Fossil-Based Hydrogen Production, Transport, Storage and Utilization", dated Jul. 7, 2021, in 8 pages.
R. B. Laughlin, "Variable Blading in Closed-Cycle Brayton Energy Storage", TMCES, Aug. 10, 2021, San Antonio, Total pp. 26.
Rainer Kurz, "Hydrogen Pipelines & Storage", Mar. 8, 2021, Total pp. 16.
Reply to Communication Under Rule 71(3) EPC, received in corresponding EP App. No. 21 843 808.3, submitted May 6, 2024, in 9 pages.
Revterra, "Revterra Company Overview", TMCES 2021, Total pp. 14.
Reyad Sawafta, "Thermal Energy Storage—Cold Storage", Energy Storage for Manufacturing and Industrial Decarbonization Workshop, Feb. 9, 2022, Total pp. 11.
Richard Brody, "Powering the Carbon-Free Electric Future, Modular Geomechanical Pumped Storage (GPS)", Quidnet Energy, 3rd TMCES—Storage Deployment Panel, Aug. 11, 2021, Total pp. 7.
Richard T. Ibekwe, "Induction Heating of Firebricks for the Large-Scale Storage of Nuclear and Renewable Energy", Massachusetts Institute of Technology, Jun. 2018, Total pp. 40.
Robert J. Krane, "A second law analysis of a thermal energy storage system with Joulean heating of the storage element", American Society of Mechanical Engineers, Winter Annual Meeting, Miami Beach, Florida, USA, Nov. 17-21, 1985, Total pp. 10.
Russ Weed, "Market Needs & Technology Overview", Thermal-Mechanical-Chemical Energy Storage Workshop—Storage Deployment, Aug. 11, 2021, Total pp. 20.
S. W. Sucech et al., "Alcoa Pressure Calcination Process for Alumina", Light Metals 1986, R.E. Miller, 669-674, Total pp. 6.
Sanjoy Banerjee, "Energy Storage to Decarbonize the Industrial Sector Through Direct Electrification", Energy Storage for Manufacturing and Industrial Decarbonization Workshop, Feb. 8, 2022, Total pp. 9.
Scott Hume, "Mid-Duration Energy Storage (MDES) Benefits and Challenges", 3rd TMCES Workshop, Aug. 10, 2021, Total pp. 11.
Sempra Energy Utility, "SoCalGas", Total pp. 6, Oct. 2021.
Sharadga, Hussein, et al., "A hybrid PV/T and Kalina cycle for power generation", Int J Energy Res. 2018;42:4817-4829, https://doi.org/10.1002/er.4237, dated Sep. 7, 2018.
Shaun Sullivan, "Reversible Counter-Rotating Turbomachine to Enable Brayton-Laughlin Cycle", 3rd Thermal-Mechanical-Chemical Energy Storage Workshop, Aug. 10, 2021, San Antonio TX, Total pp. 7.
Siemens AG, "Compressed Air Energy Storage (CAES)", 3rd Thermal-Mechanical-Chemical Energy Storage Workshop, Siemens Energy, Aug. 2021, Total pp. 17.
Siemens Gamesa, "Electric Thermal Energy Storage (ETES)—Industrial Decarbonization", Siemens Gamesa Renewable Energy, 2020, Total pp. 9.
Soteris Kalogirou, "The potential of solar industrial process heat applications", Applied Energy, vol. 76, Issue 4, Dec. 2003, pp. 337-361, Total pp. 25.
Steffes, ThermElect Hydronic, Demand-Free, Off-Peak Heating, May 2020, Total pp. 2.
Stefica Nicol Bikes, "Australian engineers patent thermal block to store renewable energy", www.reuters.com, Oct. 26, 2021, Total pp. 6.
Storworks Power, 3rd Thermal-Mechanical-Chemical Energy Storage Workshop, Aug. 10, 2021, Total pp. 8.
Swagelok Energy Advisors Inc, "Steam Quality—Plant Operations Require A High Steam Quality", Steam Systems Best Practices, Document No. 23, 2009, Total pp. 3.
T. Fiedler et al., "Thermal capacitors made from Miscibility Gap Alloys (MGAs)", WIT Transactions on Ecology and The Environment, vol. 186, 2014, Total pp. 8.
Third Party Objections raised in corresponding EP App. No. 21 843 808.3, dated Apr. 30, 2024, with English Translation, in 8 pages.
Thomas A. Buscheck, "Hybrid-energy technology enabled by heat storage and oxy-combustion for power and industrial-heat applications with near-zero or negative CO2 emissions", Thermal-Mechanical-Chemical Energy Storage Workshop, San Antonio, Texas, Aug. 10, 2021, Total pp. 22.
Timothy C. Allison, "Thermal-Mechanical-Chemical Energy Storage Technology Overview and Research Activities", Southwest Research Institute, Aug. 9, 2021, Total pp. 22.
Todd Brix, "Converting Carbon. Storing Energy", Richland, Washington U.S.A, Feb. 9, 2022, Total pp. 13.
Tony Bowdery et al., "Heat Exchangers For Thermal Energy Storage: Challenges And Mitigation", Meggitt, Aug. 2021, Total pp. 20.
Torbjörn Lindquist, "Powering the evolution of a renewable society, by redefining energy infrastructure", Azelio, Feb. 7, 2022, Total pp. 10.
Travis McLing et al., "Dynamic Earth Energy Storage: Grid Scale Energy Storage using Planet Earth as a Thermal Battery (RTES)", Feb. 2022, Total pp. 7.
Trevor Brown, "Ammonia: the other hydrogen", Energy Storage for Manufacturing and Industrial Decarbonization Workshop "Energy StorM", Feb. 9, 2022, Total pp. 13.
Veera Gnaneswar Gude, "Energy storage for desalination processes powered by renewable energy and waste heat sources", Applied Energy, vol. 137, Jan. 1, 2015, pp. 877-898, Total pp. 22.
Vishal Sardeshpande, "Performance analysis for glass furnace regenerator", Applied Energy, vol. 88, Issue 12, Dec. 2011, pp. 4451-4458, Total pp. 8.
Whitlock, "NREL scientists partnering with Antora Energy and MIT on TPV projects" Renewable Energy Magazine Dec. 10, 2021, https://www.renewableenergymagazine.com/pv_solar/nrel-scientists-partnering-with-antoraenergy-and-20211210.
Written Opinion of the International Searching Authority mailed on Sep. 14, 2022 for PCT/US2021/061041, 26 pages.
Zhao, Haichuan, et al., "Thermal Calculation and Experimental Investigation of Electric Heating and Solid Thermal Storage System", Energies 2020, 13, 5241; doi: 10.3390/en13205241, www.mdpi.com/journal/energies, published on Oct. 9, 2020, in 20 pages.
Zhou et al., "Highly Conductive Porous Graphene/Ceramic Composites for Heat Transfer and Thermal Energy Storage," Adv. Funct. Mater., 2013, 23, pp. 2263-2269.
International Search Report and Written Opinion mailed on Aug. 29, 2025 for International Application No. PCT/US2025/030863, 19 pages.
Ametek Process Instruments, "Reduce Nox Emissions While Improving Fuel Efficiency", EDG Series Gas Analyzers, Year: 2018, in 2 pages.
Fakhroleslam, Mohammad, et al., "Thermal/catalytic cracking of hydrocarbons for the production of olefins; a state-of-the-art review III: Process modeling and simulation", Elsevier, www.elsevier.com/locate/fuel, Fuel 252 (2019) 553-566, in 14 pages.
Sakakibara, Reyu, et al., "Practical emitters for thermophotovoltaics: a review", Journal of Photonics for Energy, vol. 9, Issue 3, 032713 (Feb. 2019), https://doi.org/10.1117/1.JPE.9.032713, in 38 pages.
International Search Report and Written Opinion mailed on Oct. 16, 2025 for International Application No. PCT/US2025/036518, 13 pages.
International Search Report and Written Opinion mailed on Oct. 21, 2025 for International Application No. PCT/US2025/026289, 19 pages.
Waste Heat Recovery: Technology and Opportunities in U.S. Industry, prepared by BCS, Incorporation, Mar. 2008, in 112 pages.

(56) References Cited

OTHER PUBLICATIONS

International Search Report and Written Opinion mailed on Apr. 25, 2025 for International Application No. PCT/US2024/051145, 19 pages.
Deepinder Jot Singh, et al., "On the reduction of electric energy consumption in electrolysis: A thermodynamic study," www.sciencedirect.com, Mar. 26, 2021, Total 13 pages.

* cited by examiner

THERMAL ENERGY STORAGE SYSTEM WITH A HEAT PUMP FOR IMPROVED EFFICIENCY

CROSS-REFERENCE TO RELATED APPLICATIONS

This application claims priority to the following provisional applications:

U.S. Provisional Patent Application No. 63/678,465 filed on Aug. 1, 2024, and

U.S. Provisional Patent Application No. 63/544,106 filed on Oct. 13, 2023.

The contents of these priority applications are incorporated by reference in their entirety and for all purposes.

Additionally, the following patent applications are directed to related technologies, and are incorporated by reference in their entirety for all purposes:

U.S. patent application Ser. No. 17/537,407 (filed Nov. 29, 2021; issued as U.S. Pat. No. 11,603,776 on Mar. 14, 2023), and International Patent Application No.: PCT/US2021/061041 (filed Nov. 29, 2021).

Section A describes various embodiments of a high efficiency energy system, some of which use a thermal energy storage system and a heat pump.

BACKGROUND

Thermal energy storage systems can be used to store electrical energy in the form of heat, which can be used for the continuous supply of hot air, carbon dioxide ($CO_2$), steam or other heated fluids, for various applications including the supply of thermal energy to industrial processes and/or electrical power generation. This can be particularly useful to store excess energy during times of the day when a large amount of electrical energy is being generated but actual energy usage at that time is low.

Some of these thermal energy storage systems can be used to power a turbine which in turn creates electricity that powers a facility such as a data center. Because of turbine inefficiencies, waste heat is created alongside the electricity. The electricity that powers the servers or computers at the data center also generates its own waste heat. These heat losses from the turbine and the data center result in a system that is not as efficient as it could be. Unfortunately, it remains challenging to effectively recapture the waste heat for productive uses as the waste heat is typically at a temperature too low to be directly usable.

SUMMARY

The example implementations advance the art of thermal energy storage and enable the practical construction and operation of high efficiency thermal energy storage systems which are charged by intermittent electricity, store energy in a media, and deliver heat at desired temperatures. Some aspects of the example implementations relate to systems for heat recovery and improved overall system efficiency. In at least some implementations, the combined system may deliver all or a combination of high efficiency cooling, heating, and/or power generation with all or at least a majority of the driving energy coming from a thermal energy storage (TES) system. The TES system charges from electricity or other energy source intermittently (or optionally continuously) and stores energy as heat at high temperatures. Compared to other forms of energy storage such as electrochemical batteries, the efficiency of thermal storage is higher (~92-99% efficient for TES for ~85% for electrochemical batteries) and the cost is lower. The system can provide continuous heating, cooling and power generation while charging entirely from intermittent renewable electricity. Depending on the process conditions and level of heat recovery built into a heat pump coupled to such a system, the heat pump can deliver medium temperature heat at a COP of up to 2.5. The combined energy efficiency is very high (>90%). Efficiency advantages exist compared to comparable, conventional heating and cooling practices.

At least some of the embodiments disclosed herein present configurations that cover several integrations of heat pumps and chillers with a TES system. To mitigate carbon emissions, the system can utilize electricity from intermittent renewables such as wind and solar power to electrically charge the TES. Many processes desire continuous operation which makes fully powering a process with intermittent renewables challenging. If the process is continuous but relies on intermittent power sources, a TES system can be implemented to provide such continuous output. Thus, instead of having a renewable energy source, an electrochemical battery, and a compression heat pump/chiller, one could have a renewable energy source, a TES battery, and a sorption heat pump/chiller. Several possible thermal integrations based on this premise are described herein. Optionally, some integrations may rely on additional specific requirements to demonstrate their value.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

INCORPORATION BY REFERENCE

All publications, patents, and patent applications mentioned in this specification are herein incorporated by reference to the same extent as if each individual publication, patent, or patent application was specifically and individually indicated to be incorporated by reference. However, in the event of a conflict between the content of the present express disclosure and the content of a document incorporated by reference herein, the content of the present express disclosure controls.

COPYRIGHT

This document contains material subject to copyright protection. The copyright owner (Applicant herein) has no objection to facsimile reproduction of the patent documents and disclosures, as they appear in the US Patent and Trademark Office patent file or records, but otherwise reserves all copyright rights whatsoever. The following notice shall apply: Copyright © 2021-2024 Rondo Energy, Inc.

BRIEF DESCRIPTION OF DRAWINGS

The accompanying drawings are included to provide a further understanding of the present disclosure and are incorporated in and constitute a part of this specification. The drawings illustrate example implementations of the present disclosure and, together with the description, serve to explain the principles of the present disclosure.

In the drawings, similar components and/or features may have the same reference label. Further, various components of the same type may be distinguished by following the reference label with a second label that distinguishes among the similar components. If only the first reference label is used in the specification, the description is applicable to any one of the similar components having the same first reference label irrespective of the second reference label.

FIG. 1 illustrates a schematic diagram of the thermal energy storage system architecture according to the example implementations.

FIG. 2 illustrates a schematic diagram of a system according to the example implementations.

FIG. 3 illustrates a schematic diagram of a storage-fired once-through steam generator (OTSG) according to the example implementations.

FIG. 4 illustrates an example view of a system being used as an integrated cogeneration system according to the example implementations.

FIG. 5 illustrates dynamic insulation according to the example implementations.

FIG. 6 illustrates an isometric view of the thermal storage unit with multiple vents closures open, according to some implementations.

DETAILED DESCRIPTION

Aspects of the example implementations, as disclosed herein, relate to systems, methods, materials, articles, and improvements for a thermal energy storage system for power generation for various applications. The embodiments, implementations, or integrations described herein are exemplary and non-limiting. Any specifics such as, but not limited to, temperatures, pressures, conditions, or efficiency numbers are exemplary only, are non-limiting, and are primarily intended to illustrate some but not necessarily all operating conditions.

I. Thermal Energy Storage System

This Section I of the Summary relates to the disclosure as it appears in U.S. Pat. No. 11,603,776, which is incorporated herein by reference in its entirety as noted above.

U.S. Pat. No. 11,603,776 relates to the field of thermal energy storage and utilization systems and addresses the above-noted problems. A thermal energy storage system is disclosed that stores electrical energy in the form of thermal energy in a charging mode and delivers the stored energy in a discharging mode. The discharging can occur at the same time as charging; i.e., the system may be heated by electrical energy at the same time that it is providing a flow of convectively heated air. The discharged energy is in the form of hot air, hot fluids in general, steam, heated $CO_2$. heated supercritical $CO_2$, and/or electrical power generation, and can be supplied to various applications, including industrial uses. The disclosed implementations include efficiently constructed, long-service-life thermal energy storage systems having materials, fabrication, physical shape, and other properties that mitigate damage and deterioration from repeated temperature cycling.

Optionally, heating of the elements of the storage unit may be optimized, so as to store a maximum amount of heat during the charging cycle. Alternatively, heating of elements may be optimized to maximize heating element life, by means including minimizing time at particular heater temperatures, and/or by adjusting peak charging rates and/or peak heating element temperatures. Still other alternatives may balance these competing interests. Specific operations to achieve these optimizations are discussed further below.

Example implementations employ efficient yet economical insulation. Specifically, a dynamic insulation design may be used either by itself or in combination with static primary thermal insulation. The disclosed dynamic insulation techniques provide a controlled flow of air inside the system to restrict dissipation of thermal energy to the outside environment, which results in higher energy storage efficiency.

System Overview as Disclosed in U.S. Pat. No. 11,603,776

Figure 1:
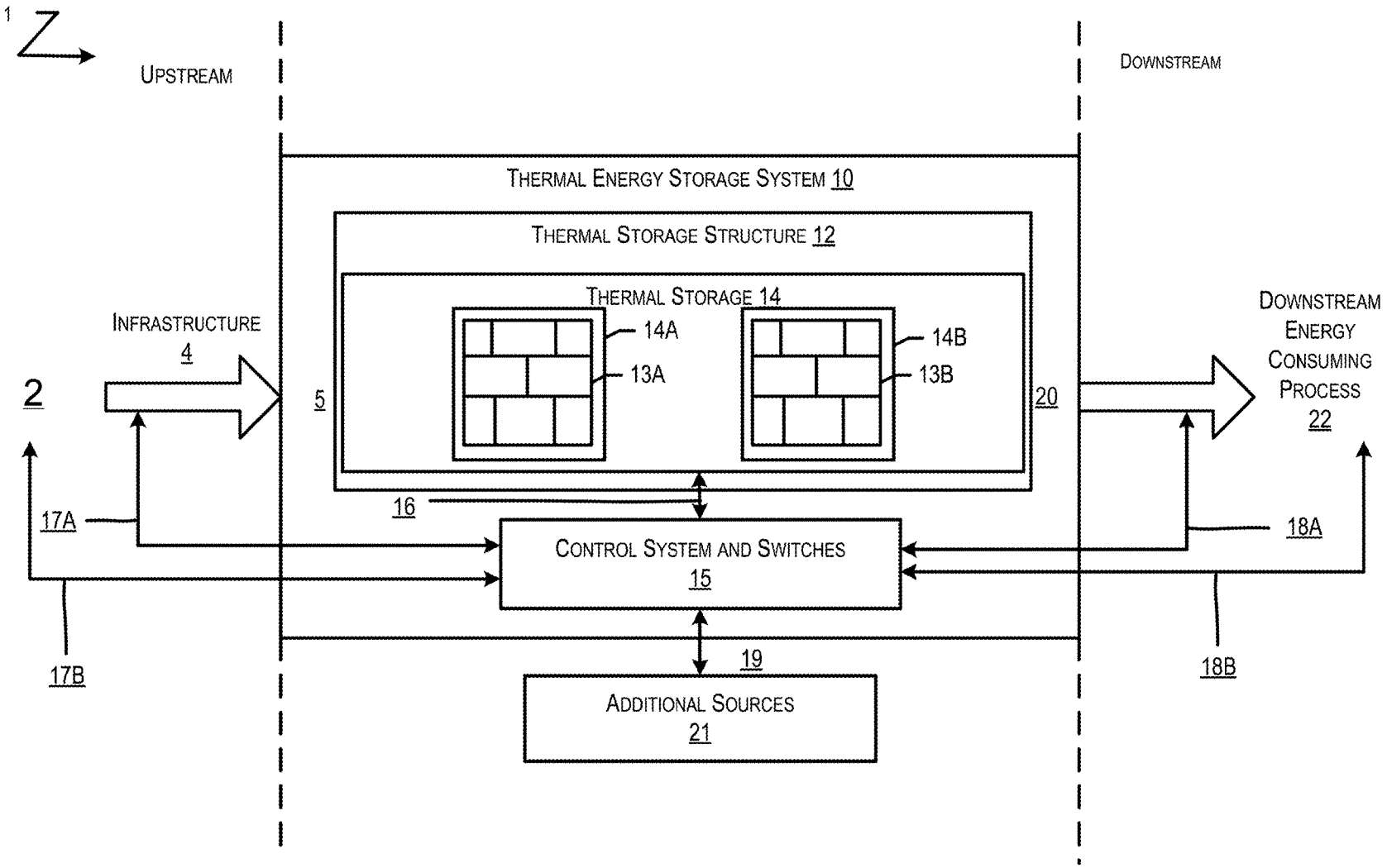
FIGS. 1 to 6 appear in U.S. Pat. No. 11,702,963.

FIG. 1 is a block diagram of a system 1 that includes a thermal energy storage system 10, according to one implementation. In the implementation shown, thermal energy storage system 10 is coupled between an input energy source 2 and a downstream energy-consuming process 22. For case of reference, components on the input and output sides of system 1 may be described as being "upstream" and "downstream" relative to system 10.

In the depicted implementation, thermal energy storage system 10 is coupled to input energy source 2, which may include one or more sources of electrical energy. Source 2 may be renewable, such as photovoltaic (PV) cell or solar, wind, geothermal, etc. Source 2 may also be another source, such as nuclear, natural gas, coal, biomass, or other. Source 2 may also include a combination of renewable and other sources. In this implementation, source 2 is provided to thermal energy storage system 10 via infrastructure 4, which may include one or more electrical conductors, commutation equipment, etc. In some implementations, infrastructure 4 may include circuitry configured to transport electricity over long distances; alternatively, in implementations in which input energy source 2 is located in the immediate vicinity of thermal energy storage system 10, infrastructure 4 may be greatly simplified. Ultimately, infrastructure 4 delivers energy to input 5 of thermal energy storage system 10 in the form of electricity.

The electrical energy delivered by infrastructure 4 is input to thermal storage structure 12 within system 10 through switchgear, protective apparatus and active switches controlled by control system 15. Thermal storage structure 12 includes thermal storage 14, which in turn includes one more assemblages (e.g., 14A, 14B) of solid storage media (e.g., 13A, 13B) configured to store thermal energy. These assemblages are variously referred to throughout this disclosure as "stacks," "arrays," and the like. These terms are intended to be generic and not connote any particular orientation in space, etc. In general, an array can include any material that is suitable for storing thermal energy and can be oriented in any given orientation (e.g., vertically, horizontally, etc.). Likewise, the solid storage media within the assemblages may variously be referred to as thermal storage blocks, bricks, etc. In implementations with multiple arrays, the arrays may be thermally isolated from one another and are separately controllable, meaning that they are capable of being charged or discharged independently from one another. This arrangement provides maximum flexibility, permitting multiple arrays to be charged at the same time, multiple arrays to be charged at different times or at different rates, one array to be discharged while the other array remains charged, etc.

Thermal storage 14 is configured to receive electrical energy as an input. The received electrical energy may be provided to thermal storage 14 via resistive heating elements that are heated by electrical energy and emit heat, primarily as electromagnetic radiation in the infrared and visible spectrum. During a charging mode of thermal storage 14, the electrical energy is released as heat from the resistive heating elements, transferred principally by radiation emitted both by the heating elements and by hotter solid storage media, and absorbed and stored in solid media within storage 14. When an array within thermal storage 14 is in a discharging mode, the heat is discharged from thermal storage structure 12 as output 20. As will be described, output 20 may take various forms, including a fluid such as hot air. (References to the use of "air" and "gases" within the present disclosure may be understood to refer more generally to a "fluid.") The hot air may be provided directly to a downstream energy consuming process 22 (e.g., an industrial application), or it may be passed through a steam generator (not shown) to generate steam for process 22.

Additionally, thermal energy storage system 10 includes a control system 15. Control system 15, in various implementations, is configured to control thermal storage 14, including through setting operational parameters (e.g., discharge rate), controlling fluid flows, controlling the actuation of electromechanical or semiconductor electrical switching devices, etc. The interface 16 between control system 15 and thermal storage structure 12 (and, in particular thermal storage 14) is indicated in FIG. 1. Control system 15 may be implemented as a combination of hardware and software in various embodiments.

Control system 15 may also interface with various entities outside thermal energy storage system 10. For example, control system 15 may communicate with input energy source 2 via an input communication interface 17B. For example, interface 17B may allow control system 15 to receive information relating to energy generation conditions at input energy source 2. In the implementation in which input energy source 2 is a photovoltaic array, this information may include, for example, current weather conditions at the site of source 2, as well as other information available to any upstream control systems, sensors, etc. Interface 17B may also be used to send information to components or equipment associated with source 2.

Similarly, control system 15 may communicate with infrastructure 4 via an infrastructure communication interface 17A. In a manner similar to that explained above, interface 17A may be used to provide infrastructure information to control system 15, such as current or forecast VRE availability, grid demand, infrastructure conditions, maintenance, emergency information, etc. Conversely, communication interface 17A may also be used by control system 15 to send information to components or equipment within infrastructure 4. For example, the information may include control signals transmitted from the control system 15, that controls valves or other structures in the thermal storage structure 12 to move between an open position and a closed position, or to control electrical or electronic switches connected to heaters in the thermal storage 14. Control system 15 uses information from communication interface 17A in determining control actions, and control actions may adjust closing or firing of switches in a manner to optimize the use of currently available electric power and maintain the voltage and current flows within infrastructure 4 within chosen limits.

Control system 15 may also communicate downstream using interfaces 18A and/or 18B. Interface 18A may be used to communicate information to any output transmission structure (e.g., a steam transmission line), while interface 18B may be used to communicate with downstream process 22. For example, information provided over interfaces 18A and 18B may include temperature, industrial application demand, current or future expected conditions of the output or industrial applications, etc. Control system 15 may control the input, heat storage, and output of thermal storage structure based on a variety of information. As with interfaces 17A and 17B, communication over interfaces 18A and 18B may be bidirectional—for example, system 10 may indicate available capacity to downstream process 22. Still further, control system 15 may also communicate with any other relevant data sources (indicated by reference numeral 21 in FIG. 1) via additional communication interface 19. Additional data sources 21 are broadly intended to encompass any other data source not maintained by either the upstream or downstream sites. For example, sources 21 might include third-party forecast information, data stored in a cloud data system, etc.

Thermal energy storage system 10 is configured to efficiently store thermal energy generated from input energy source 2 and deliver output energy in various forms to a downstream process 22. In various implementations, input energy source 2 may be from renewable energy and downstream process 22 may be an industrial application that requires an input such as steam or hot air. Through various techniques, including arrays of thermal storage blocks that use radiant heat transfer to efficiently storage energy and a lead-lag discharge paradigm that leads to desirable thermal properties such as the reduction of temperature nonuniformities within thermal storage 14, system 10 may advantageously provide a continuous (or near-continuous) flow of output energy based on an intermittently available source. The use of such a system has the potential to reduce the reliance of industrial applications on fossil fuels.

Figure 2:
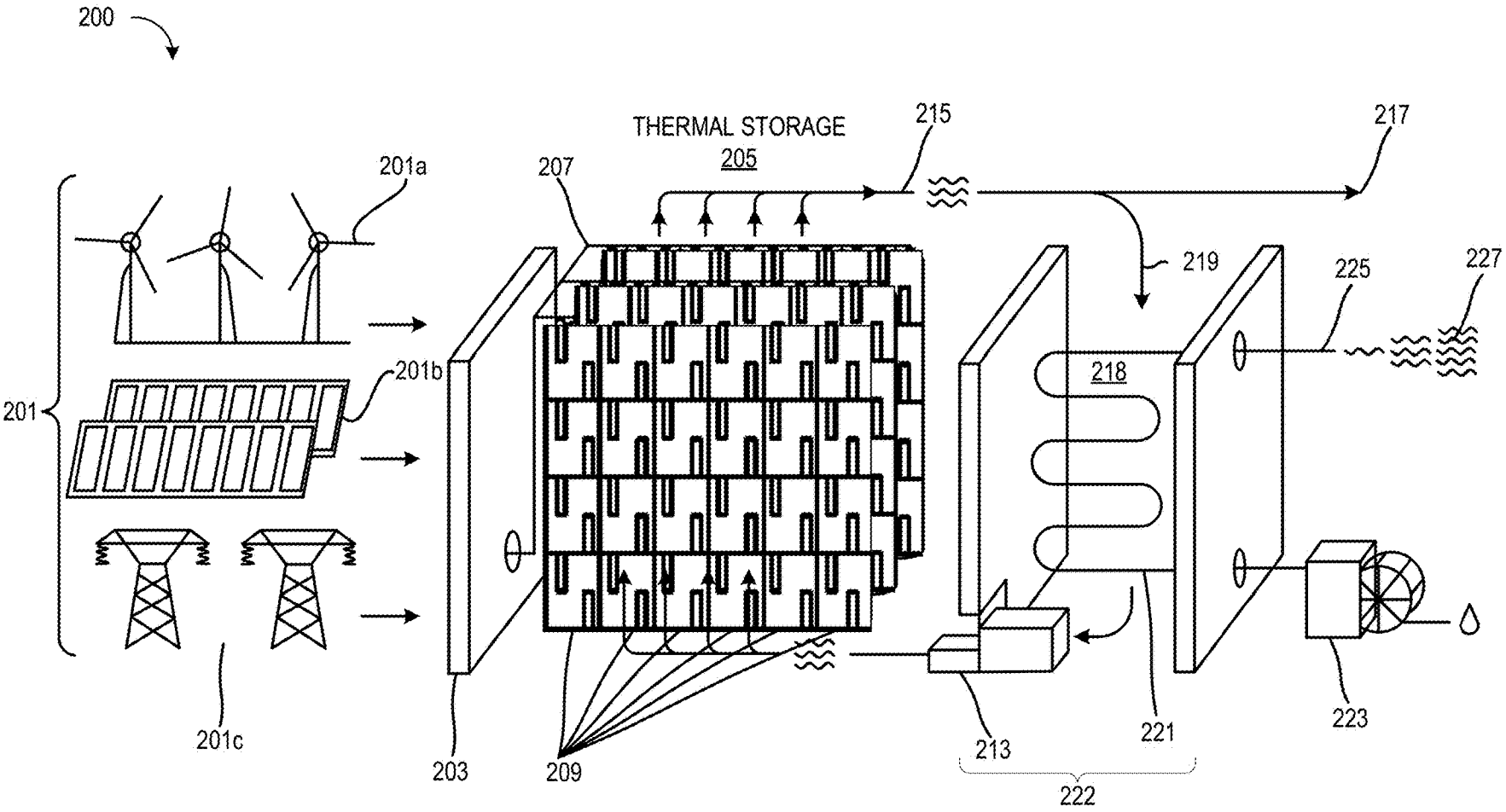

FIG. 2 provides a schematic view of one implementation of a system 200 for storing thermal energy, and further illustrates components and concepts just described with respect to FIG. 1. As shown, one or more energy sources 201 provide input electricity. For example, and as noted above, renewable sources such as wind energy from wind turbines 201*a*, solar energy from photovoltaic cells 201*b*, or other energy sources may provide electricity that is variable in availability or price because the conditions for generating the electricity are varied. For example, in the case of wind turbine 201*a*, the strength, duration and variance of the wind, as well as other weather conditions causes the amount of energy that is produced to vary over time (e.g., affects the rate of rotation of the rotor blades of the wind turbine). Similarly, the amount of energy generated by photovoltaic cells 201*b* also varies over time, depending on factors such as time of day, length of day due to the time of year, level of cloud cover due to weather conditions, temperature, other ambient conditions, etc. Further, the input electricity may be received from the existing power grid 201*c*, which may in turn vary based on factors such as pricing, customer demand, maintenance, and emergency requirements.

The electricity generated by source 201 is provided to the thermal storage structure within the thermal energy storage system. In FIG. 2, the passage of electricity into the thermal storage structure is represented by wall 203. The input electrical energy is converted to heat within thermal storage 205 via resistive heating elements 207 controlled by switches (not shown). Heating elements 207 provide heat to solid storage media 209. Thermal storage components (sometimes called "bricks") within thermal storage 205 are arranged to form embedded radiative chambers. FIG. 2 illustrates that multiple thermal storage arrays 209 may be present within system 200. These arrays may be thermally isolated from one another and may be separately controllable. FIG. 2 is merely intended to provide a conceptual representation of how thermal storage 205 might be implemented—one such implementation might, for example, include only two arrays, or might include six arrays, or ten arrays, or more.

In the depicted implementation, a blower 213 drives air or other fluid to thermal storage 205 such that the air is eventually received at a lower portion of each of the arrays 209. The air flows upward through the channels and chambers formed by bricks in each of the arrays 209, with flow controlled by louvers. By the release of heat energy from the resistive heating elements 207, heat is radiatively transferred to arrays 209 of bricks during a charging mode. Relatively hotter brick surfaces reradiate absorbed energy (which may be referred to as a radiative "echo") and participate in heating cooler surfaces. During a discharging mode, the heat stored in arrays 209 is output, as indicated at 215.

Once the heat has been output in the form of a fluid such as hot air, the fluid may be provided for one or more downstream applications. For example, hot air may be used directly in an industrial process that is configured to receive the hot air, as shown at 217. Further, hot air may be provided as a stream 219 to a heat exchanger 218 of a steam generator 222, and thereby heats a pressurized fluid such as air, water, $CO_2$ or other gas. In the example shown, as the hot air stream 219 passes over a line 221 that provides the water from the pump 223 as an input, the water is heated and steam is generated as an output 225, which may be provided to an industrial application as shown at 227.

Figure 3:
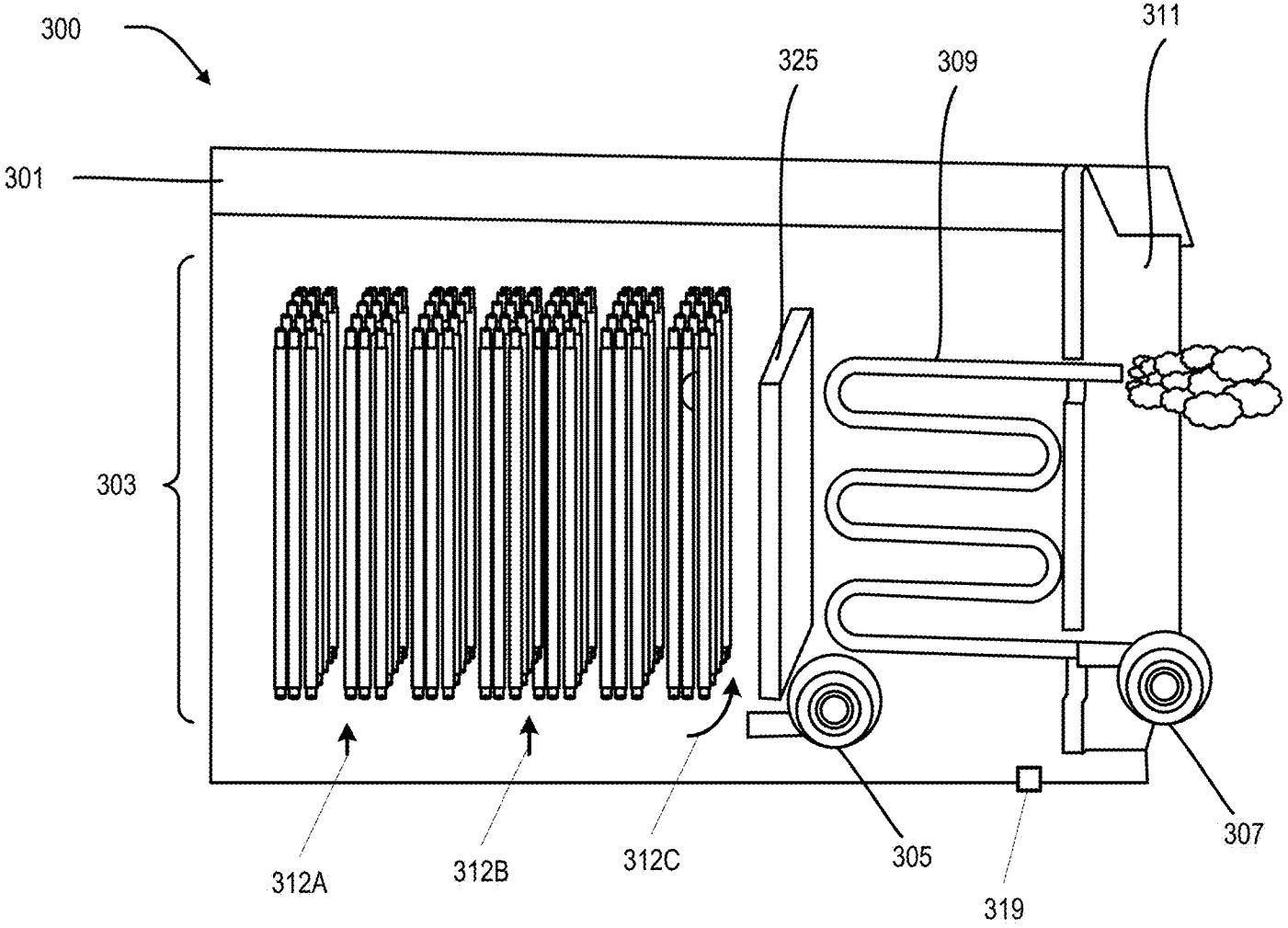

A thermal storage structure such as that depicted in FIGS. 1-2 may also include output equipment configured to produce steam for use in a downstream application. FIG. 3, for example, depicts a block diagram of an implementation of a thermal storage structure 300 that includes a storage-fired once-through steam generator (OTSG). An OTSG is a type of heat recovery stream generator (HRSG), which is a heat exchanger that accepts hot air from a storage unit, returns cooler air, and heats an external process fluid. The depicted OTSG is configured to use thermal energy stored in structure 300 to generate steam at output 311.

As has been described, thermal storage structure 300 includes outer structure 301 such walls, a roof, as well as thermal storage 303 in a first section of the structure. The OTSG is located in a second section of the structure, which is separated from the first section by thermal barrier 325. During a charging mode, thermal energy is stored in thermal storage 303. During a discharging mode, the thermal energy stored in thermal storage 303 receives a fluid flow (e.g., air) by way of a blower 305. These fluid flows may be generated from fluid entering structure 300 via an inlet valve 319 and include a first fluid flow 312A (which may be directed to a first stack within thermal storage 303) and a second fluid flow 312B (which may be directed to a second stack within thermal storage 303).

As the air or other fluid directed by blower 305 flows through the thermal storage 303 from the lower portion to the upper portion, it is heated and is eventually output at the upper portion of thermal storage 303. The heated air, which may be mixed at some times with a bypass fluid flow 312C that has not passed through thermal storage 302, is passed over a conduit 309 through which flows water, or another fluid pumped by the water pump 307. As the hot air heats up the water in the conduit, steam is generated at 311. The cooled air that has crossed the conduit (and transferred heat to the water flowing through it) is then fed back into the brick heat storage 303 by blower 305. As explained below, the control system can be configured to control attributes of the steam, including steam quality, or fraction of the steam in the vapor phase, and flow rate.

As shown in FIG. 3, an OTSG does not include a recirculating drum boiler. Properties of steam produced by an OTSG are generally more difficult to control than those of steam produced by a more traditional HRSG with a drum, or reservoir. The steam drum in such an HRSG acts as a phase separator for the steam being produced in one or more heated tubes recirculating the water; water collects at the bottom of the reservoir while the steam rises to the top. Saturated steam (having a steam quality of 100%) can be collected from the top of the drum and can be run through an additional heated tube structure to superheat it and further assure high steam quality. Drum-type HRSGs are widely used for power plants and other applications in which the water circulating through the steam generator is highly purified and stays clean in a closed system. For applications in which the water has significant mineral content, however, mineral deposits form in the drum and tubes and tend to clog the system, making a recirculating drum design infeasible.

For applications using water with a higher mineral content, an OTSG may be a better option. One such application is oil extraction, in which feed water for a steam generator may be reclaimed from a water/oil mixture produced by a well. Even after filtering and softening, such water may have condensed solid concentrations on the order of 10,000 ppm or higher. The lack of recirculation in an OTSG enables operation in a mode to reduce mineral deposit formation; however, an OTSG needs to be operated carefully in some implementations to avoid mineral deposits in the OTSG water conduit. For example, having some fraction of water droplets present in the steam as it travels through the OTSG conduit may be required to prevent mineral deposits by retaining the minerals in solution in the water droplets. This consideration suggests that the steam quality (vapor fraction) of steam within the conduit may be maintained below a specified level. On the other hand, a high steam quality at the output of the OTSG may be important for the process employing the steam. Therefore, it is advantageous for a steam generator powered by VRE through TES to maintain close tolerances on outlet steam quality. There is a sensitive interplay among variables such as input water temperature, input water flow rate and heat input, which may be managed to achieve a specified steam quality of output steam while avoiding damage to the OTSG.

Implementations of the thermal energy storage system disclosed herein provide a controlled and specified source of heat to an OTSG. The controlled temperature and flow rate available from the thermal energy storage system allows effective feed-forward and feedback control of the steam quality of the OTSG output. In one implementation, feed-forward control includes using a target steam delivery rate and steam quality value, along with measured water temperature at the input to the water conduit of the OTSG, to determine a heat delivery rate required by the thermal energy storage system for achieving the target values. In this implementation, the control system can provide a control signal to command the thermal storage structure to deliver the flowing gas across the OTSG at the determined rate. In one implementation, a thermal energy storage system integrated with an OTSG includes instrumentation for measurement of the input water temperature to the OTSG.

In one implementation, feedback control includes measuring a steam quality value for the steam produced at the outlet of the OTSG, and a controller using that value to adjust the operation of the system to return the steam quality to a desired value. Obtaining the outlet steam quality value may include separating the steam into its liquid and vapor phases and independently monitoring the heat of the phases to determine the vapor phase fraction. Alternatively, obtaining the outlet steam quality value may include measuring the pressure and velocity of the outlet steam flow and the pressure and velocity of the inlet water flow, and using the relationship between values to calculate an approximation of the steam quality. Based on the steam quality value, a flow rate of the outlet fluid delivered by the thermal storage to the OTSG may be adjusted to achieve or maintain the target steam quality. In one implementation, the flow rate of the outlet fluid is adjusted by providing a feedback signal to a controllable element of the thermal storage system. The controllable element may be an element used in moving fluid through the storage medium, such as a blower or other fluid moving device, a louver, or a valve.

The steam quality measurement of the outlet taken in real time may be used as feedback by the control system to determine the desired rate of heat delivery to the OTSG. To accomplish this, an implementation of a thermal energy storage system integrated with an OTSG may include instruments to measure inlet water velocity and outlet steam flow velocity, and, optionally, a separator along with instruments for providing separate measurements of the liquid and vapor heat values. In some implementations, the tubing in an OTSG is arranged such that the tubing closest to the water inlet is positioned in the lowest temperature portion of the airflow, and that the tubing closest to the steam exit is positioned in the highest temperature portion of the airflow. In some implementations of the present innovations, the OTSG may instead be configured such that the highest steam quality tubes (closest to the steam outlet) are positioned at some point midway through the tubing arrangement, so as to enable higher inlet fluid temperatures from the TSU to the OTSG while mitigating scale formation within the tubes and overheating of the tubes, while maintaining proper steam quality. The specified flow parameters of the heated fluid produced by thermal energy storage systems as disclosed herein may in some implementations allow precise modeling of heat transfer as a function of position along the conduit. Such modeling may allow specific design of conduit geometries to achieve a specified steam quality profile along the conduit.

Figure 4:
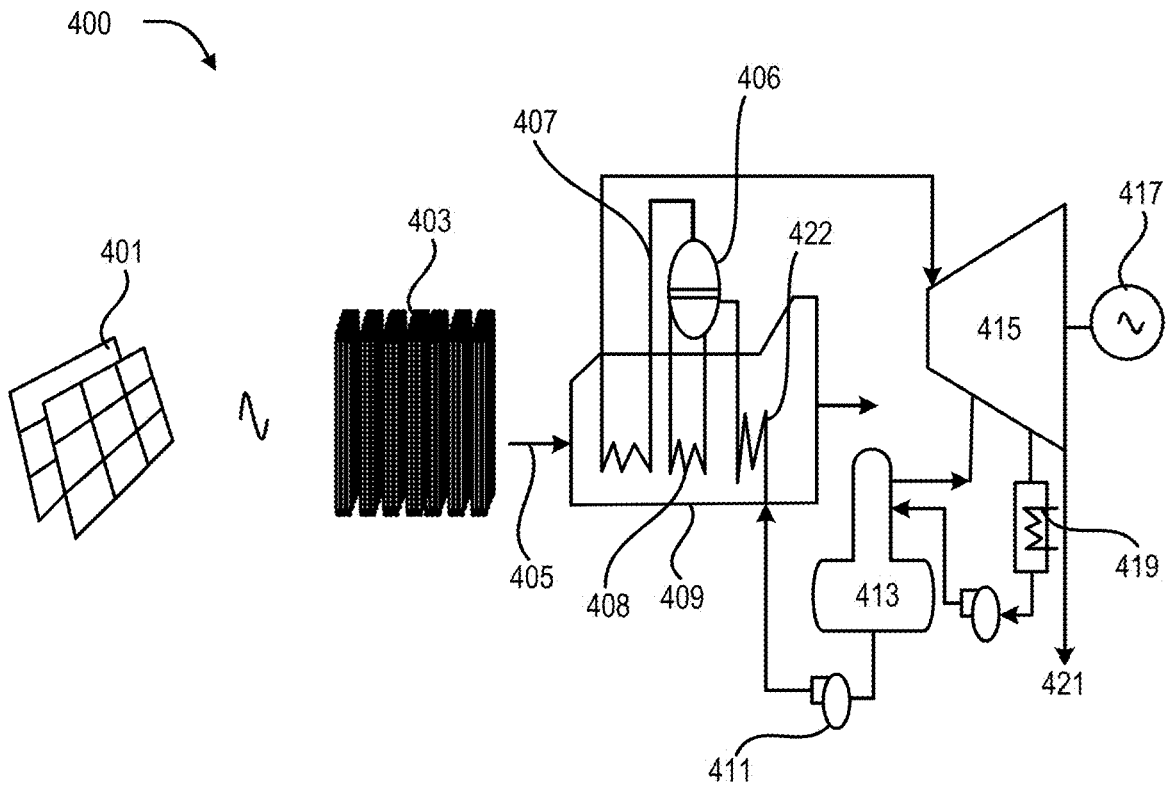

As shown in FIG. 4, the output of the thermal energy storage system may be used for an integrated cogeneration system 400. As previously explained, an energy source 401 provides electrical energy that is stored as heat in the heat storage 403 of the TSU. During discharge, the heated air is output at 405. As shown in FIG. 4, lines containing a fluid, in this case water, are pumped into a drum 406 of an HRSG 409 via a preheating section of tubing 422. In this implementation, HRSG 409 is a recirculating drum type steam generator, including a drum or boiler 406 and a recirculating evaporator section 408. The output steam passes through line 407 to a superheater coil, and is then provided to a turbine at 415, which generates electricity at 417. As an output, the remaining steam 421 may be expelled to be used as a heat source for a process or condensed at 419 and optionally passed through to a deaeration unit 413 and delivered to pump 411 in order to perform subsequent steam generation.

Certain industrial applications may be particularly well-suited for cogeneration. For example, some applications use higher temperature heat in a first system, such as to convert the heat to mechanical motion as in the case of a turbine, and lower-temperature heat discharged by the first system for a second purpose, in a cascading manner; or an inverse temperature cascade may be employed. One example involves a steam generator that makes high-pressure steam to drive a steam turbine that extracts energy from the steam, and low-pressure steam that is used in a process, such as an ethanol refinery, to drive distillation and electric power to run pumps. Still another example involves a thermal energy storage system in which hot gas is output to a turbine, and the heat of the turbine outlet gas is used to preheat inlet water to a boiler for processing heat in another steam generator (e.g., for use in an oilfield industrial application). In one application, cogeneration involves the use of hot gas at e.g., 840° C. to power or co-power hydrogen electrolysis, and the lower temperature output gas of the hydrogen electrolyzer, which may be at about 640° C., is delivered alone or in combination with higher-temperature heat from a TSU to a steam generator or a turbine for a second use. In another application, cogeneration involves the supply of heated gas at a first temperature e.g., 640° C. to enable the operation of a fuel cell, and the waste heat from the fuel cell which may be above 800° C. is delivered to a steam generator or a turbine for a second use, either alone or in combination with other heat supplied from a TSU.

A cogeneration system may include a heat exchange apparatus that receives the discharged output of the thermal storage unit and generates steam. Alternately, the system may heat another fluid such as supercritical carbon dioxide by circulating high-temperature air from the system through a series of pipes carrying a fluid, such as water or $CO_2$, (which transfers heat from the high-temperature air to the pipes and the fluid), and then recirculating the cooled air back as an input to the thermal storage structure. This heat exchange apparatus is an HRSG, and in one implementation is integrated into a section of the housing that is separated from the thermal storage.

The HRSG may be physically contained within the thermal storage structure or may be packaged in a separate structure with ducts conveying air to and from the HRSG. The HRSG can include a conduit at least partially disposed within the second section of the housing. In one implementation, the conduit can be made of thermally conductive material and be arranged so that fluid flows in a "once-through" configuration in a sequence of tubes, entering as lower-temperature fluid and exiting as higher temperature, possibly partially evaporated, two-phase flow. As noted above, once-through flow is beneficial, for example, in processing feedwater with substantial dissolved mineral contaminants to prevent accumulation and precipitation within the conduits.

Figure 6:
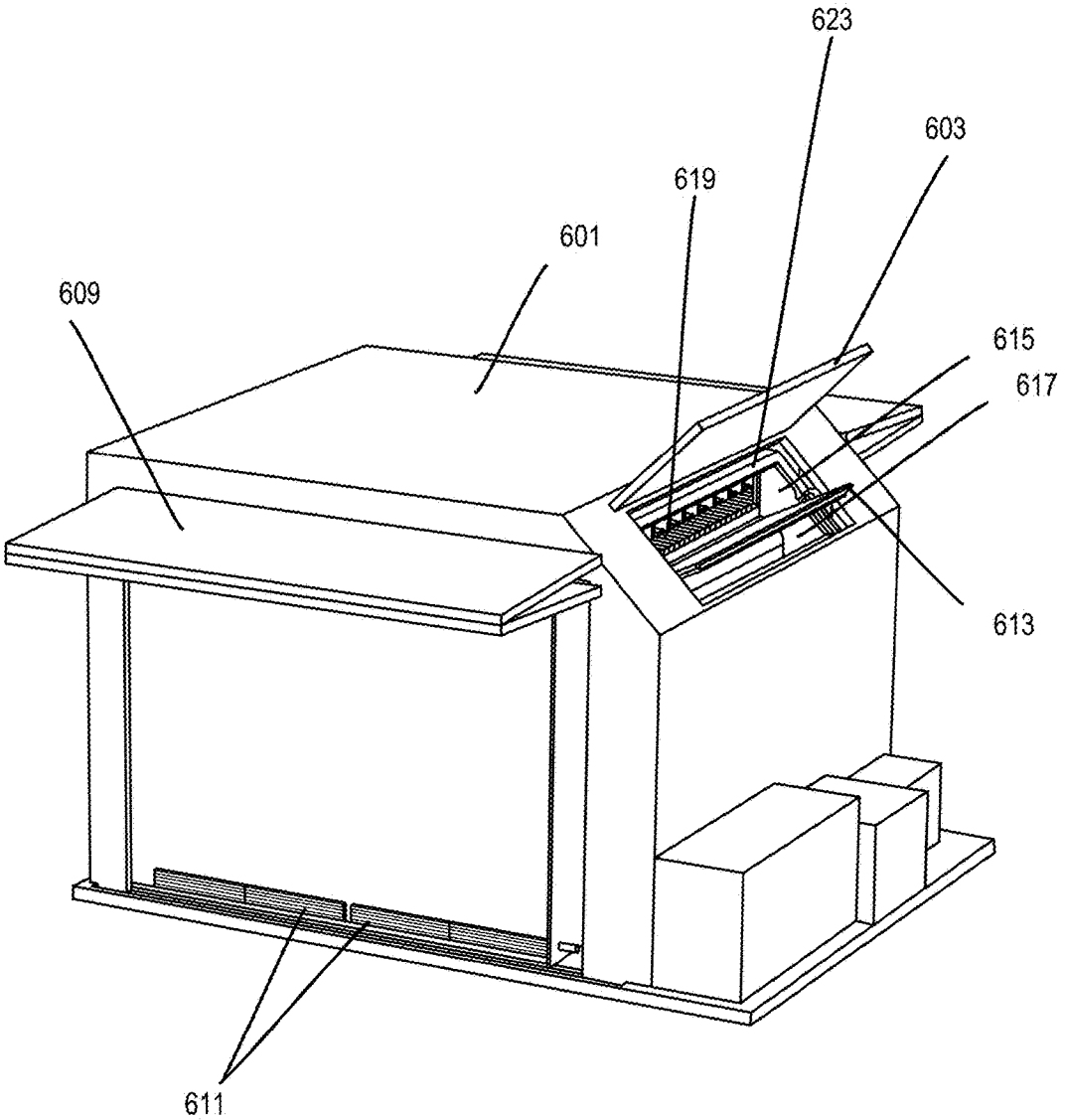

In an OTSG implementation, a first end of the conduit can be fluidically coupled to a water source. The system may provide for inflow of the fluids from the water source into a first end of the conduit and enable outflow of the received fluid or steam from a second end of the conduit. The system can include one or more pumps configured to facilitate inflow and outflow of the fluid through the conduit. The system can include a set of valves configured to facilitate controlled outflow of steam from the second end of the conduit to a second location for one or more industrial applications or electrical power generation. As shown in FIG. 6, an HRSG may also be organized as a recirculating drum-type boiler with an economizer and optional superheater, for the delivery of saturated or superheated steam.

The output of the steam generator may be provided for one or more industrial uses. For example, steam may be provided to a turbine generator that outputs electricity for use as retail local power. The control system may receive information associated with local power demands, and determine the amount of steam to provide to the turbine, so that local power demands can be met.

In addition to the generation of electricity, the output of the thermal storage structure may be used for industrial applications as explained below. Some of these applications may include, but are not limited to, electrolyzers, fuel cells, gas generation units such as hydrogen, carbon capture, manufacture of materials such as cement, calcining applications, as well as others. More details of these industrial applications are provided below.

Dynamic Insulation

It is generally beneficial for a thermal storage structure to minimize its total energy losses via effective insulation, and to minimize its cost of insulation. Some insulation materials are tolerant of higher temperatures than others. Higher-temperature tolerant materials tend to be more costly.

Figure 5:
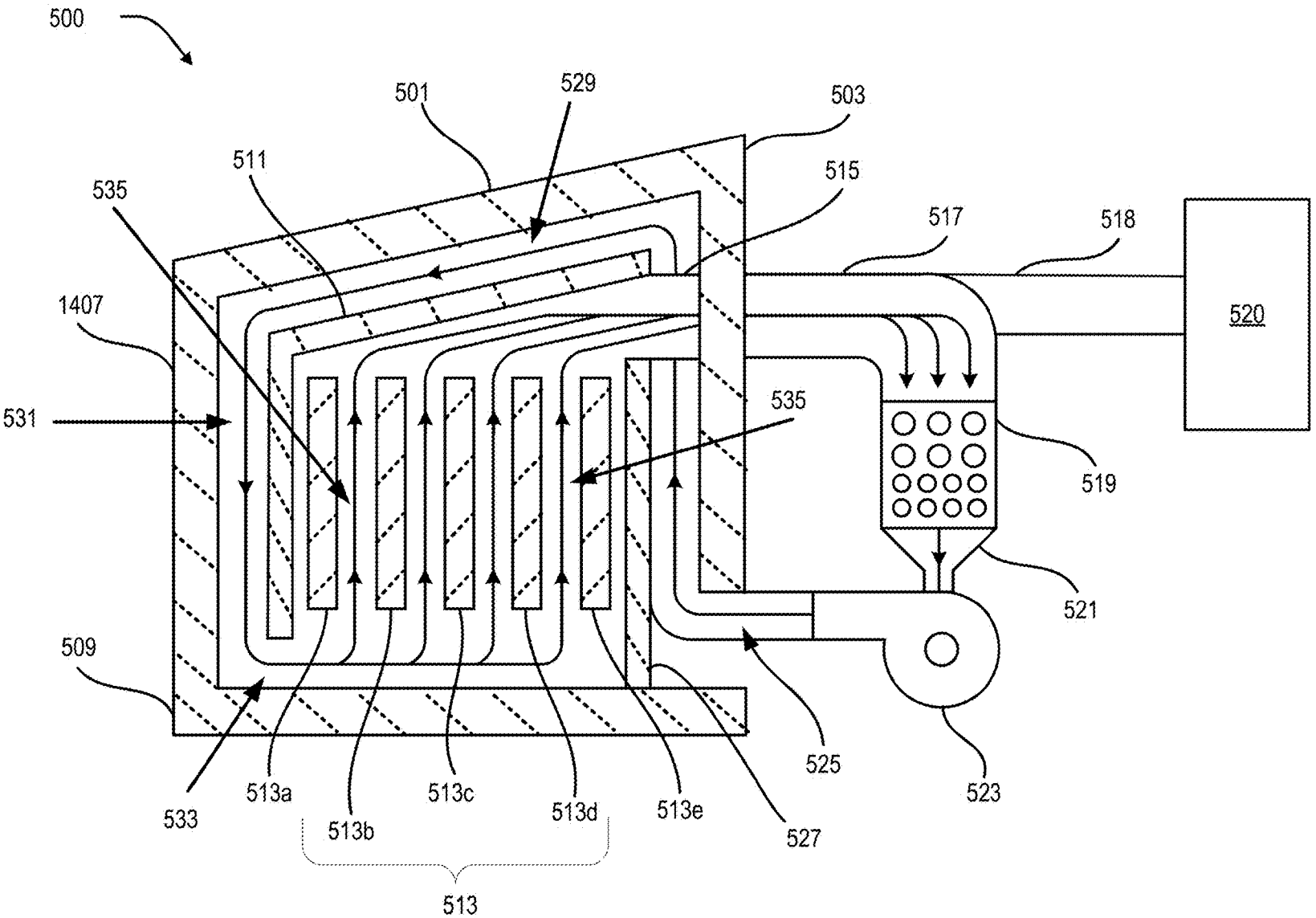

FIG. 5 provides a schematic section illustration 500 of an implementation of dynamic insulation. The outer container includes roof 501, walls 503, 507 and a foundation 509. Within the outer container, a layer of insulation 511 is provided between the outer container and columns of bricks in stack 513, the columns being represented as 513*a*, 513*b*, 513*c*, 513*d* and 513*e*. The heated fluid that is discharged from the upper portion of the columns of bricks 513*a*, 513*b*, 513*c*, 513*d* and 513*e* exits by way of an output 515, which is connected to a duct 517. Duct 517 provides the heated fluid as an input to a steam generator 519. Once the heated fluid has passed through steam generator 519, some of its heat is transferred to the water in the steam generator and the stream of fluid is cooler than when exiting the steam generator. Further, the heated fluid may be used directly in an industrial process 520 that is configured to receive the heated fluid, as shown at 518. Cooler recycled fluid exits a bottom portion 521 of the steam generator 519. An air blower 523 receives the cooler fluid, and provides the cooler fluid, via a passage 525 defined between the walls 503 and insulation 527 positioned adjacent the stack 513, through an upper air passage 529 defined between the insulation 511 and the roof 501, down through side passages 531 defined on one or more sides of the stack 513 and the insulation 511, and thence down to a passage 533 directly below the stack 513.

The air in passages 525, 529, 531 and 533 acts as an insulating layer between (a) the insulations 511 and 527 surrounding the stack 513, and (b) the roof 501, walls 503, 507 and foundation 509. Thus, heat from the stack 513 is prevented from overheating the roof 501, walls 503, 507 and foundation 509. At the same time, the air flowing through those passages 525, 529, 531 and 533 carries by convection heat that may penetrate the insulations 511 and/or 517 into air flow passages 535 of the stack 513, thus preheating the air, which is then heated by passage through the air flow passages 535.

The columns of bricks 513*a*, 513*b*, 513*c*, 513*d* and 513*e* and the air passages 535 are shown schematically in FIG. 5. The physical structure of the stacks and air flow passages therethrough in embodiments described herein is more complex, leading to advantages.

In some implementations, to reduce or minimize the total energy loss, the layer of insulation 511 is a high-temperature primary insulation that surrounds the columns 513*a*, 513*b*, 513*c*, 513*d* and 513*e* within the housing. Outer layers of lower-cost insulation may also be provided. The primary insulation may be made of thermally insulating materials selected from any combination of refractory bricks, alumina fiber, ceramic fiber, and fiberglass or any other material that might be apparent to a person of ordinary skill in the art. The amount of insulation required to achieve low losses may be large, given the high temperature differences between the storage media and the environment. To reduce energy losses and insulation costs, conduits are arranged to direct returning, cooler fluid from the HRSG along the outside of a primary insulation layer before it flows into the storage core for reheating.

The cooler plenum, including passages 525, 529, 531 and 533, is insulated from the outside environment, but total temperature differences between the cooler plenum and the outside environment are reduced, which in turn reduces thermal losses. This technique, known as "dynamic insulation," uses the cooler returning fluid, as described above, to recapture heat which passes through the primary insulation, preheating the cooler air before it flows into the stacks of the storage unit. This approach further serves to maintain design temperatures within the foundation and supports of the thermal storage structure. Requirements for foundation cooling in existing designs (e.g., for molten salt) involve expensive dedicated blowers and generators—requirements avoided by implementations according to the present teaching.

The materials of construction and the ground below the storage unit may not be able to tolerate high temperatures, and in the present system active cooling—aided by the unassisted flowing heat exchange fluid in the case of power failure—can maintain temperatures within design limits.

A portion of the fluid returning from the HRSG may be directed through conduits such as element 521 located within the supports and foundation elements, cooling them and delivering the captured heat back to the input of the storage unit stacks as preheated fluid. The dynamic insulation may be provided by arranging the bricks 513*a*, 513*b*, 513*c*, 513*d* and 513*e* within the housing so that the bricks 513*a*, 513*b*, 513*c*, 513*d* and 513*e* are not in contact with the outer surface 501, 503, 507 of the housing, and are thus thermally isolated from the housing by the primary insulation formed by the layer of cool fluid. The bricks 513*a*, 513*b*, 513*c*, 513*d* and 513*e* may be positioned at an elevated height from the bottom of the housing, using a platform made of thermally insulating material.

During unit operation, a controlled flow of relatively cool fluid is provided by the fluid blowing units 523, to a region (including passages 525, 529, 531 and 533) between the housing and the primary insulation (which may be located on an interior or exterior of an inner enclosure for one or more thermal storage assemblages), to create the dynamic thermal insulation between the housing and the bricks, which restricts the dissipation of thermal energy being generated by the heating elements and/or stored by the bricks into the outside environment or the housing, and preheats the fluid. As a result, the controlled flow of cold fluid by the fluid blowing units of the system may facilitate controlled transfer of thermal energy from the bricks to the conduit, and also facilitates dynamic thermal insulation, thereby making the system efficient and economical.

In another example implementation, the buoyancy of fluid can enable an unassisted flow of the cold fluid around the bricks between the housing and the primary insulator 511 such that the cold fluid may provide dynamic insulation passively, even when the fluid blowing units 523 fail to operate in case of power or mechanical failure, thereby maintaining the temperature of the system within predefined safety limits, to achieve intrinsic safety. The opening of vents, ports, or louvres (not shown) may establish passive buoyancy-driven flow to maintain such flow, including cooling for supports and foundation cooling, during such power outages or unit failures, without the need for active equipment.

In the above-described fluid flow, the fluid flows to an upper portion of the unit, down the walls and into the inlet of the stacking, depending on the overall surface area to volume ratio, which is in turn dependent on the overall unit size, the flow path of the dynamic insulation may be changed. For example, in the case of smaller units that have greater surface area as compared with the volume, the amount of fluid flowing through the stack relative to the area may utilize a flow pattern that includes a series of serpentine channels, such that the fluid flows on the outside, moves down the wall, up the wall, and down the wall again before flowing into the inlet. Other channelization patterns may also be used.

Additionally, the pressure difference between the return fluid in the insulation layer and the fluid in the stacks may be maintained such that the dynamic insulation layer has a substantially higher pressure than the pressure in the stacks themselves. Thus, if there is a leak between the stacks and the insulation, the return fluid at the higher pressure may be forced into the leak or the cracks, rather than the fluid within the stacks leaking out into the dynamic insulation layer. Accordingly, in the event of a leak in the stacks, the very hot fluid of the stacks may not escape outside of the unit, but instead the return fluid may push into the stacks, until the pressure between the dynamic insulation layer in the stacks equalizes. Pressure sensors may be located on either side of the blower that provide relative and absolute pressure information. With such a configuration, a pressure drop within the system may be detected, which can be used to locate the leak.

Earlier systems that store high temperature sensible heat in rocks and molten salts have required continuous active means of cooling foundations, and in some implementations continuous active means of heating system elements to prevent damage to the storage system; thus, continuous active power and backup power supply systems are required. A system as described herein does not require an external energy supply to maintain the safety of the unit. Instead, as described below, the present disclosure provides a thermal storage structure that provides for thermally induced flows that passively cools key elements when equipment, power, or water fails. This also reduces the need for fans or other cooling elements inside the thermal storage structure.

Forecast-Based System Control

As noted above, forecast information such as weather predictions may be used by a control system to reduce wear and degradation of system components. Another goal of forecast-based control is to ensure adequate thermal energy production from the thermal energy storage system to the load or application system. Actions that may be taken in view of forecast information include, for example, adjustments to operating parameters of the thermal energy storage system itself, adjustments to an amount of input energy coming into the thermal energy storage system, and actions or adjustments associated with a load system receiving an output of the thermal energy storage system.

Weather forecasting information can come from one or more of multiple sources. One source is a weather station at a site located with the generation of electrical energy, such as a solar array or photovoltaic array, or wind turbines. The weather station may be integrated with a power generation facility, and may be operationally used for control decisions of that facility, such as for detection of icing on wind turbines. Another source is weather information from sources covering a wider area, such as radar or other weather stations, which may be fed into databases accessible by the control system of the thermal energy storage system. Weather information covering a broader geography may be advantageous in providing more advanced notice of changes in condition, as compared to the point source information from a weather station located at the power source. Still another possible source of weather information is virtual or simulated weather forecast information. In general, machine learning methods can be used to train the system, taking into account such data and modifying behavior of the system.

As an example, historical information associated with a power curve of an energy source may be used as a predictive tool, taking into account actual conditions, to provide forecasting of power availability and adjust control of the thermal energy storage system, both as to the amount of energy available to charge the units and the amount of discharge heat output available. For example, the power curve information may be matched with actual data to show that when the power output of a photovoltaic array is decreasing, it may be indicative of a cloud passing over one or more parts of the array, or cloudy weather generally over the region associated with the array.

Forecast-related information is used to improve the storage and generation of heat at the thermal energy storage system in view of changing conditions. For example, a forecast may assist in determining the amount of heat that may be stored and the rate at which heat may be discharged in order to provide a desired output to an industrial application—for instance, in the case of providing heat to a steam generator, to ensure a consistent quality and amount of steam, and to ensure that the steam generator does not have to shut down. The controller may adjust the current and future output of heat in response to current or forecast reductions in the availability of charging electricity, so as to ensure across a period of future time that the state of charge of the storage unit does not reduce so that heat output may be stopped. By adjusting the continuous operation of a steam generator to a lower rate in response to a forecasted reduction of available input energy, the unit may operate continuously. The avoidance of shutdowns and later restarts is an advantageous feature: shutting down and restarting a steam generator is a time-consuming process that is costly and wasteful of energy, and potentially exposes personnel and industrial facilities to safety risks.

The forecast, in some cases, may be indicative of an expected lower electricity input or some other change in electricity input pattern to the thermal energy storage system. Accordingly, the control system may determine, based on the input forecast information, that the amount of energy that would be required by the thermal energy storage system to generate the heat necessary to meet the demands of the steam generator or other industrial application is lower than the amount of energy expected to be available. In one implementation, making this determination involves considering any adjustments to operation of the thermal energy storage system that may increase the amount of heat it can produce. For example, one adjustment that may increase an amount of heat produced by the system is to run the heating elements in a thermal storage assemblage at a higher power than usual during periods of input supply availability, in order to obtain a higher temperature of the assemblage and greater amount of thermal energy stored. Such "overcharging" or "supercharging" of an assemblage, as discussed further below, may in some implementations allow sufficient output heat to be produced through a period of lowered input energy supply. Overcharging may increase stresses on the thermal storage medium and heater elements of the system, thus increasing the need for maintenance and the risk of equipment failure.

As an alternative to operational adjustments for the thermal energy storage system, or in embodiments for which such adjustments are not expected to make up for a forecasted shortfall of input energy, action on either the source side or the load side of the thermal energy storage system may be initiated by the control system. On the input side, for example, the forecast difference between predicted and needed input power may be used to provide a determination, or decision-support, with respect to sourcing input electrical energy from other sources during an upcoming time period, to provide the forecasted difference. For example, if the forecasting system determines that the amount of electrical energy to be provided from a photovoltaic array will be 70% of the expected amount needed over a given period of time, e.g., due to a forecast of cloudy weather, the control system may effectuate connection to an alternative input source of electrical energy, such as wind turbine, natural gas or other source, such that the thermal energy storage system receives 100% of the expected amount of energy. In an implementation of a thermal energy storage system having an electrical grid connection available as an alternate input power source, the control system may effectuate connection to the grid in response to a forecast of an input power shortfall.

In a particular implementation, forecast data may be used to determine desired output rates for a certain number of hours or days ahead, presenting to an operator signals and information relating to expected operational adjustments to achieve those output rates, and providing the operator with a mechanism to implement the output rates as determined by the system, or alternatively to modify or override those output rates. This may be as simple as a "click to accept" feedback option provided to the operator, a dead-man's switch that automatically implements the determined output rates unless overridden, and/or more detailed options of control parameters for the system.

II. Heat Transport in TSU: Bricks and Heating Elements

A. Problems Solved by One or More Disclosed Embodiments

Traditional approaches to the formation of energy storage cells may have various problems and disadvantages. For example, traditional approaches may not provide for uniform heating of the thermal energy storage cells. Instead, they may use structures that create uneven heating, such as hot spots and cold spots. Non-uniform heating may reduce the efficiency of an energy storage system, lead to earlier equipment failure, cause safety problems, etc. Further, traditional approaches may suffer from wear and tear on thermal energy storage cells. For example, stresses such as mechanical and thermal stress may cause deterioration of performance, as well as destabilization of the material, such as cracking of the bricks.

B. Example Solutions Disclosed Herein

In some implementations, thermal storage blocks (e.g., bricks) have various features that facilitate more even distribution. As one example, blocks may be formed and positioned to define fluid flow pathways with chambers that are open to heating elements to receive radiative energy. Therefore, a given fluid flow pathway (e.g., oriented vertically from the top to bottom of a stack) may include two types of openings: radiation chambers that are open to a channel for a heating element and fluid flow openings (e.g., fluid flow slots) that are not open to the channel. The radiation chambers may receive infrared radiation from heater elements, which, in conjunction with conductive heating by the heater elements may provide more uniform heating of an assemblage of thermal storage blocks, relative to traditional implementations. The fluid flow openings may receive a small amount of radiative energy indirectly via the chambers, but are not directly open to the heating element. The stack of bricks may be used alone or in combination with other stacks of bricks to form the thermal storage unit, and one or more thermal storage units may be used together in the thermal energy storage system. As the fluid blower circulates the fluid through the structure during charge and discharge as explained above, a thermocline may be formed in a substantially vertical direction. Further, the fluid movement system may direct relatively cooler fluid for insulative purposes, e.g., along the insulated walls and roof of the structure. Finally, a venting system may allow for controlled cooling for maintenance or in the event of power loss, water loss, blower failure, etc., which may advantageously improve safety relative to traditional techniques.

Designs according to the present disclosure combine several key innovations, which together address these challenges and enable a cost-effective, safe, reliable high-temperature thermal energy storage system to be built and operated. A carefully structured solid media system according to the present teaching incorporates structured airflow passages which accomplish effective thermocline discharge; repeated mixing chambers along the direction of air flow which mitigate the thermal effects of any localized air channel blockages or nonuniformities; effective shielding of thermal radiation from propagating in the vertical direction; and a radiation chamber structure which uniformly and rapidly heats brick material with high heater power loading, low and uniform exposed surface temperature, and long-distance heat transfer within the storage media array via multi-step thermal radiation.

Innovative structures according to the present disclosure may comprise an array of bricks that form chambers. The bricks have structured air passages, such that in the vertical direction air flows upwards in a succession of open chambers and small air passages. In some embodiments, the array of bricks with internal air passages is organized in a structure such that the outer surface of each brick within the TSU core forms a wall of a chamber in which it is exposed to radiation from other brick surfaces, as well as radiation originating from an electrical heater.

The chamber structure is created by alternating brick materials into a checkerboard-type pattern, in which each brick is surrounded on all sides by open chambers, and each open chamber has adjacent bricks as its walls. In addition, horizontal parallel passages are provided that pass through multiple chambers. Electrical heating elements that extend horizontally through the array are installed in these passages. An individual heating element it may be exposed along its length to the interior spaces of multiple chambers. Each brick within such a checkerboard structure is exposed to open chambers on all sides. Accordingly, during charging, radiant energy from multiple heating elements heats all outer surfaces of each brick, contributing to the rapid and even heating of the brick, and reducing reliance on conductive heat transfer within the brick by limiting the internal dimensions of the brick.

The radiation chamber structure provides a key advance in the design and production of effective thermal energy storage systems that are charged by electrical energy. The large surface area, which is radiatively exposed to heaters, causes the average temperature of the large surface to determine the radiation balance and thus the surface temperature of the heater. This intrinsic uniformity enables a high wattage per unit area of heater without the potential of localized overheating. And exposed brick surfaces are larger per unit of mass than in prior systems, meaning that incoming wattage per unit area is correspondingly smaller, and consequently thermal stresses due to brick internal temperature differences are lower. And critically, re-radiation of energy—radiation by hotter brick surfaces that is absorbed by cooler brick surfaces—reduces by orders of magnitude the variations in surface temperature, and consequently reduces thermal stresses in brick materials exposed to radiant heat. Thus, the radiation chamber design effectively enables heat to be delivered relatively uniformly to a large horizontally oriented surface area and enables high wattage per unit area of heater with relatively low wattage per unit area of brick.

Note that while this configuration is described in terms of "horizontal" and "vertical", these are not absolute degree or angle restrictions. Advantageous factors include maintaining a thermocline and providing for fluid flow through the stack in a direction that results in convective heat transfer, exiting the stack at a relatively hotter portion of the thermocline. An additional advantageous factor that may be incorporated is to position the stack in a manner that encourages buoyant, hot air to rise through the stack and exit at the hot end of the thermocline; in this case, a stack in which the hot end of the thermocline is at a higher elevation than the cold end of the thermocline is effective, and a vertical thermocline maximizes that effectiveness.

An important advantage of this design is that uniformity of heating element temperature is strongly improved in designs according to the present disclosure. Any variations in brick heat conductivity, or any cracks forming in a brick that result in changed heat conductivity, are strongly mitigated by radiation heat transfer away from the location with reduced conductivity. That is, a region reaching a higher temperature than nearby regions due to reduced effectiveness of internal conduction will be out of radiation balance with nearby surfaces, and will as a result be rapidly cooled by radiation to a temperature relatively close to that of surrounding surfaces. As a result, both thermal stresses within solid media, and localized peak heater temperatures, are reduced by a large factor compared to previous teachings.

The system may include one or more air blowing units including any combination of fans and, blowers, and configured at predefined positions in the housing to facilitate the controlled flow of air between a combination of the first section, the second section, and the outside environment. The first section may be isolated from the second section by a thermal barrier. The air blowing units may facilitate the flow of air through at least one of the channels of the bricks from the bottom end of the cells to the upper end of the cells in the first section at the predefined flow rate, and then into the second section, such that the air passing through the bricks and/or heating elements of the cells at the predefined flow rate may be heated to a second predefined temperature, and may absorb and transfer the thermal energy emitted by the heating elements and/or stored by the bricks within the second section. The air may flow from the second section across a steam generator or other heat exchanger containing one or more conduits, which carry a fluid, and which, upon receiving the thermal energy from the air having the second predefined temperature, may heat the fluid flowing through the conduit to a higher temperature or may convert the fluid into steam. Further, the system may facilitate outflow of the generated steam from the second end of the conduit, to a predefined location for one or more industrial applications. The second predefined temperature of the air may be based on the material being used in conduit, and the required temperature and pressure of the steam. In another implementation, the air leaving the second section may be delivered externally to an industrial process.

Additionally, the example implementations described herein disclose a resistive heating element. The resistive heating element may include a resistive wire. The resistive wire may have a cross-section that is substantially round, elongated, flat, or otherwise shaped to admit as heat the energy received from the input of electrical energy.

Passive Cooling

FIG. 6 provides an isometric view of the thermal storage unit with multiple vent closures open, according to some implementations. Therefore, FIG. 6 may represent a maintenance or failsafe mode of operation. As shown, the thermal storage unit also includes an inner enclosure 623. The outer surface of inner enclosure 623 and the inner surface of the outer enclosure define a fluid passageway through which fluid may be conducted actively for dynamic cooling or passively for failsafe operation.

Inner enclosure 623 includes two vents 615 and 617 which include corresponding vent closures in some implementations (portions of vent door 613, in this example). In some implementations, vents 615 and 617 define respective passages between an interior of the inner enclosure 623 and an exterior of the inner enclosure. When the external vent closure 603 is open, these two vents are exposed to the exterior of the outer enclosure as well.

As shown, vent 615 may vent heated fluid from the thermal storage blocks conducted by duct 619. The vent 617 may allow entry of exterior fluid into the fluid passageway and eventually into the bottoms of the thermal storage block assemblies via louvers 611 (the vent closure 609 may remain closed in this situation). In some implementations, the buoyancy of fluid heated by the blocks causes it to exit vent 615 and a chimney effect pulls external fluid into the outer enclosure via vent 617. This external fluid may then be directed through louvers 611 due to the chimney effect and facilitate cooling of the unit. Speaking generally, a first vent closure may open to output heated fluid and a second vent closure may open to input external fluid for passive venting operation.

During passive cooling, the louvers 611 may also receive external fluid directly, e.g., when vent closure 609 is open. In this situation, both vents 615 and 617 may output fluid from the inner and outer enclosures.

Vent door 613 in the illustrated implementation, also closes an input to the steam generator when the vents 615 and 617 are open. This may prevent damage to steam generator components (such as water tubes) when water is cut off, the blower is not operating, or other failure conditions. The vent 617 may communicate with one or more blowers which may allow fluid to passively move through the blowers even when they are not operating. Speaking generally, one or more failsafe vent closure may close one or more passageways to cut off fluid heated by the thermal storage blocks and reduce or avoid equipment damage.

When the vent door 613 is closed, it may define part of the fluid passageway used for dynamic insulation. For example, the fluid movement system may move fluid up along one wall of the inner enclosure, across an outer surface of the vent door 613, across a roof of the inner enclosure, down one or more other sides of the inner enclosure, and into the thermal storage blocks (e.g., via louvers 611). Louvers 611 may allow control of fluid flow into assemblages of thermal storage blocks, including independent control of separately insulated assemblages in some implementations.

In the closed position, vent door 613 may also define an input pathway for heated fluid to pass from the thermal storage blocks to duct 619 and beneath the vent door 613 into the steam generator to generate steam.

In some implementations, one or more of vent door 613, vent closure 603, and vent closure 609 are configured to open in response to a nonoperating condition of one or more system elements (e.g., nonoperation of the fluid movement system, power failure, water failure, etc.). In some implementations, one or more vent closures or doors are held in a closed position using electric power during normal operation and open automatically when electric power is lost or in response to a signal indicating to open.

In some implementations, one or more vent closures are opened while a fluid blower is operating, e.g., to rapidly cool the unit for maintenance.

Thermoelectric Power Generation

1. Problems to be Solved

Gasification is the thermal conversion of organic matter by partial oxidation into gaseous product, consisting primarily of $H_2$, carbon monoxide (CO), and may also include methane, water, $CO_2$ and other products. Biomass (e.g., wood pellets), carbon rich waste (e.g. paper, cardboard) and even plastic waste can be gasified to produce hydrogen rich syngas at high yields with high temperature steam, with optimum yields attained at >1000° C. The rate of formation of combustible gases are increased by increasing the temperature of the reaction, leading to a more complete conversion of the fuel. The yield of hydrogen, for example, increases with the rise of reaction temperature.

Turning waste carbon sources into a usable alternative energy or feedstock stream to fossil fuels is a potentially highly impactful method for reducing carbon emissions and valorizing otherwise unused carbon sources.

2. Thermoelectric Power Generation

Indirect gasification uses a Dual Fluidized Bed (DFB) system consisting of two intercoupled fluidized bed reactors—one combustor and one gasifier—between which a considerable amount of bed material is circulated. This circulating bed material acts as a heat carrier from the combustor to the gasifier, thus satisfying the net energy demand in the gasifier originated by the fact that it is fluidized solely with steam, i.e., with no air/oxygen present, in contrast to the classical approach in gasification technology also called direct gasification. The absence of nitrogen and combustion in the gasifying chamber implies the generation of a raw gas with much higher heating value than that in direct gasification. The char which is not converted in the gasifying chamber follows the circulating bed material into the combustor, which is fluidized with air, where it is combusted and releases heat which is captured by the circulating bed material and thereby transported into the gasifier in order to close the heat balance of the system.

Referring to FIG. 4, in some example implementations, the thermal energy storage structure 403 can be integrated directly with a steam power plant to provide an integrated cogeneration system 400 for a continuous supply of hot air, steam and/or electrical power for various industrial applications. Thermal storage structure 403 may be operatively coupled to electrical energy sources 401 to receive electrical energy and convert and store the electrical energy in the form of thermal energy. In some implementations, at least one of the electrical energy sources 401 may comprise an input energy source having intermittent availability. However, electrical energy sources 401 may also include input energy sources having on-demand availability, and combinations of intermittent and on-demand sources are also possible and contemplated. The system 403 can be operatively coupled to a heat recovery steam generator (HRSG) 409 which is configured to receive heated air from the system 403 for converting the water flowing through conduits 407 of the HRSG 409 into steam for the steam turbine 415. In an alternative implementation, HRSG 409 is a once-through steam generator in which the water used to generate steam is not recirculated. However, implementations in which the water used to generate steam is partially or fully circulated as shown in FIG. 4 are also possible and contemplated.

A control unit can control the flow of the heated air (and more generally, a fluid) into the HRSG 409, based on load demand, cost per KWH of available energy source, and thermal energy stored in the system. The steam turbine 415 can be operatively coupled to a steam generator 409, which can be configured to generate a continuous supply of electrical energy. Further, the steam turbine 415 can also release a continuous flow of relatively lower-pressure 421 steam as output to supply an industrial process. Accordingly, implementations are possible and contemplated in which steam is received by the turbine at a first pressure and is output therefrom at a second, lower pressure, with lower pressure steam being provided to the industrial process. Examples of such industrial process that may utilize the lower pressure output steam include (but are not limited to) production of liquid transportation fuels, including petroleum fuels, biofuel production, production of diesel fuels, production of ethanol, grain drying, and so on.

The production of ethanol as a fuel from starch and cellulose involves aqueous processes including hydrolysis, fermentation and distillation. Ethanol plants have substantial electrical energy demand for process pumps and other equipment, and significant demands for heat to drive hydrolysis, cooking, distillation, dehydrating, and drying the biomass and alcohol streams. It is well known to use conventional electric power and fuel-fired boilers, or fuel-fired cogeneration of steam and power, to operate the fuel production process. Such energy inputs are a significant source of $CO_2$ emissions, in some cases 25% or more of total $CO_2$ associated with total agriculture, fuel production, and transportation of finished fuel. Accordingly, the use of renewable energy to drive such production processes is of value. Some ethanol plants are located in locations where excellent solar resources are available. Others are located in locations where excellent wind and solar resources are available.

The use of electrothermal energy storage may provide local benefits in such locations to grid operators, including switchable electricity loads to stabilize the grid; and intermittently available grid electricity (e.g., during low-price periods) may provide a low-cost continuous source of energy delivered from the electrothermal storage unit.

The use of renewable energy (wind or solar power) as the source of energy charging the electrothermal storage may deliver important reductions in the total. $CO_2$ emissions involved in producing the fuel, as up to 100% of the driving electricity and driving steam required for plant operations may come from cogeneration of heat and power by a steam turbine powered by steam generated by an electrothermal storage unit. Such emissions reductions are both valuable to the climate and commercially valuable under programs which create financial value for renewable and low-carbon fuels.

The electrothermal energy storage unit having air as a heat transfer fluid may provide other important benefits to an ethanol production facility, notably in the supply of heated dry air to process elements including spent grain drying. One useful combination of heated air output and steam output from a single unit is achieved by directing the outlet stream from the HRSG to the grain dryer. In this manner, a given amount of energy storage material (e.g., brick) may be cycled through a wider change in temperature, enabling the storage of extra energy in a given mass of storage material. There may be periods where the energy storage material temperature is below the temperature required for making steam, but the discharge of heated air for drying or other operations continues.

In some implementations thermal storage structure 403 may be directly integrated to industrial processing systems in order to directly deliver heat to a process without generation of steam or electricity. For example, thermal storage structure 403 may be integrated into industrial systems for manufacturing lime, concrete, petrochemical processing, or any other process that requires the delivery of high temperature air or heat to drive a chemical process. Through integration of thermal storage structure 403 charged by VRE, the fossil fuel requirements of such industrial process may be significantly reduced or possibly eliminated.

The control unit can determine how much steam is to flow through a condenser 419 versus steam output 421, varying both total electrical generation and steam production as needed. As a result, the integrated cogeneration system 400 can cogenerate steam and electrical power for one or more industrial applications.

If implemented with an OTSG as shown in FIG. 3 instead of the recirculating HRSG shown in FIG. 5, the overall integrated cogeneration system 400 can be used as thermal storage once-through steam generator (TSOTG) which can be used in oil fields and industries to deliver wet saturated steam or superheated dry steam at a specific flow rate and steam quality under automated control. High temperature delivered by the bricks and heating elements of the system 403 can power the integrated heat recovery steam generator (HRSG) 409. A closed air recirculation loop can minimize heat losses and maintain overall steam generation efficiency above 98%.

The HRSG 409 can include a positive displacement (PD) pump 411 under variable frequency drive (VFD) control to deliver water to the HRSG 409. Automatic control of steam flow rate and steam quality (including feed-forward and feed-back quality control) can be provided by the TSOTG 400. In an exemplary example implementation, a built-in Local Operator Interface (LOI) panel operatively coupled to system 400 and the control unit can provide unit supervision and control. Further, thermal storage structure 403 can be connected to a supervisory control and data acquisition system (SCADA)) associated with the steam power plant (or other load system). In one implementation, a second electrical power source is electrically connected to the steam generator pumps, blowers, instruments, and control unit.

In some implementations, system 400 may be designed to operate using feedwater with substantially dissolved solids; accordingly, a recirculating boiler configuration is impractical. Instead, a once-through steam generation process can be used to deliver wet steam without the buildup of mineral contaminants within the boiler. A serpentine arrangement of conduits 407 in an alternative once-through configuration of the HRSG 409 can be exposed to high-temperature air generated by the thermal storage structure 403, in which preheating and evaporation of the feedwater can take place consecutively. Water can be forced through the conduits of HRSG 409 by a boiler feedwater pump, entering the HRSG 409 at the "cold" end. The water can change phase along the circuit and may exit as wet steam at the "hot" end. In one implementation, steam quality is calculated based on the temperature of air provided by the thermal storage structure 403, and feedwater temperatures and flow rates, and is measured based on velocity acceleration at the HRSG outlet. Embodiments implementing a separator to separate steam from water vapor and determine the steam quality based on their relative proportions are also possible and contemplated.

In the case of an OTSG implementation, airflow (or other fluid flow) can be arranged such that the hottest air is nearest to the steam outlet at the second end of the conduit. An OTSG conduit can be mounted transversely to the airflow path and arranged in a sequence to provide highly efficient heat transfer and steam generation while achieving a low cost of materials. As a result, other than thermal losses from energy storage, steam generation efficiency can reach above 98%. The prevention of scale formation within the tubing is an important design consideration in the selection of steam quality and tubing design. As water flows through the serpentine conduit, the water first rises in temperature according to the saturation temperature corresponding to the pressure, then begins evaporating (boiling) as flow continues through heated conduits.

As boiling occurs, volume expansion causes acceleration of the rate of flow, and the concentration of dissolved solids increases proportionally with the fraction of liquid phase remaining. Maintaining concentrations below precipitation concentration limits is an important consideration to prevent scale formation. Within a bulk flow whose average mineral precipitation, localized nucleate and film boiling can cause increased local mineral concentrations at the conduit walls. To mitigate the potential for scale formation arising from such localized increases in mineral concentration, conduits which carry water being heated may be rearranged such that the highest temperature heating air flows across conduits which carry water at a lower steam quality, and that heating air at a lower-temperature flows across the conduits that carry the highest steam quality flow.

Returning to FIG. 6, various implementations are contemplated in which a fluid movement device moves fluid across a thermal storage medium, to heat the fluid, and subsequently to an HRSG such as HRSG 409 for use in the generation of steam. In one implementation, the fluid is air. Accordingly, air circulation through the HRSG 409 can be forced by a variable-speed blower, which serves as the fluid movement device in such an embodiment. Air temperature can be adjusted by recirculation/mixing, to provide inlet air temperature that does not vary with the state of charge of the bricks or other mechanisms used to implement a thermal storage unit. The HRSG 409 can be fluidically coupled to a steam turbine generator 415, which upon receiving the steam from the HRSG 409, causes the production of electrical energy using generator 417. Further, the steam gas turbine 415 in various embodiments releases low-pressure steam that is condensed to a liquid by a condenser 419, and then de-aerated using a deaerator 413, and again delivered to the HRSG 409.

Section A: High Efficiency Thermal Energy Storage and Heat Pump Systems

This Section A relates to systems and methods for high efficiency thermal energy storage systems that use one or more heat transfer systems such but not limited as a heat pump. In the following description, the thermal energy storage system, thermal storage media, processes for use and variations thereon may be any of the range of implementations described throughout this application, including in any combination with the variations discussed above that were described in the aforementioned U.S. Pat. No. 11,603,776.

Figure 7:
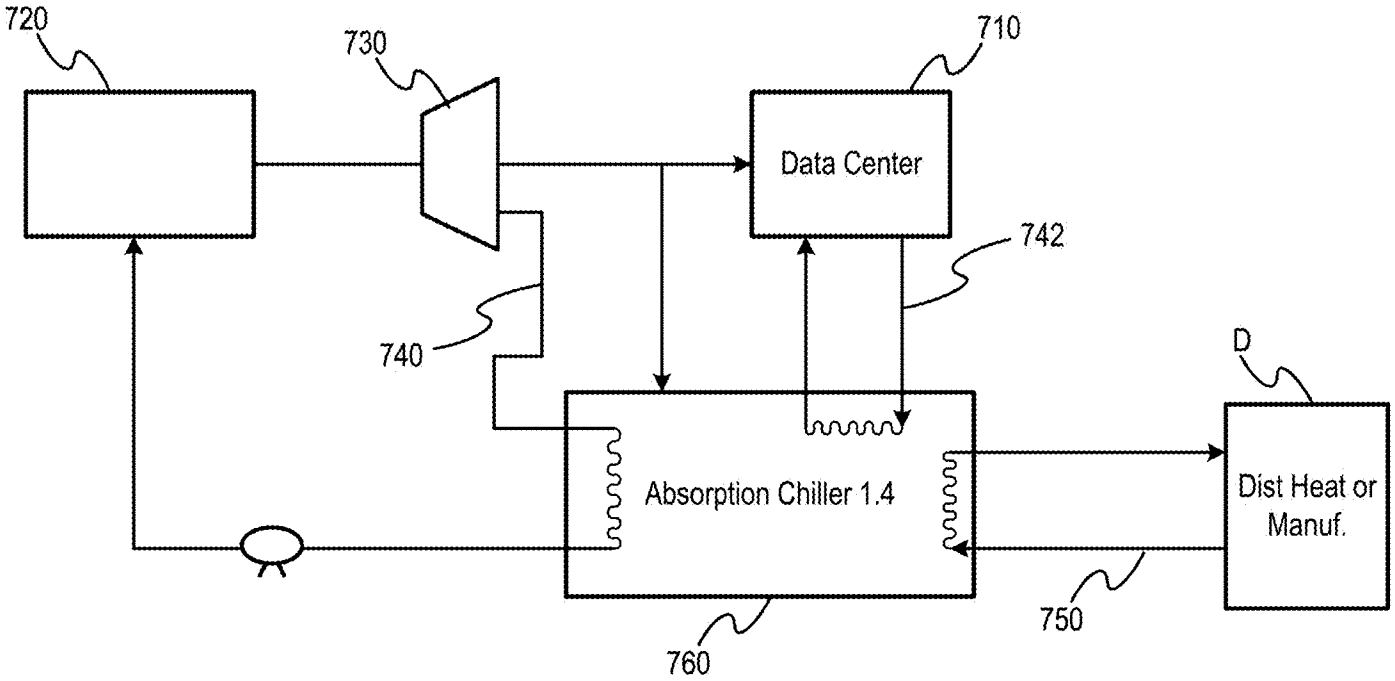
FIG. 7 illustrates a schematic diagram of a TES system with an chiller according to the example implementations.

Referring now to FIG. 7, one non-limiting example described herein involves the use of a data center 710 configured to run on electricity from a renewable energy source. Specifically, the data center is running on a thermal energy storage system 720 charged at least in part by intermittent power provided by a renewable energy source such as, but not limited to solar, wind, geothermal, hydroelectric, and/or tidal sources. In this embodiment, the thermal energy storage system 720 powers a steam turbine 730 that provides electricity to the data center 710.

In this non-limiting example, a certain percentage of the input power to the steam turbine 730 is converted to electricity for powering a facility such as, but not limited to, the data center 710. Now that means a percentage of the input energy of the steam turbine 30 is leaving the steam turbine 730 as waste heat 740 or other form that is not electricity. With regards to the recipient of the electricity, the data center 710 in this non-limiting example receives about 18 megawatts of input power which in turn puts out about 18 megawatts of heat, but the data center 710 outputs this return heat 742 at a low temperature of around 40° C. to 50° C. or in a temperature range a few degrees below or above that 40° C. to 50° C. temperature range.

One embodiment of a system herein repurposes return heat 742 from data center 710 to uplift heat from another thermal system such as, but not limited, to a district heating system D. A district heating system D may be a system for distributing heat generated in a centralized location through insulated pipes around a city or some portion thereof for residential and/or commercial heating purposes. Although a district heating system D is used as the example recipient of waste heat and/or return heat from the system in FIG. 7, it should be understood that other systems that are based on a thermal energy change to heat or cool can also be adapted to use the waste heat energy in the temperature range(s) associated with electricity generation or other work generation from this system.

The return heat 742 from the data center 710 is, unfortunately, typically at too low of a temperature to be used as-is for the district heating system D. A typical district heating system D desires heat in the temperature range of between about 65° C. to 80° C. This return heat 742, however, can be combined with other thermal source(s) to uplift the returning heat 750 of the district heating system D to the desired temperature range of between about 65° C. to 80° C.

Figure 8:
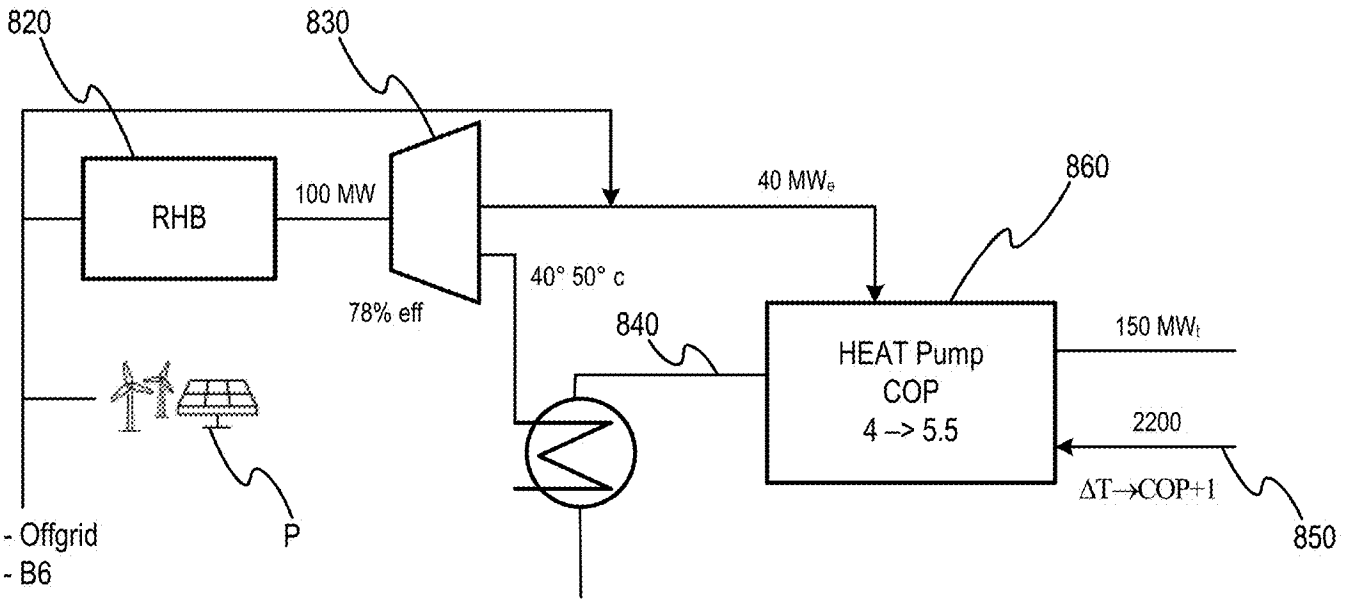
FIG. 8 illustrates a schematic diagram of a TES system with a heat pump according to the example implementations.

In this non-limiting example, a heat pump system 760, such as but limited to an absorption chiller, is provided that can use either the waste heat 740 out of the turbine, the return heat 742 from the data center 710, and/or some electric power to uplift the returning heat 750 of the district heating system D to a usable temperature range. As seen in FIG. 8, district heating heat pump 860 is bringing return heat 850 of the district heating system D back at 30° C. or similar temperature. This return heat 850 comes back from the district heating system D and will be output as heat at a higher temperature to be reused in the district heating system D. The turbine 830 has its waste heat 840 going to heat pump system 860. Optionally, the return heat 842 from the data center 10 can also be used as part of the heat pump system 860 or as a preheater to treat the return heat 850 of the district heating system D.

In this embodiment disclosed herein, waste heat from one or more component(s) of the system, such as from the steam turbine 830, is being recaptured along with other heat such as from a load like the data center 810, to uplift the returning heat 850. The waste heat is lifting the returning heat to a first temperature and then to a second, higher temperature. In this non-limiting example, the return heat 850 of district heating system D might be coming back at 30° C. and is being lifted to 40° C. possibly by the data center return heat 42, before it goes into the heat pump system 60 and being further lifted to about 65° C. to 80° C.

Turbine waste heat 840 is recaptured, potentially in series with return heat 842 from the data center 810, so that what is being given back to the district heating system D is all the energy that originally went to the turbine 830; some of the output went out as electricity and went through the data center 810, got turned into heat 842 and information, and then some of the energy was released as waste heat 840, and then all recaptured by the heat pump system 860 to uplift a fluid stream from a lower temperature to a higher temperature.

It should be understood that this is only one configuration using an electric drive heat pump and that there are other configurations that can use other devices, such as but not limited to a thermal drive heat pump, in place of or in conjunction with an electric drive heat pump for system 860. An electric drive heat pump has a coefficient of performance (COP) on the order of five; that is one unit of electricity in moves five units total heat. For a thermal drive heat pump, it has a COP of about 1.7, but one is feeding it heat, not electricity and it has lower capital cost plus fewer moving parts, possibly leading to a longer service life.

Embodiments are described herein provide electricity to facilities such as a data center, but in addition to separately making electricity, there are large heat pumps being installed to heat a town that could benefit from utilizing return and/or waste heat recovery as described herein to improve heat pump performance to further utilize heat associated with electricity generation.

Thus, instead of running the heat pump on continuous electricity provided by a natural gas powerplant or other fossil fuel powered power station which produce environmentally undesirable byproducts, the present embodiment proposes running the heat pump on intermittent renewable power by way of a thermal energy storage system; the waste heat from this power generation process is combined to further improve overall performance such that an embodiment has a factor 2.2 net COP for the heat. In a still further permutation of the embodiments described herein, a condenser can be included in the system to improve system performance.

FIG. 8 shows yet another embodiment as described herein related using a heat pump system 860 wherein output from a turbine 830 is output directly to power the heat pump system 860. FIG. 8 also shows an intermittent power source P such as solar panels or wind turbines that are used in grid or off-grid configurations to provide energy to the thermal energy storage system 820. There may be return heat 850 from the district heating system D.

I. Detailed System Descriptions

Novel Configurations of Heat Pumps and Thermal Energy Storage

The following embodiments may achieve one or more of the following advantages. First, the combined system may deliver all or a combination of high efficiency cooling, heating, and power generation with all the driving energy coming from a thermal energy storage system. The thermal energy storage system charges from electricity intermittently (or optionally continuously) and stores energy as heat at high temperatures. Compared to other forms of energy storage such as electrochemical batteries, the efficiency is higher (~92-99% efficient for TES for ~85% for electrochemical batteries) and the cost is lower. The system can provide continuous heating, cooling and power generation while charging entirely from intermittent renewable electricity. Depending on the actual process conditions and level of heat recovery built into the heat pump, the heat pump can deliver medium temperature heat at a COP of up to 2.5. The combined energy efficiency is very high (>90%). Efficiency advantages exist compared to comparable, conventional heating and cooling practices. Whether it is continuous grid electricity or on-site combustion of fossil fuels both alternative energy sources have reduced efficiency. For fuel combusting systems, boilers that generate steam often have efficiencies of about 85% HHV. This means that for a unit of energy entering the system as a fuel, 0.85 units of useful heat are produced with 0.15 exhausted to the environment. Comparing versus continuous clean electricity, the argument is slightly more abstracted. Outside of a few places in the world with available baseload renewable electricity generation (geothermal, nuclear, and hydro), most electric grids generate electricity with conventional, fossil fuel burning heat engines during times when intermittent renewables aren't generating. Heat engine generators have well known theoretical and practical efficiencies with the best generators having an efficiency of 45-50%. If the line is drawn around the source of energy, the current configurations with thermal energy storage charged from intermittent renewable sources beat out alternatives on an efficiency basis in most cases.

Often, efficiency is linked to carbon emissions. At least some embodiments herein produce less emissions than a system burning fossil fuels. Even when charged from the grid, the emissions of a pure grid tied solution would have more emissions, even if indirect. If a heat engine is operating with an example typical efficiency of 35%, it uses roughly 1/35% or ~2.9 units of fuel to produce 1 unit of electricity. The result is a system that has a higher carbon intensity than one that burns fuel for heat directly. The following configurations have an advantage in both energy efficiency and carbon intensity. A few of the configurations have their main advantage in being a cost effective alternative to other systems with the same capabilities (on site energy storage, continuous delivery of high quality heat).

A thermal energy storage system 720, such as a heat battery, is provided that charges intermittently from electricity. This charging is intermittent due in part to the nature of some of the energy sources such as but not limited to solar or wind sources that have variability in their energy output and availability. Energy is stored within the heat battery in the form of heat. The heat battery discharges heat to some heat transfer medium (heated water, air, steam, or other heat transfer fluid).

In this current non-limiting example, this integration with the heat battery discharges heat by generating high pressure, superheated steam either directly or indirectly with a heat exchanger. This steam is expanded across a steam turbine which produces work which can be used directly to power compressors or pumps or with a generator to produce electricity.

Sorption heat pumps refer to a class of thermally driven heat pumps that use high temperature heat instead of vapor compression as the driving energy source of the system. There are two broad classes of sorption heat pumps: absorption and adsorption.

Absorption relies on the refrigerant being absorbed by a liquid sorbent in the heat pump to manipulate the boiling point and drive the heat pump cycle. The liquid sorbent is pumped between the absorber and desorber where it releases and absorbs heat. The adsorption heat pump cycle is thermodynamically similar to the absorption heat pump cycle except instead of the refrigerant being absorbed by a liquid sorbent, the refrigerant is absorbed in the pores of a solid sorbent. Both are mature technologies that are well known for heat pumps.

Figure 9:
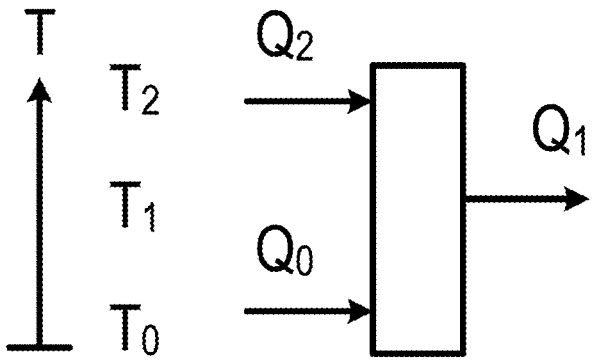
FIG. 9 illustrates a schematic diagram of a thermal system according to the example implementations.

Sorption chillers/heat pumps have the same requirements. As seen in FIG. 9 above, a high temperature heat source Q2 is desired for the driving energy. Useful cold (in chillers) or low temperature heat (in heat pumps) Q0 is supplied at the lowest temperature. The sum of the heat supplied (such that energy is conserved within the heat pump) is released at a medium temperature level Q1. Q1 is released as useful heat in heating operation (heat pumps) and in cooling mode (chillers) it is often released to the environment though it can be used in a heating process as well.

Operating with the same working principle, sorption chillers/refrigerators or cooling machines are sorption heat pumps configured for a different application. These devices use high temperature heat as a driving energy source and a medium temperature heat sink to produce chilled or cold fluid that is significantly cooler than ambient conditions. An absorption chiller may be used to produce chilled fluid at temperatures as low as −40° C. and as high as 18° C.

Both sorption chillers and heat pumps have an electric alternative, so called compression heat pumps and chillers that rely on vapor compression instead of thermally driven (ad/ab) sorption to transfer heat. The electrically driven compression heat pumps have much higher coefficients of performance than the sorption types. However, there are scenarios in which sorption heat pumps and chillers have been found useful. There may be value in a sorption heat pump over a compression type when electricity is scarce or expensive, and waste or cheap heat is available.

The embodiments disclosed herein present configurations that cover several integrations of heat pumps and chillers with a thermal energy storage system. Electrically charged thermal energy storage stores electrical energy as heat at a fraction of the cost of traditional electrical energy storage devices such as electrochemical batteries. In the race to mitigate carbon emissions to avoid climate change, there is a large and growing desire to utilize electricity from intermittent renewables such as wind and solar power. Many processes desire continuous operation which makes fully powering a process with intermittent renewables challenging. If the process is continuous but relies on intermittent power sources, it most typically would involve energy storage. Provided the cheaper cost and higher efficiency of storing energy as heat versus electrochemically in a battery, there are new use cases of sorption heat pump and chiller technology that begin making sense. Instead of having a renewable energy source, an electrochemical battery, and a compression heat pump/chiller, one could have a renewable energy source, a TES battery, and a sorption heat pump/chiller. Several possible thermal integrations based on this premise are described herein. Optionally, some integrations may rely on additional specific requirements to demonstrate their value.

In the following diagrams, the temperatures are example operating conditions, are non-limiting, and are primarily intended to illustrate the various temperature levels within the heat pump and thermal energy storage systems.

Figure 10:
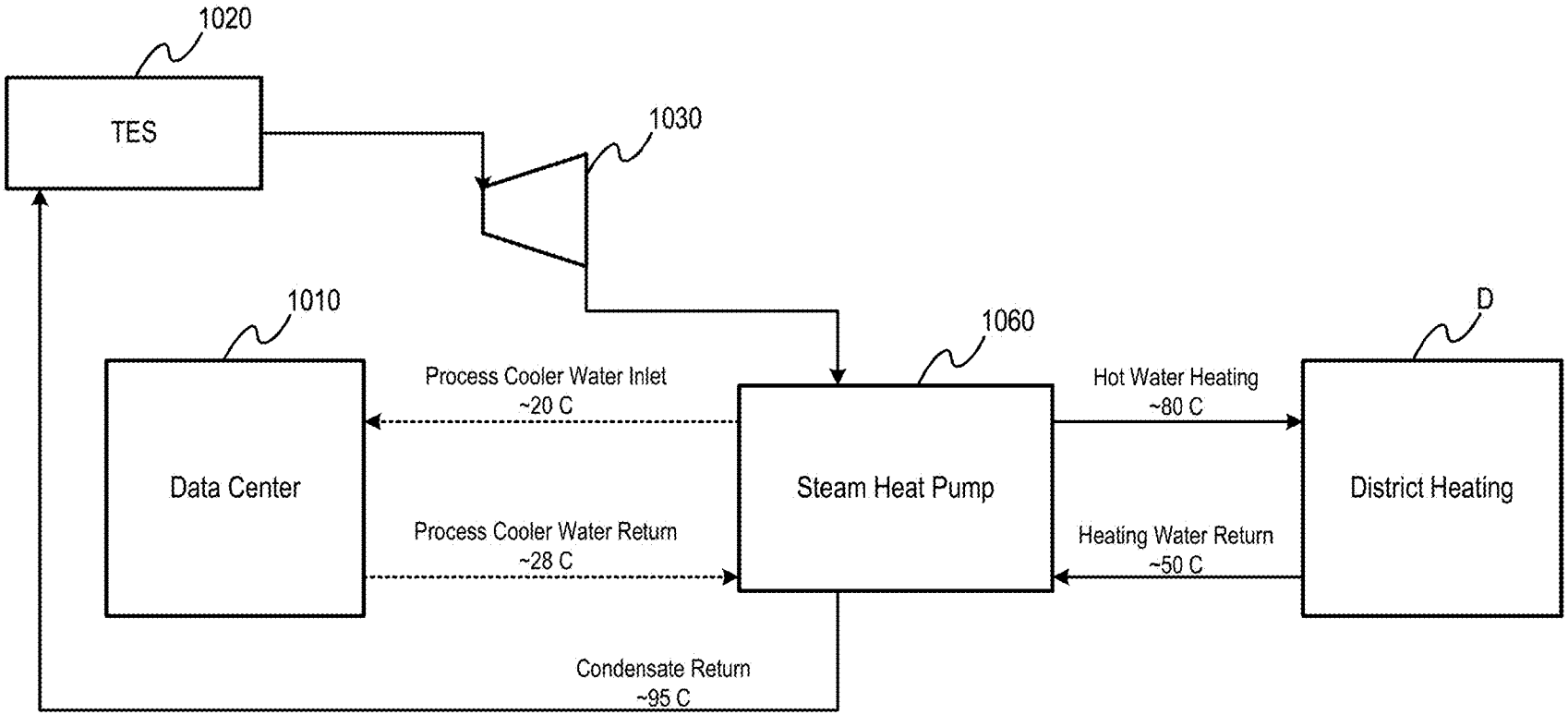
FIG. 10 illustrates a schematic diagram of a TES system with steam heat pump according to the example implementations.

1) Thermal Storage+Noncondensing Steam Turbine+Absorption Heat Pump+Heat Load+Cooling Load:

Referring to FIG. 10, this figure shows an example schematic of a data center 1010 and district heating network D utilizing the cooling and heating of a heat pump 1060. This implementation includes a TES 1020 for thermal storage feeding thermal energy to a turbine 1030. While the temperatures here are representative, this example would work well with warm water-cooled data centers with a heat pump COP of about 1.7.

Figure 11:
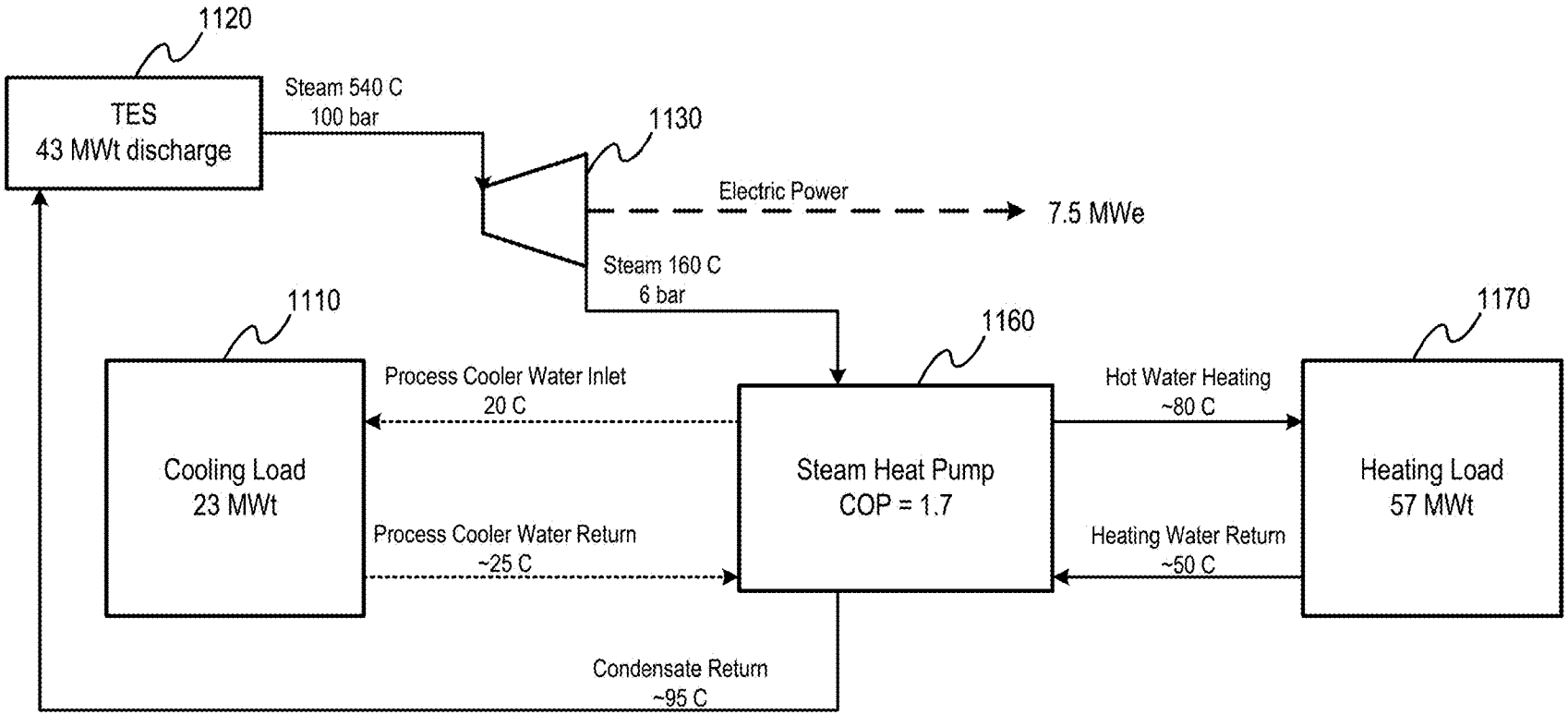
FIG. 11 illustrates a schematic diagram of a TES system with steam heat pump according to the example implementations.

Referring now to FIG. 11, this figure shows, in more detail, a system that provides approximately 23 MW of cooling, 7.5 MWe of electrical generation and 57 MWt of medium temperature heating out of 43 MW of discharge from a TES system 1120. The temperatures and quantities resemble a realistic system with an absorption heat pump COP of 1.7 and a very high roundtrip efficiency. The power quantities and temperatures will likely be different case to case as different processes will have different operating conditions.

In this non-limiting example, this integration broadly describes a system comprising an electro-thermal energy storage system (TES) 1120, a non-condensing (backpressure) steam turbine 1130, a steam driven sorption heat pump 1160, a cooling load 1110, and a heating load 1150. An example cooling load 1110 may be a cooling water loop of a data center. The heating load 1170 might be the hot water supply/return of a district heating network. It is noted that the cooling fluid returning to the heat pump is at a lower temperature than the heating fluid returning to the heat pump.

The high temperature driving heat source is provided by steam that is exiting the non-condensing steam turbine 1130.

In this embodiment, the low temperature heat source for the heat pump is the returning cooling fluid from the cooling load. In this non-limiting example, the cooling load may be a liquid-cooled data center although other cooling loads are not excluded. Water might leave the heat pump at 20° Celsius and flow to the data center's cooling system. The cooling water picks up heat from the data center and returns to the heat pump at a temperature of 28° Celsius. The heat pump cools the water from 28° to 20° C. via heat exchange in the evaporator section of the heat pump.

The heat sink of the heat pump 1160 is the water to the heating process. For example, say the heating load is a district heating network that desires inlet water at 80° C. and returns from the network at 50° C. The heat extracted from the lower temperature heat source (the data center in the previous example) and from the higher temperature driving heat source is combined and discharged at the medium temperature heat sink temperature of 80° C. such that the amount of medium temperature heat exiting the system is greater than the amount of heat entering the system as high temperature driving steam.

The thermally driven heat pump 1160 is driven by steam, typically at pressures of about 2-8 bar (g) in the generator/desorber section of the heat pump. The steam is used to boil off the refrigerant in the heat pump 1160. After internal heat recovery within the heat pump, the driving steam source is often condensed and exits at temperatures under 95° Celsius as condensate. The condensate may desire deaeration or other treatment before being pumped to high pressures and recirculated back to the TES. The thermal energy storage system exchanges its stored heat with the high-pressure water such that superheated steam is generated at a temperature and pressure greater than the desired temperature and pressure of the heat pumps driving steam conditions. An example power steam pressure generated from the TES 1120 is about 100 bar, 540° C. In one non-limiting example, the high-pressure and high temperature turbine can handle at least 100 bar and at least 550° C. fluid. Optionally, the high-pressure and high temperature turbine can handle at least 100 bar and at least 500° C. fluid. Optionally, the high-pressure and high temperature turbine can handle at least 90 bar and at least 450° C. fluid. Optionally, the high-pressure and high temperature turbine can handle at least 80 bar and at least 400° C. fluid.

The high-pressure power steam is directed fully or in part to a non-condensing steam turbine 1130. The high-pressure steam is expanded to the pressure of the driving steam of the heat pump. In the expansion process within the turbine, mechanical work is generated. Mechanical shaft work from the turbine can be used directly to drive pumps or compressors and/or paired with a generator to produce electricity.

The combined system delivers high efficiency cooling, heating, and power generation with all the driving energy coming from a thermal energy storage system. The thermal energy storage system charges from electricity intermittently (or optionally continuously) and stores energy as heat at high temperatures. Compared to other forms of energy storage such as electrochemical batteries, the efficiency is higher (~92-98% efficient for TES for ~85% for electrochemical batteries) and the cost is lower. Thus, the system can provide continuous heating, cooling and power generation while charging entirely from intermittent electricity at a lower lifecycle cost than with conventional electrochemical storage. Depending on the actual process conditions and level of heat recovery built into the heat pump, the heat pump 1160 can deliver medium temperature heat at a COP of up to 2.5. The combined energy efficiency is very high (>90%).

Figure 12:
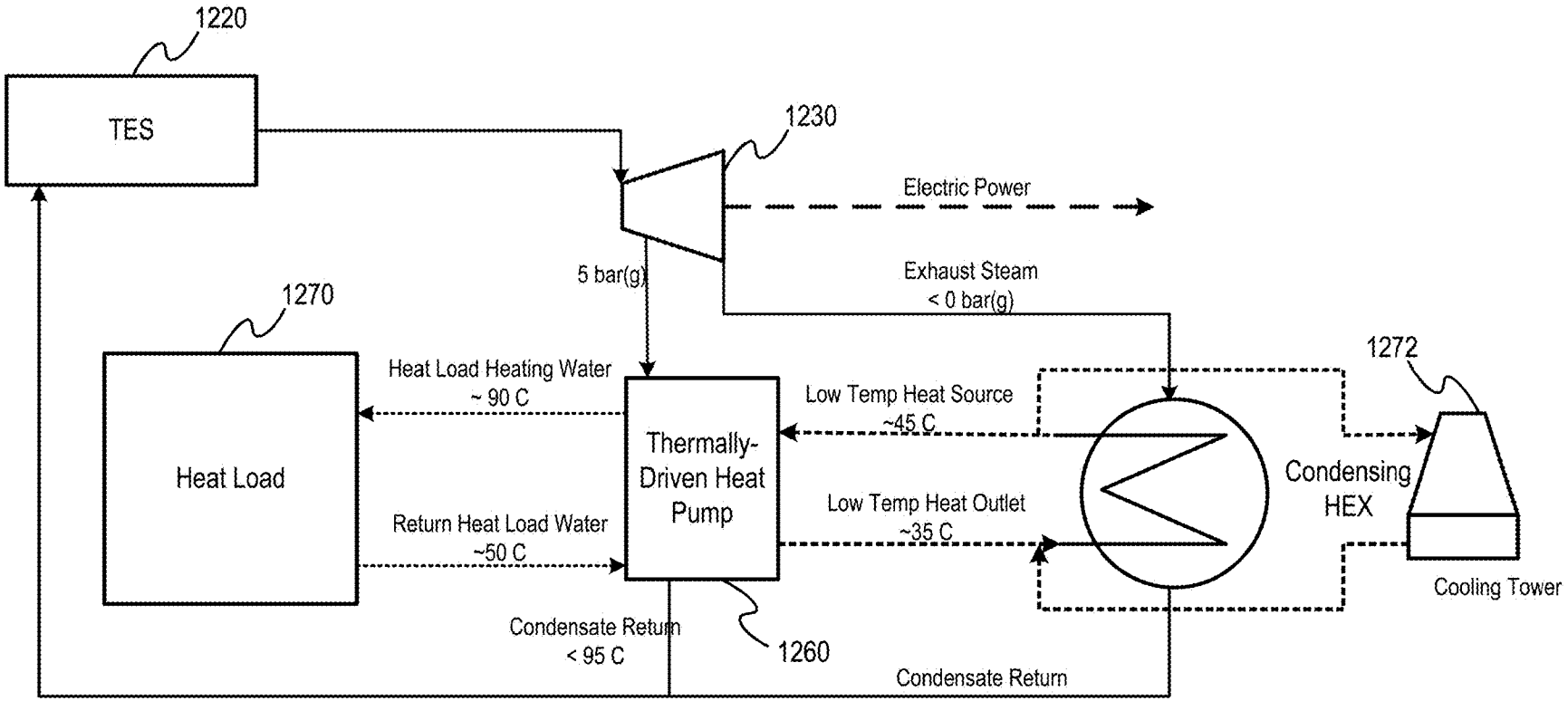
FIG. 12 illustrates a schematic diagram of a TES system with thermally drive heat pump according to the example implementations.

2) Thermal Storage+Condensing Steam Turbine+Thermally Driven Heat Pump+Heating Load:

Referring now to FIG. 12, this embodiment broadly describes a system comprising an electro-thermal energy storage system (TES) 1220, an extraction-condensing steam turbine 1230, a steam driven heat pump 1260, an integrated condenser heat exchanger, and a heating load 1270. The heating load might be the hot water supply/return of a district heating network. Once again, the condenser cooling fluid returning to the heat pump is at a lower temperature than the heating fluid returning to the heat pump.

This is very similar to the embodiment of FIGS. 10 to 11 with a non-condensing steam turbine 1230. In this non-limiting example, instead of a low temperature cooling load (such as a data center cooling system), the low temperature cooling load is the cooling of the condenser. In some implementations, the low temperature stream may be joined by the return fluid from another lower temperature cooling process such as from data center cooling. The high-pressure power steam generated with heat from the TES 1220 is again directed into a steam turbine 1230. Work is generated as the steam is expanded and pressure is reduced. The steam turbine is to be configured with an extraction port such that at the turbine stage where the steam is at a pressure that matches the high temperature driving heat requirement of the heat pump. Typically in one non-limiting example, desired steam pressures are about 2-8 bar (g). At this point, the desired mass flow of steam is directed towards the heat pump to provide driving heat. The remaining power steam is fed back into the steam turbine where it is further expanded to a lower pressure. Typical condensing steam turbines condense to pressure well below atmospheric such that steam condenses at temperatures between approximately 17° and 70° Celsius. The lower the pressure and temperature of the condenser, the more power there is to be extracted from the power steam.

In some condensing steam turbines, a large volume of low-grade heat is available from the condenser. Usually, this heat is dispelled to the environment via cooling tower or direct air heat exchange as its temperature is often too low to provide useful heating. In this embodiment, energy in the system is conserved by directing all or a portion of the waste heat generated to the heat pump to serve as its low temperature heat source. This low temperature waste heat is combined with the high temperature driving steam to produce a medium temperature discharge that is of a high enough temperature to be used in a heating process such as a district heating network.

The effect of this is that an intermittently charged thermal energy storage system can drive a high efficiency system that provides heating power generation. The effects are very similar to the first embodiment with a non-condensing steam turbine. The main difference between the two is that more power can be generated relative to the heat supplied with the condensing system. Instead of using the heat pump's cooling capacity as it did previously with the waste heat stream from the data center, the cooling capacity is used to power the condenser which allows for additional power generation through the lower pressure stages of the steam turbine.

Figure 13:
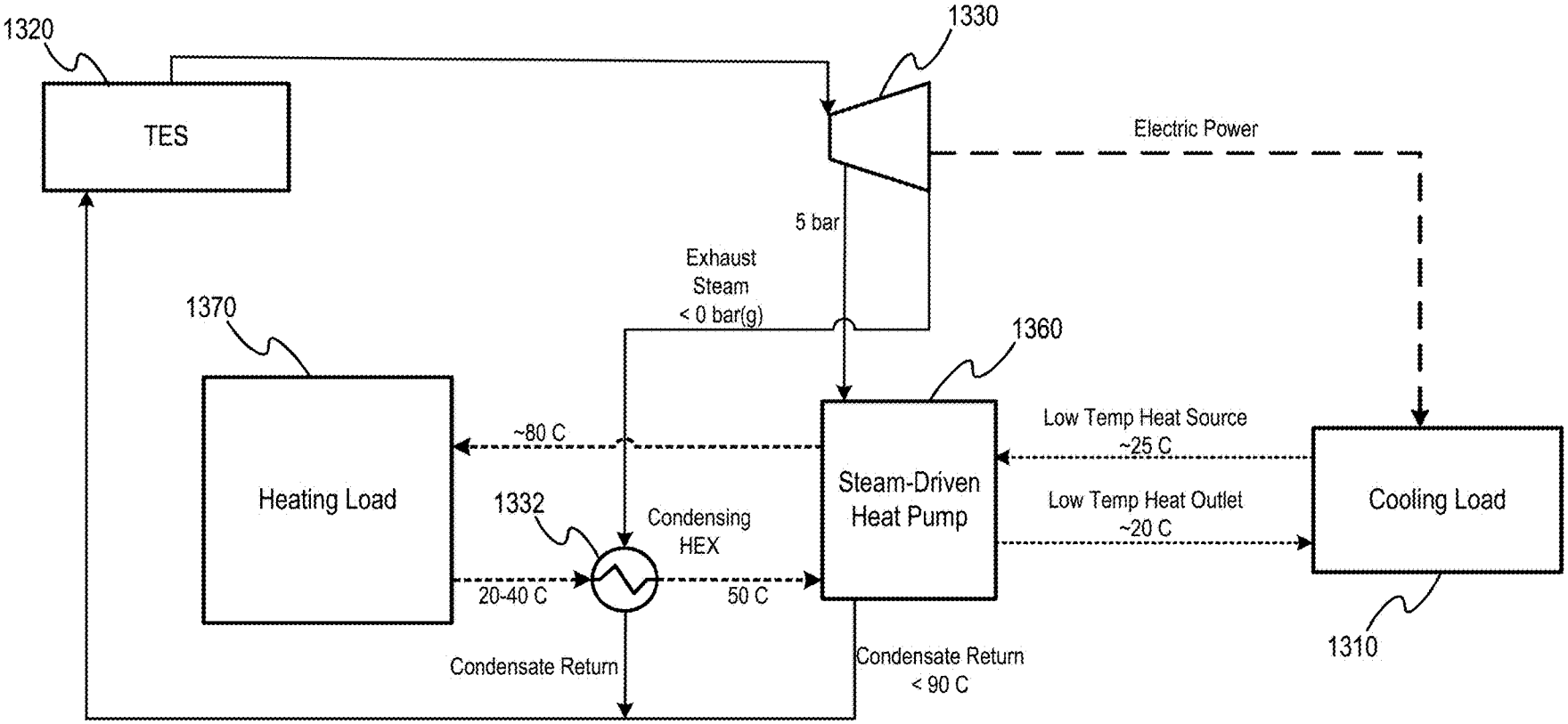
FIG. 13 illustrates a schematic diagram of a TES system with steam heat pump and a condensing heat exchanger according to the example implementations.

3) Thermal Storage+Condensing Steam Turbine+Thermally Driven Heat Pump+Heating Load+Cooling Load:

Referring now to FIG. 13, this integration broadly describes a system comprising an electro-thermal energy storage system (TES) 1320, an extraction-condensing steam turbine 1330, a steam driven sorption heat pump 1360, an integrated condenser heat exchanger 1332, a cooling load 1310, and a heating load 1370.

In this non-limiting example, this integrated system resembles the embodiment of FIG. 12 with a condensing steam turbine 1330. However, instead of configuring the system such that the heat recovered from the condenser heat exchanger 1332 by the condensing power steam serves as the low temperature heat source of the heat pump 1330, it is instead used to heat the return water of the medium temperature heating load 1370. The returning stream from the cooling load 1310 provides the low temperature heat source for the heat pump 1330.

If the temperature of the return stream from the heating process is low enough to maintain adequate condensing conditions in the condenser this process has advantages. Similar to the past configurations, it is a system designed for high efficiency and cost effectiveness when there is a demand to continuously drive power generation and heating and cooling loads with intermittent electricity.

If the cooling process is a data center, the electricity generated by steam turbine 1330 can be used to power the data center. A large portion of electricity input to data centers for data processing exits the system as heat. This combined system utilizes the waste heat traditionally associated with power generation via the Rankine cycle and utilizes that heat in cooling the data center and heating another higher temperature process.

The heat recovered by the heating loads return water is beneficial in a few ways. First, it maintains condenser temperature which enables a higher yield of electricity per input power steam without needing to reject the high-volume, low-grade heat to the atmosphere. In addition to losing energy to the environment, this heat rejection may have occurred in a cooling tower where a significant amount of water is lost to the environment via evaporation. Second, it improves the performance of the heat pump. Generally, the temperature difference between the low temperature heat source and the medium temperature heat sink has an inverse relationship with coefficient of performance. The larger the temperature lift, the more driving high temperature heat desired. By utilizing the waste heat from the condenser 1332, the incoming temperature can be increased, and the heat pump 1330 will be more effective.

4) Using a Compression Heat Pump

Referring now to FIGS. 14, 15, 30, and 31, similar configurations can be made using a compression heat pump instead of a thermally driven one.

Figure 15:
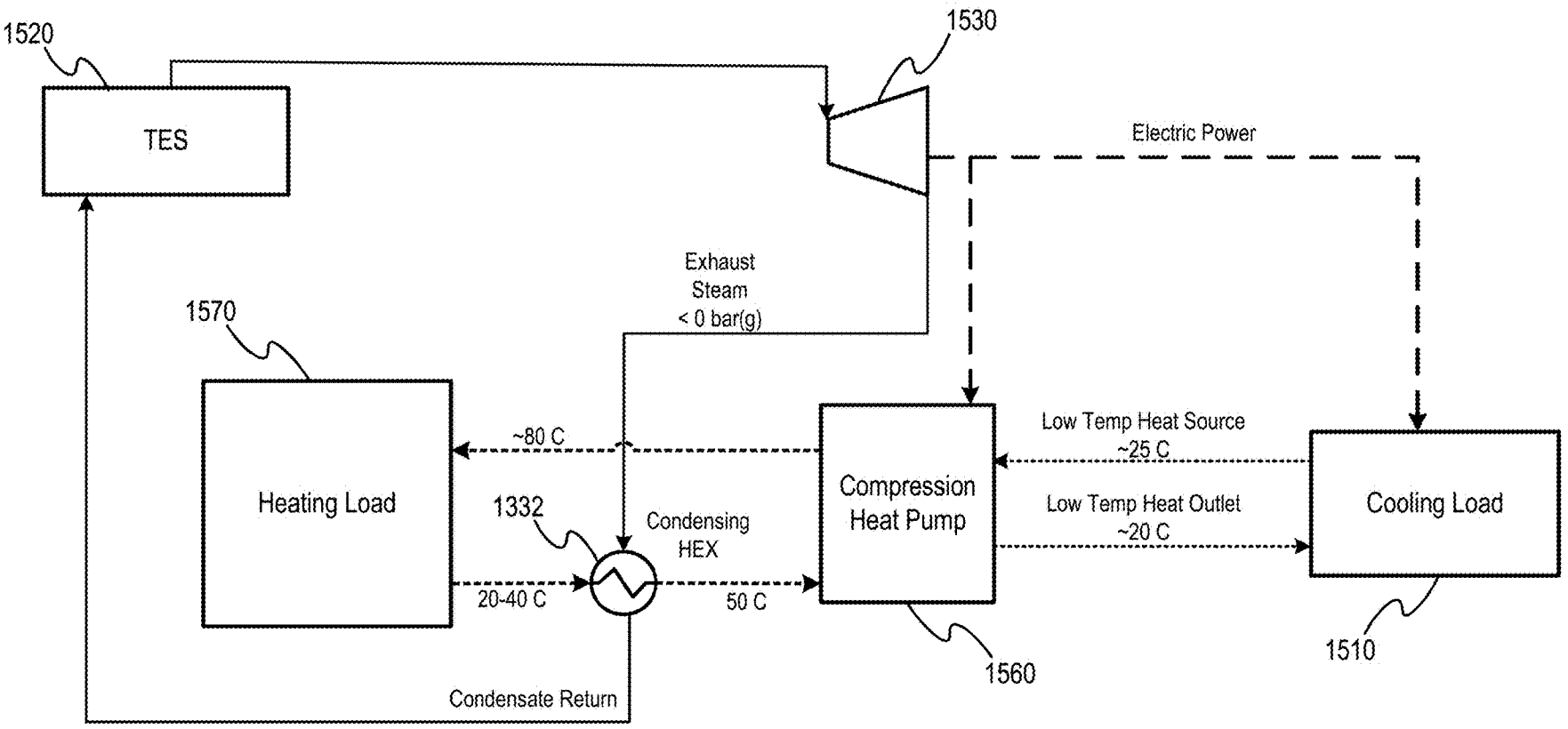
FIG. 15 illustrates a schematic diagram of a TES system with a compression heat pump and a condensing heat exchanger according to the example implementations.

As seen in FIG. 15, in the broadest, this embodiment comprises a condensing steam turbine 1530 with no extraction combined with a TES 1520, a heat pump 1560, a cooling load 1510, and a heating load 1570. The waste heat from the condensing steam turbine's condenser is captured in a condensing heat exchanger 1532. The condensing power steam may exchange heat with a lower temperature stream entering the heat pump 1560. In one embodiment, the condensing heat exchanger 1532 may preheat return water from the heating load 1570. This heating load 1570 may be a district heating network that returns water at a low enough temperature to meaningfully drive condenser cooling.

In this non-limiting example, there is a cooling load that provides the low temperature heat source to the heat pump. This cooling load may be a cooling tower, a data center cooling system, a district cooling network, or some other cooling process. The electricity generated may also be sent to an adjacent electricity load, such as a data center.

Figure 14:
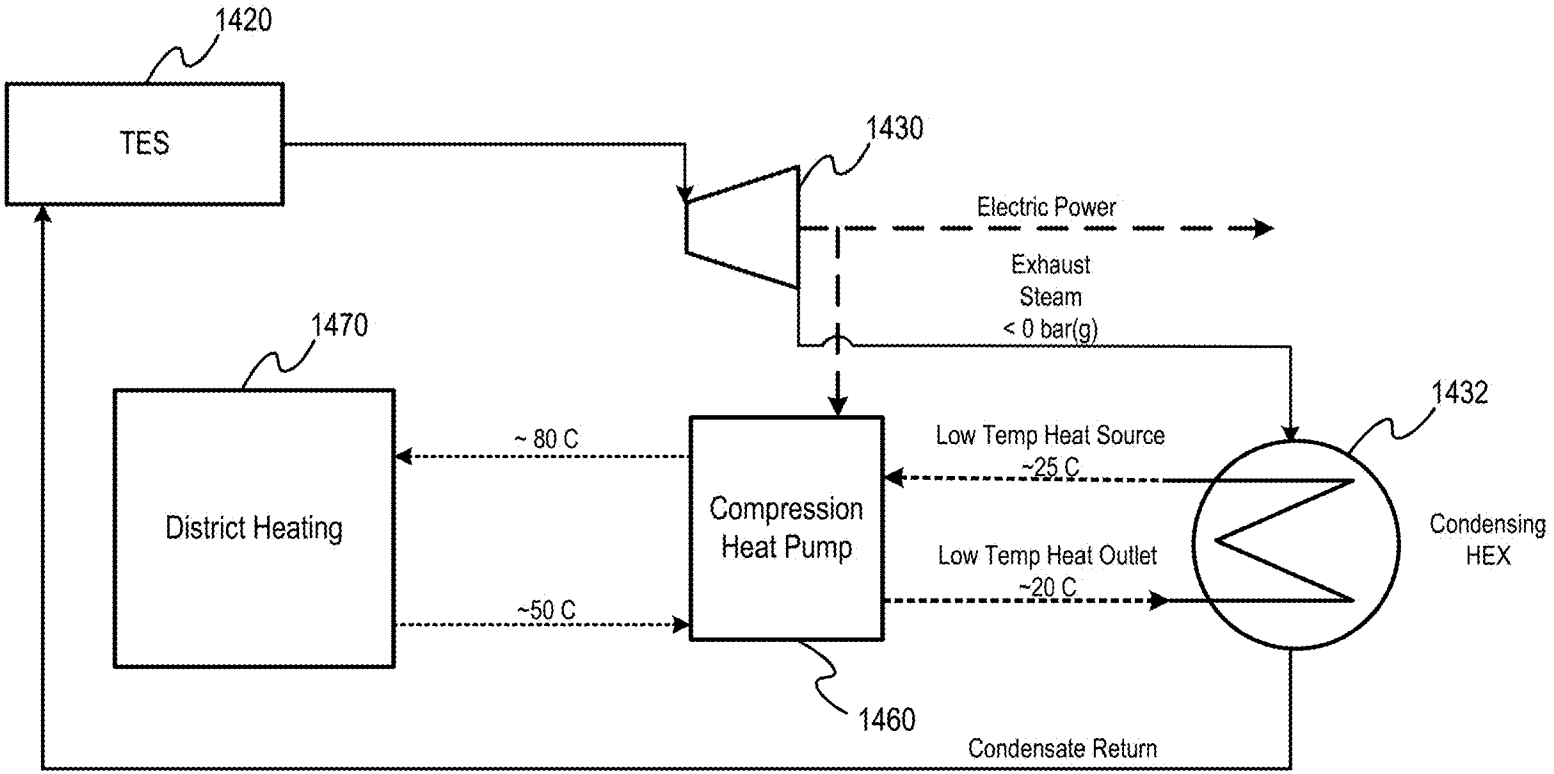
FIG. 14 illustrates a schematic diagram of a TES system with a compression heat pump and a condensing heat exchanger according to the example implementations.

In another embodiment, shown in FIG. 14, the Rankine Cycle condenser 1432, at least partially, serves as the low temperature heat source for the heat pump 1460. Cooling fluid (such as but not limited to water) exchanges heat with the condensing power steam from the steam turbine 1430, powered by TES 1420, such that the fluid is heated up and directed to the heat pump 1460 as the low temperature waste heat source. The system may be coupled to a heat load 1470 such as for district heating.

Although not pictured, a system can be imagined where the condensing exhaust power steam is used to both fully and/or partially preheat the heating load return stream to the heat pump and provide low temperature heating for the low temperature heat source. In another embodiment, depicted in FIG. 31, there may be a heat pump that uses an existing low temperature waste heat source such as a river. The river may be used first to cool the condenser (capturing waste heat from the Rankine cycle) where it is then able to provide more low temperature heat at a higher temperature to the heat pump which fundamentally improves the COP. Now there is a heat pump that can be operated entirely using off-peak or intermittent electricity to continuously provide heating.

In this embodiment, heat stored in the TES is used to generate high pressure power steam. A conventional Rankine cycle is used to generate work (electricity or mechanical). In one embodiment, at least a portion or all the electric power generated is sent to the compression heat pump to utilize the waste heat of the low temperature heat source. As mentioned above, the low temperature heat source may be from the condenser itself or part of a recirculating cooling load.

A primary advantage of compression heat pumps versus thermally driven sorption heat pumps is the much greater C.O.P. Whereas, sorption heat pumps range might achieve COPS in the range of 1.2-2.5. Compression heat pumps can achieve COPs greater than 4.

Figure 16:
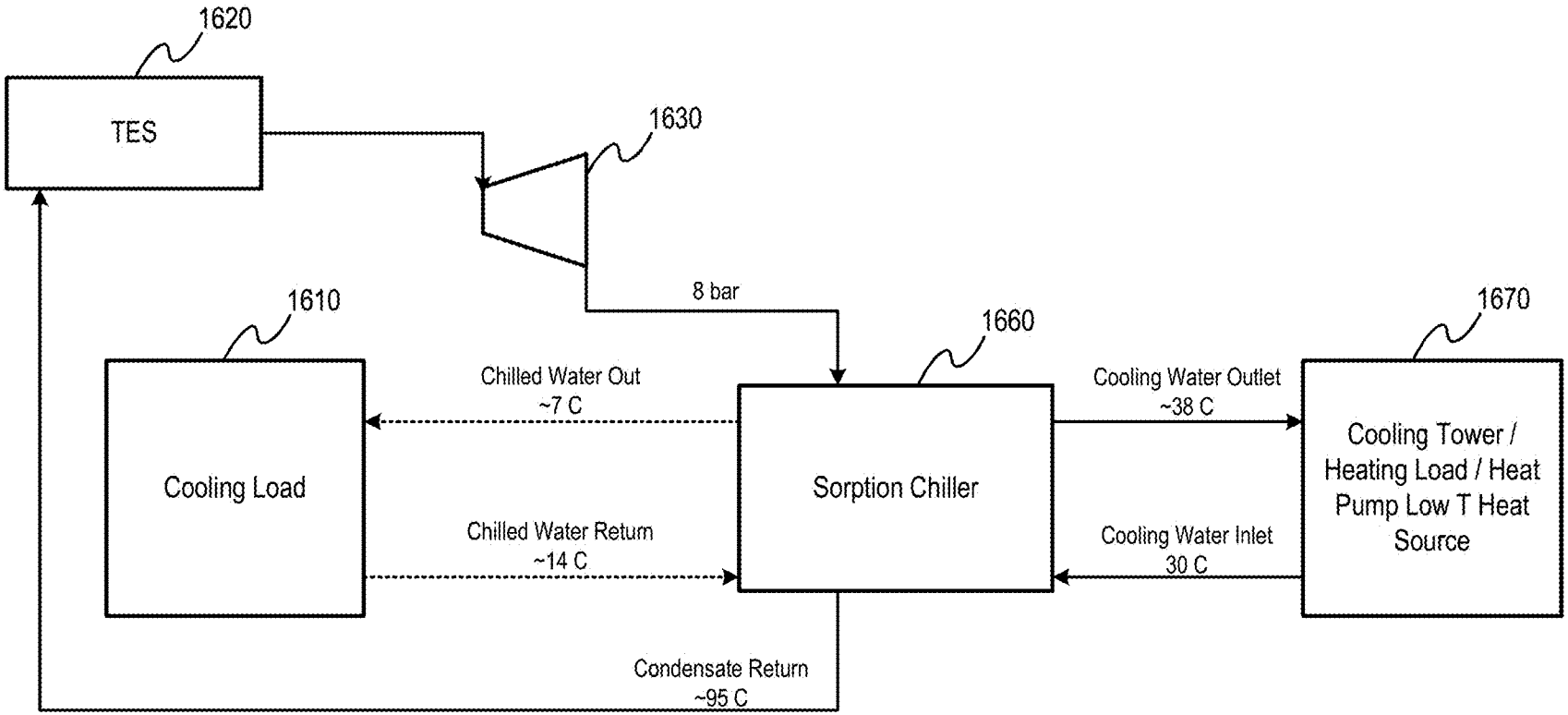
FIG. 16 illustrates a schematic diagram of a TES system with a sorption chiller and a cooling load according to the example implementations.

5) Chiller Integration:

Referring now to FIG. 16, this embodiment resembles other embodiments described herein. Instead of recycling heat from a low temperature heat source to produce higher temperature water, as one would do with a heat pump, the chiller 1660 rejects medium temperature heat in order to provide low temperature cooling. A chiller 1660 would be used if the primary load is a cooling load 1610 such as for lower temperature cooling. For example, a chiller 1660 may be used to provide cooling at about −40° C. for refrigeration purposes or about 5°-18° C. for process cooling or air conditioning.

In this non-limiting example, the medium temperature heat sink of the chiller 1660 may be rejected in a cooling tower 1670. If there is a use to the medium temperature heat coming off the chiller 1660, it may also be used directly in a process that needs hot water, such as domestic water heating. In another embodiment, the medium temperature heat rejection of the chiller 1660 may be used as the driving low temperature heat source in a heat pump that uses either more extracted steam from the steam turbine 1630 or electricity generated from stored energy in TES 1620 to produce higher temperature water to be used in a higher temperature water heated process.

For implementations where the chiller 1660 is an absorption chiller, the chiller 1660 in the figure above with the associated temperatures might have a cooling COP of 1.4. The temperatures are just for illustrative purposes and different processes specific requirements may desire different temperatures and driving heat requirements.

Heat Pump for Feedwater Preheating

Temperatures and pressures in the diagrams are for illustrative purposes only to show the relative quality of streams within the system. In practice, a wide range of conditions within streams can be observed.

Figure 17:
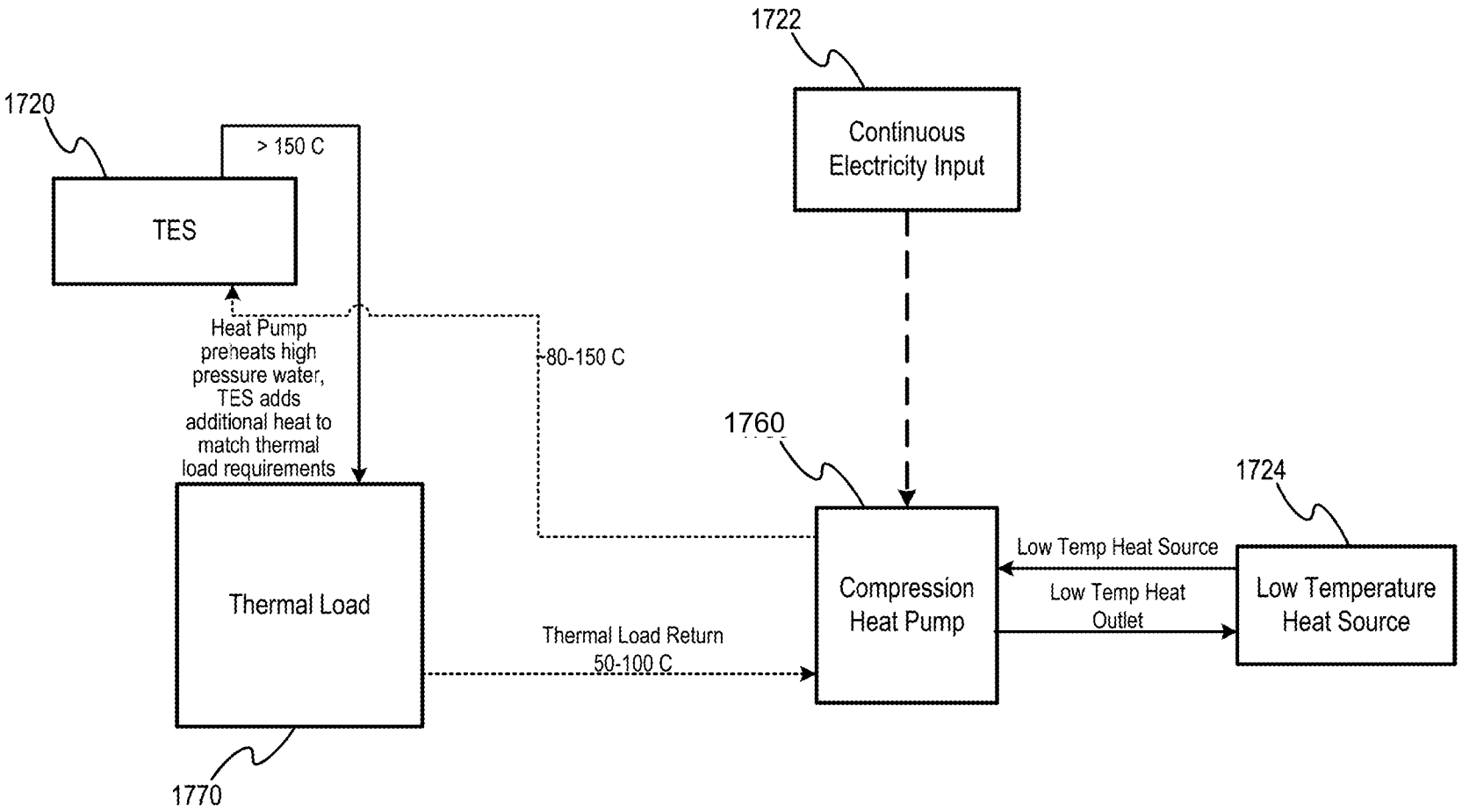
FIG. 17 illustrates a schematic diagram of a TES system with a compression heat pump and without a steam turbine according to the example implementations.
Figure 18:
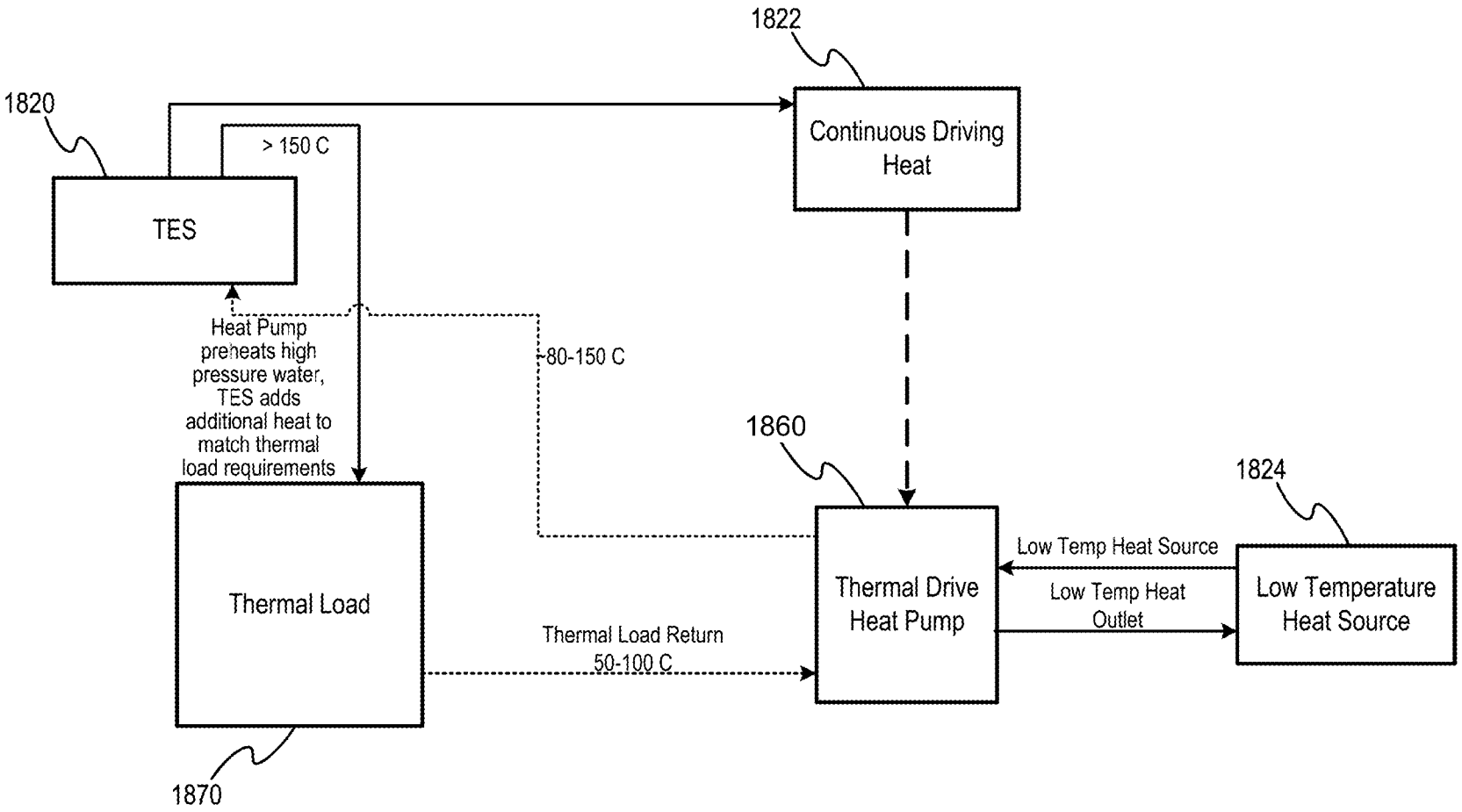
FIG. 18 illustrates a schematic diagram of a TES system with a thermally driven heat pump and a thermal load according to the example implementations.

As seen in FIGS. 17 to 18, this embodiment considers a heat pump 1760 or 1860 utilizing a low temperature heat source 1724 or 1824 to heat a fluid to a first temperature. The fluid that is heated by the heat pump 1760 or 1860 is directed to a thermal energy storage system 1720 or 1820 to be further heated to a second, higher temperature. Heat pumps have well known operating temperature limitations that stem from the thermodynamic properties on the refrigerants that are used in the system. Recent advancements have allowed higher temperature steam generation from heat pumps, though these systems are complex and costly and still have a temperature limit of 140-180° C. This embodiment addresses this problem. Even for applications that desire heat of a higher quality than a heat pump can provide, the benefits of high heat pump COP by utilizing a low temperature waste heat source can be realized. The system may include a source of continuous electricity input 1722.

In one embodiment, the heat pump may be a thermally driven heat pump 1860 such as a (abs/ad) sorption heat pump or an ejector heat pump or a mechanically driven heat pump (compression heat pump). If it is a thermally driven heat pump 1860, driving heat may be supplied from the thermal storage unit 1820, from a high temperature waste heat source, from another source of heat, or from some combination. If it is a compression heat pump 1760, the driving electricity may come from electricity cogenerated within the full system (in the case of an integrated turbine), renewable electricity, from the grid or other source of generation or some combination. For example, there may be a system with a solar PV field as the only source of energy. The solar PV generation may provide power to the heat pump and the TES system when the sun is out. When solar PV stops generating, a steam turbine integrated into the system may provide the driving electricity for the heat pump. The low temperature heat source may be from a waste heat source from a process, geothermal well, body of water, or from waste heat from a condensing heat exchanger of an integrated turbine within the system. The system would be a low cost, more efficient to a configuration using electrochemical batteries and electrically driven heat pumps/booster heaters/compressors.

Figure 19:
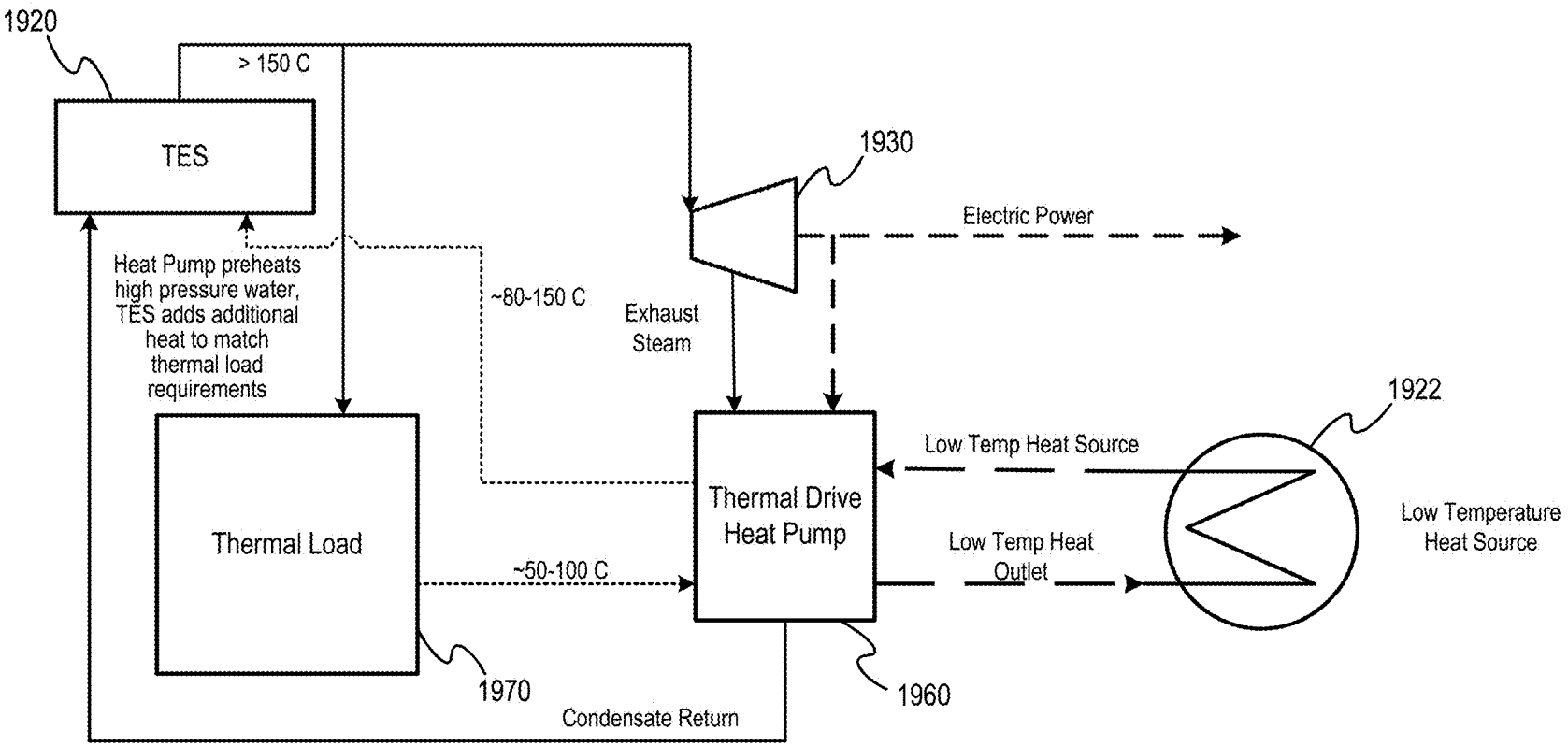
FIG. 19 illustrates a schematic diagram of a TES system with a thermally driven heat pump and a thermal load according to the example implementations.

In some configurations as seen in FIG. 19, a turbine 1930 to generate mechanical work or electricity can be integrated into the system. In one, a non-condensing turbine 1930 uses some of the steam generated by the TES system 1920 to generate electricity or mechanical work that may be used to drive pumps in the heat pump 1960 or exported to another use. The steam exiting the non-condensing turbine 1930 can be used as the high temperature driving heat source of a thermally driven heat pump 1960. Optionally, the system may include a low temperature heat source 1922 in communication with the heat pump 1960.

Figure 20:
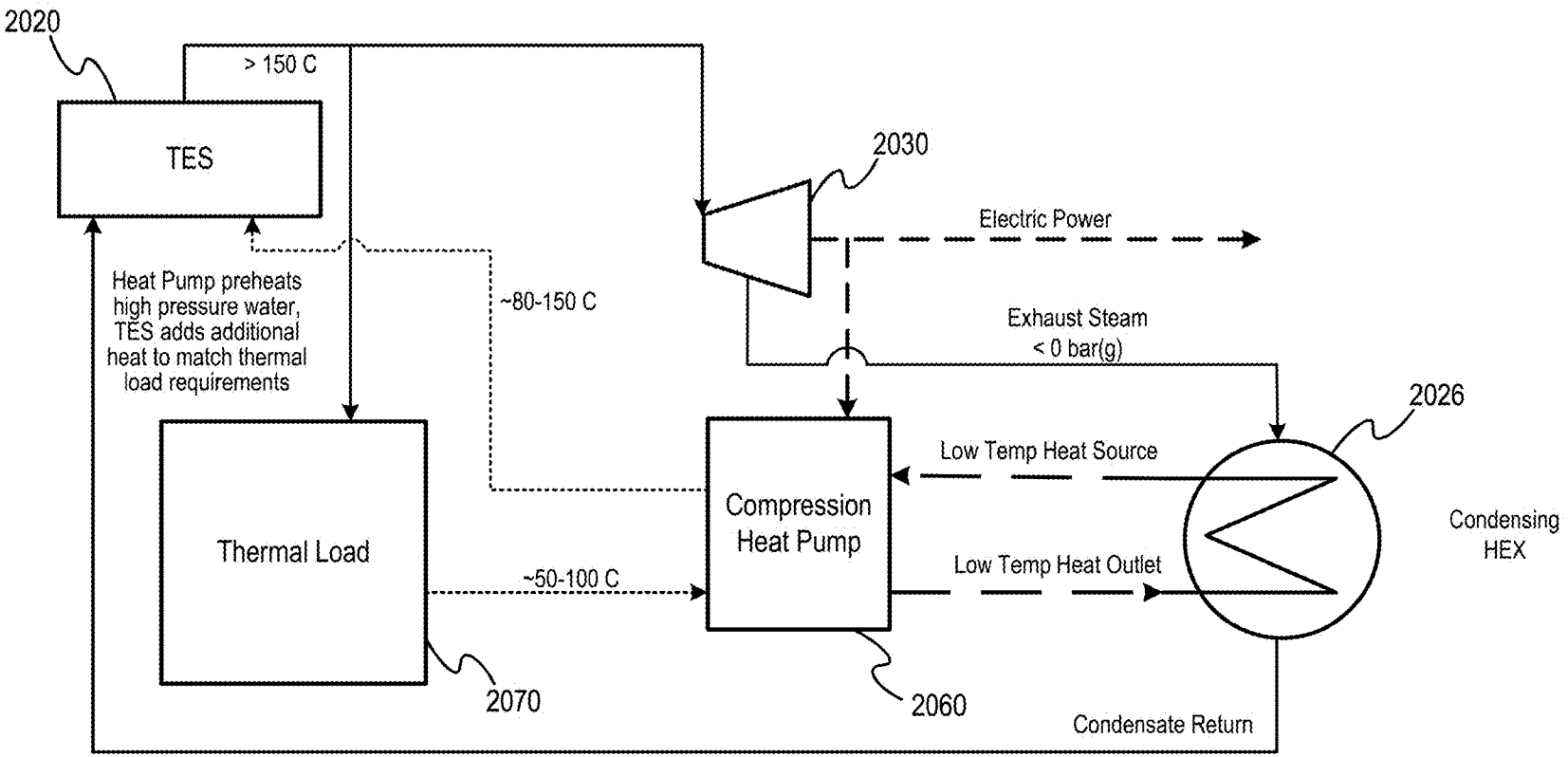
FIG. 20 illustrates a schematic diagram of a TES system with a thermally driven heat pump and a thermal load according to the example implementations.

In another case as seen in FIG. 20, a condensing steam turbine 2030 is used to generate more electricity per steam generated by the TES system 2020. Here the steam exiting the turbine 2030 (at a lower pressure and temperature than in the non-condensing case) is directed to a condensing heat exchanger 2026 where at least a portion of the latent heat of condensation is captured as a low temperature energy source for the heat pump 2060. The increased amount of electricity generated by the condensing steam turbine 2030 in the system may be used to power at least a portion of the continuous electricity demand of the heat pump 2060.

Although not pictured in the diagrams, there may be a fluid pump in between the heat pump 2060 and the thermal energy storage system 2020 such that the pressure of the heated fluid in the heat pump is lower than when it is in the thermal energy storage system. In one implementations, heat pumps generally operate below 10 bar. For example, if the thermal load desires higher pressure steam, the heat pump can add heat to water at one pressure before being pumped and directed to the thermal energy storage system to generate steam at an elevated pressure and temperature.

The efficiency benefits of a heat pump capturing otherwise useless energy streams are combined with the benefits of high efficiency, low cost storage. In such an implementations, one advantage is the ability to have a continuously discharging TES system that can potentially be used in tri-generation application (power generation, heating, and cooling).

Ejector to Boost Heat Pump

As previously mentioned, heat pumps have a known limitations to operating temperature tied to the thermodynamic properties of the refrigerants used. In addition, generally the performance (COP) of heat pumps decline as operating temperatures are increased relative to the low temperature of the heat source. Depending on the type of heat pump, there may be a limitation on operating pressure as well. Several commercially available heat pumps do not operate above 8-10 bar.

Figure 21:
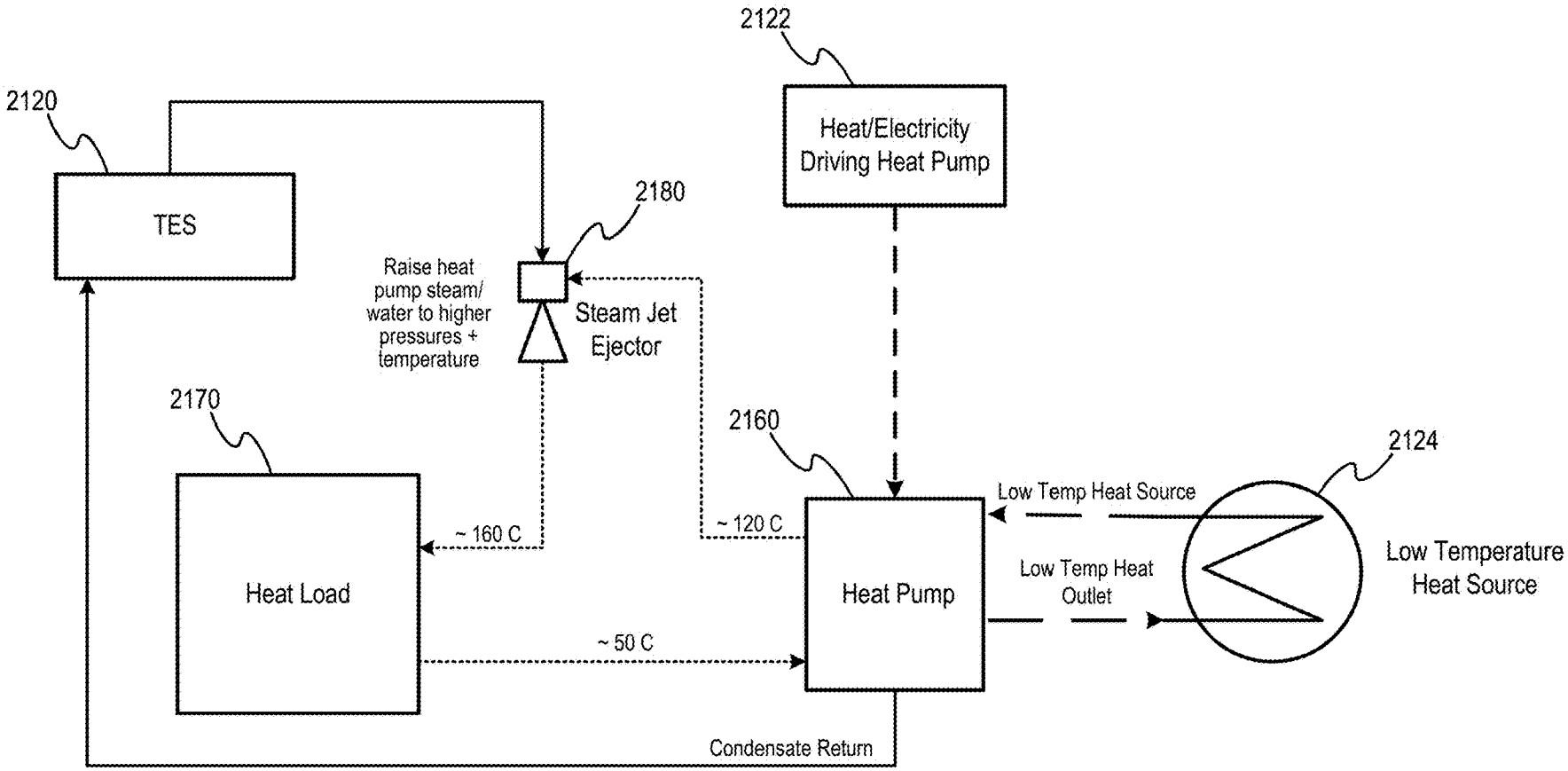
FIG. 21 illustrates a schematic diagram of a TES system with a steam jet ejector and a heat pump according to the example implementations.
Figure 22:
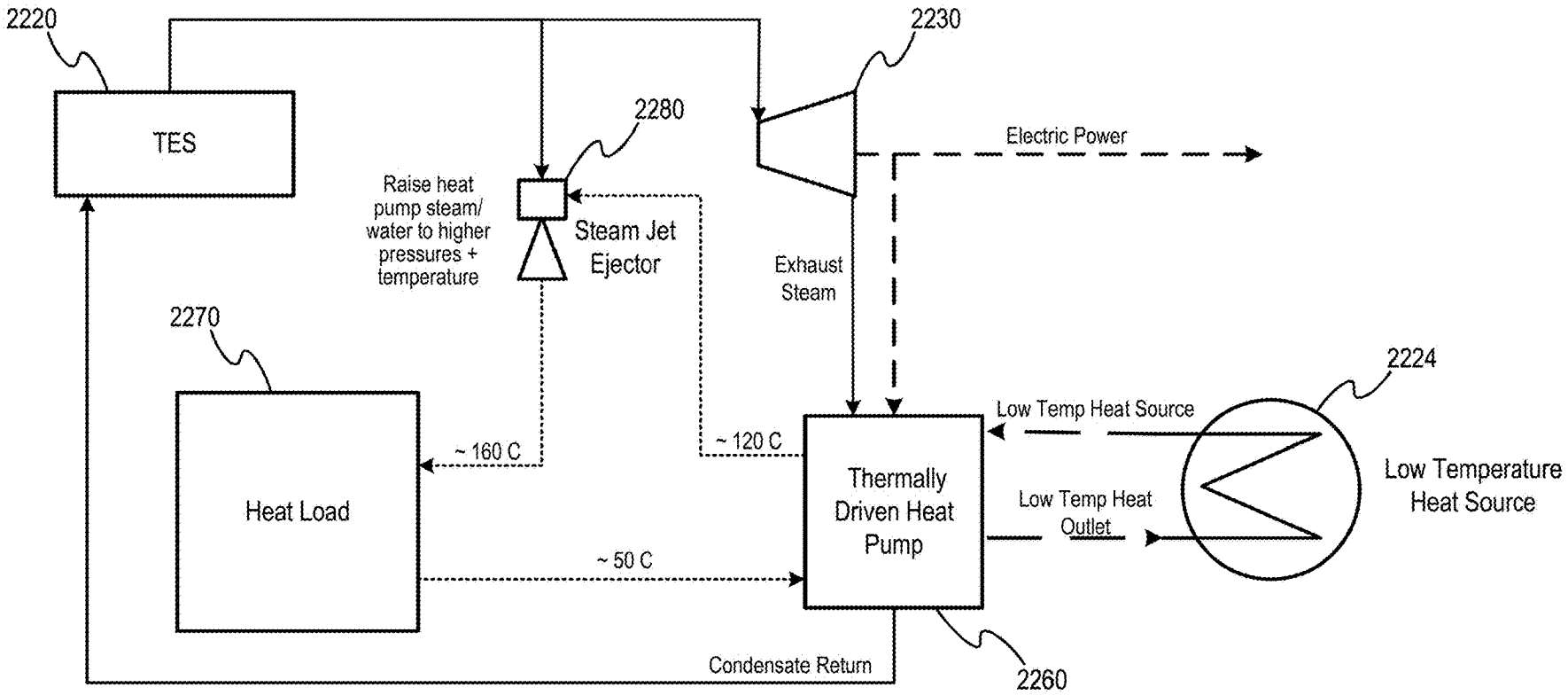
FIG. 22 illustrates a schematic diagram of a TES system with a steam jet ejector, turbine, and a heat pump according to the example implementations.
Figure 23:
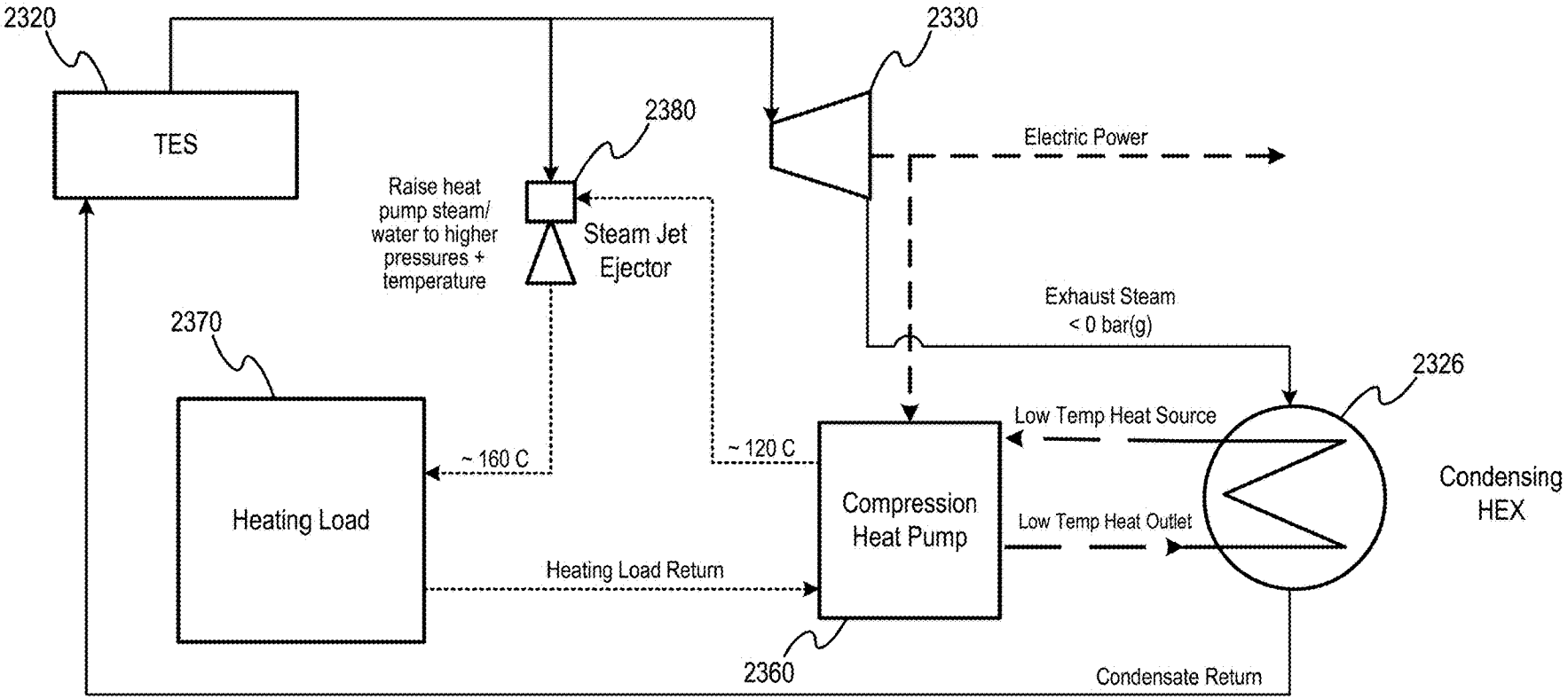
FIG. 23 illustrates a schematic diagram of a TES system with a steam jet ejector, turbine, and a compression heat pump according to the example implementations.

Referring now to FIGS. 21 to 23, one or more of these embodiments address this problem by using one or more ejectors or other suitable flow combiners. An ejector, or thermocompressor, is a form of thermally activated jet-pump that is generally used for pumping gases from systems to produce vacuum or compressing vapors. They are simple components with no moving parts and hence are known for their simplicity and low cost. The basic principle of operation is the same for all supersonic ejectors. It desires a high pressure, high temperature motive fluid that is expanded through a primary nozzle where pressure and temperature are converted to a very large increase in velocity. At the primary nozzle exit, velocity is high enough such that the flow is supersonic with low temperature and pressure. This creates a vacuum that is able to entrain a low energy flow steam (of lower pressure and temperature of the flow entering the primary nozzle) through a secondary nozzle. In the secondary nozzle, with combined flow from the high energy and low energy flows, sonic conditions are reached. The combined streams then enter a mixing chamber where the streams mix to produce a medium energy flow of pressure and temperature in between those of the high and low energy flows. In the mixing chamber, the flow becomes subsonic due to frictional losses and shocks in the mixing chamber. The flow leaving the mixing chamber enters a diffuser where it is further compressed to a medium pressure. The only losses in an ejector are kinetic losses from mixing and radiative losses to the environment which are generally small.

In the embodiment of FIG. 21, the heat pump 2160 produces its high temperature energy flow using a low temperature heat source 2124 and electricity (if a compression heat pump) or higher-pressure steam (for thermally driven heat pumps) from energy stored in TES 2120. The heat pump 2160 may produce hot fluid at T1 and P1. The hot fluid is then entrained in an ejector 2180 using motive (high energy flow) as high pressure (P2) and temperature (T2) fluid generated by the TES system such that $P2 \gg P1$ and $T2 > T1$. The two flows mix such that a combined medium energy flow is produced with medium pressure (P3) and temperature (T3). The produced stream is such that $P1 < P3 < P2$ and $T1 < T3 < T2$. The combined stream can then be directed to fulfill a thermal load requiring P3 and T3 conditions. The ejector 2180 enables high efficiency heat transfer and cost-effective pressure boosting to the high temperature stream produced by the heat pump 2160 and energy from the TES 2120 for use by heat load 2170.

FIG. 22 shows that, like other embodiments mentioned herein, a turbine 2230 may be integrated into the heat pump 2260, ejector 2280, and TES system 2220. Electricity or work generated can be used to power pumps or compressors in the heat pump 2260 or be exported to another use. The heat pump 2260 may be in fluid communication with a low temperature heat source 2224. A thermocompressor such as ejector 2280 can combine the flows from the TES 2220 and the heat pump 2260 to direct the combined flow the heat load 2270.

FIG. 23 shows that the turbine 2330 exit steam may be directed to a condensing heat exchanger 2326 where condenser heat is captured by the heat pump 2360 and/or can be extracted at a pressure higher than ambient and used as driving steam for a thermally driven heat pump 3260. The combined flow from thermocompressor such as ejector 2380 are directed to the heat load 2370.

One alternative to boosting the temperature and pressure of a heat pump's output are steam compressors. These mechanically compress steam to higher pressures and temperatures. These systems have a lot of moving parts, use a large amount of continuous electricity to run, take up a relatively large amount of space, and are expensive. Jet ejectors have no moving parts, require no electricity to operate, take up very little space, and are relatively inexpensive. Historically, a disadvantage of steam jet ejectors/thermocompression is that it requires high pressure steam. In the past, this was very valuable, high-quality steam produced by burning fossil fuels. However, the TES can be arranged such that it can deliver its thermal output at any pressure and the unused heat can be captured at a high efficiency in the process and recirculated to the process. The ejector may also be better suited for applications desiring a pressure boost at higher temperatures.

This implementation is typically used when a pressure boost is desired, and the output of the heat pump is steam where compressors may be uneconomic to run. If the heat pump is producing hot water instead of steam, mechanical pumps operate well and can be used and directed to the TES system for further heating at a higher pressure. Jet ejectors can still be used with hot water. Mechanical compressors have a much harder time with compressing gases (steam).

FIGS. 24-34 show still further implementations using a thermal energy storage system and a heat pump system. Note that specific values for temperature, pressure, and power flows used in FIGS. 24-34 are purely representative and the implementations can apply to a wide range of operating conditions.

Figure 24:
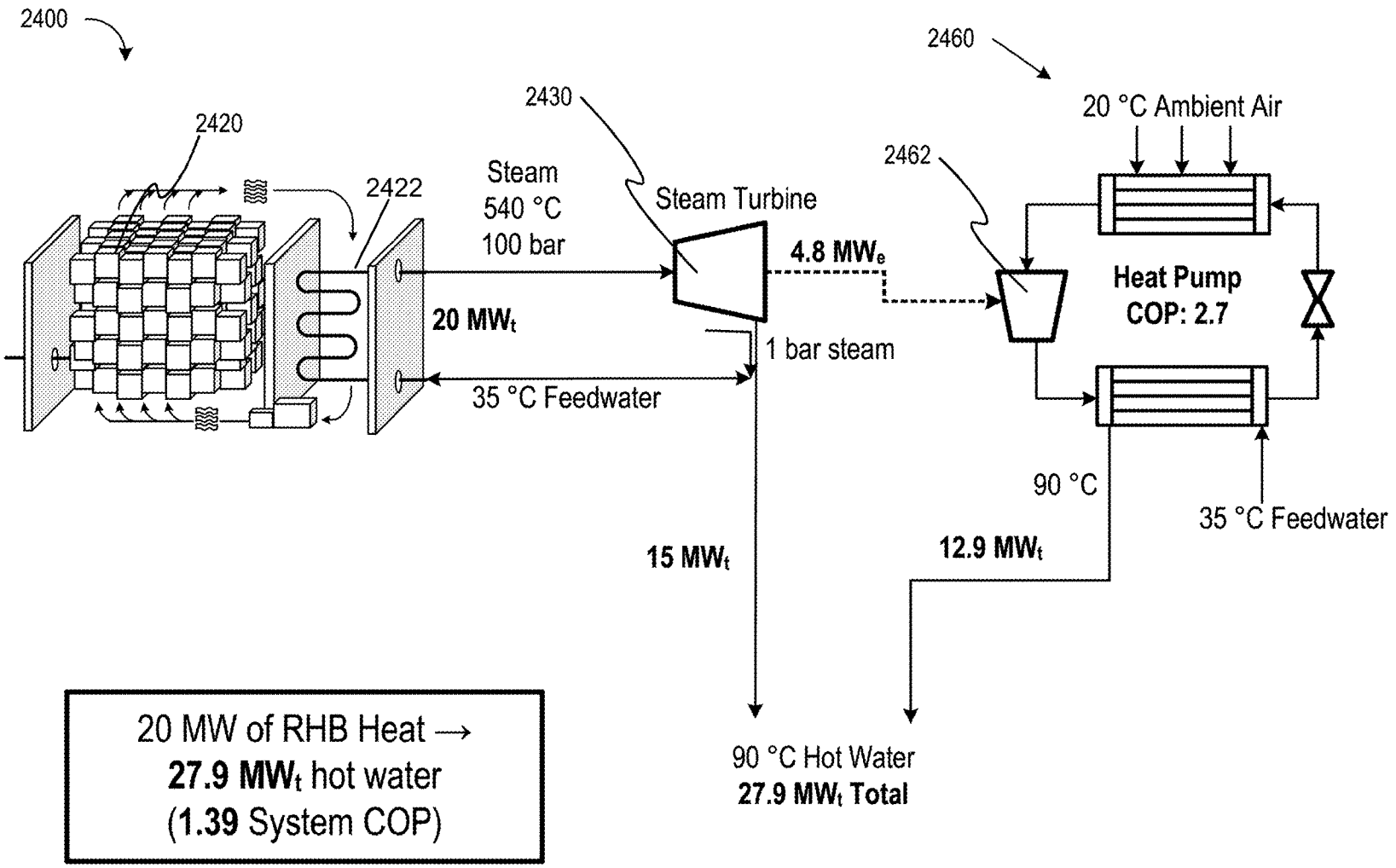
FIG. 24 illustrates a schematic diagram of a TES system where the thermal output of a turbine and a heat pump are combined according to the example implementations.

FIG. 24 shows one implementation of a thermal energy system 2400 that provides high pressure superheated steam to a steam turbine 2430 where steam is expanded to near atmospheric temperature to generate power such as electricity. The outlet steam is attemperated to 90° C. hot water. The turbine 2430 powers a compressor 2462 of a heat pump 2460 to generate more 90° C. hot water. This integration can deliver low grade heat at a COP>1 entirely powered by the TES 2420 and the environment. This implementation is a low temperature water application that uses a TES-CHP combination to provide electricity to the heat pump 2460 with a hot water outlet.

FIG. 24 also shows that the TES 2420 may have a heat exchanger 2422 integrated with the TES for heating a fluid to create steam for the turbine 2430. This heat exchanger 2442 may be integrated with the TES or it may be separate and/or downstream from the TES 2420. It should be understood that for any of the implementations herein, the heat exchanger may be integrated with the TES or it can be a separate stand-alone heat exchanger. In some implementations, the TES 2420 outputs hot air or thermal energy and the steam generating portion is not part of the TES but is instead a stand-alone unit. Optionally, the output temperature of the TES 2420 is at least about 250° C. Optionally, the output temperature of the TES 2420 is at least about 300° C. Optionally, the output temperature of the TES 2420 is at least about 400° C. Optionally, the output temperature of the TES 2420 is at least about 500° C. Optionally, the output temperature of the TES 2420 is at least about 600° C. Optionally, the output temperature of the TES 2420 is at least about 700° C. Optionally, the output temperature of the TES 2420 is at least about 800° C.

Figure 25:
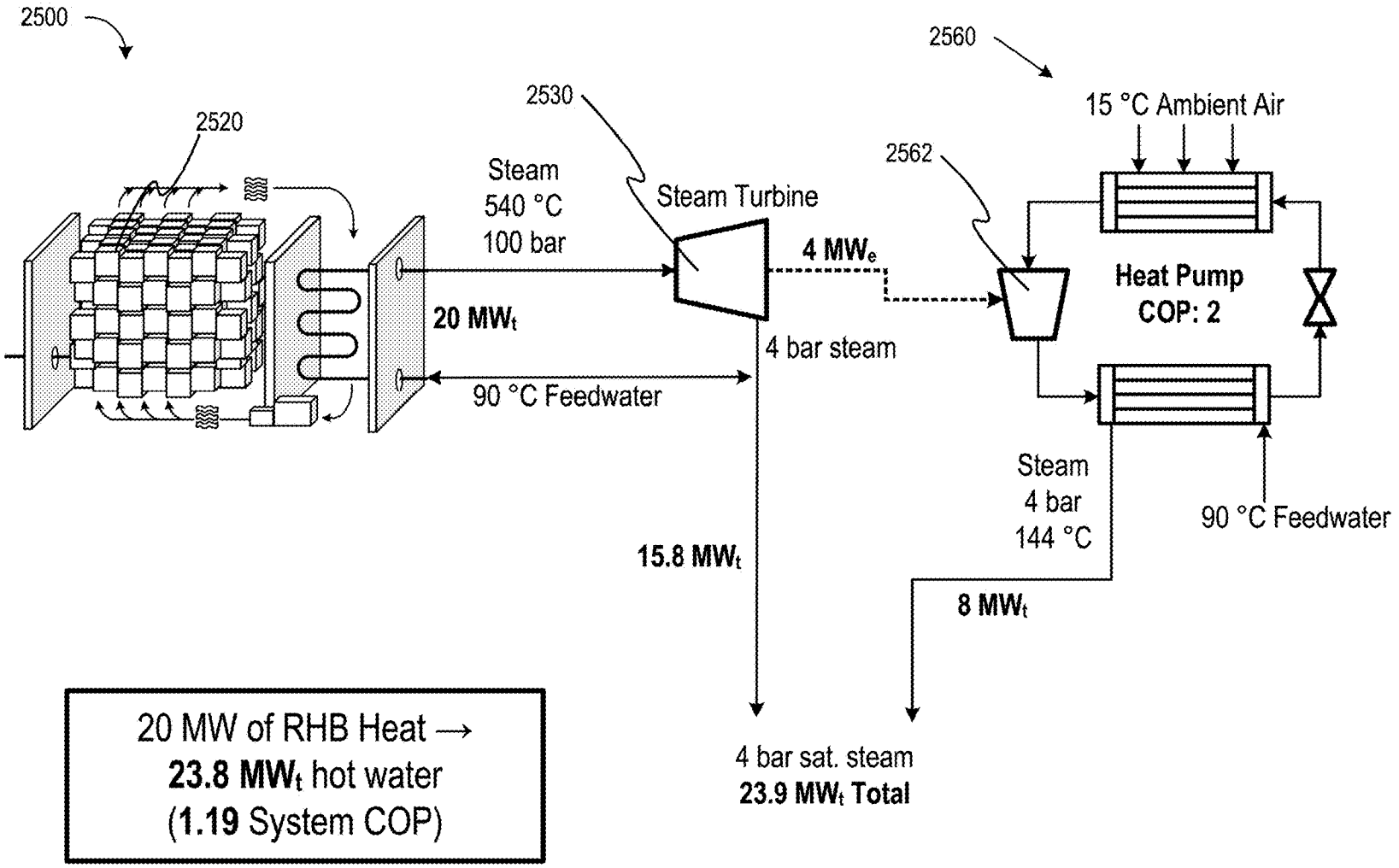
FIG. 25 illustrates a schematic diagram of a TES system where the thermal output of a turbine and a heat pump are combined according to the example implementations.

FIG. 25 shows one implementation of a thermal energy system 2500 that provides high pressure superheated steam to a steam turbine 2530 where steam is expanded to near atmospheric temperature to generate power. The outlet steam is attemperated to 4 bar saturated steam. The turbine 2530 powers a compressor 2562 of a heat pump 2560 to generate additional 4 bar steam. This integration can deliver low grade heat at a COP>1 entirely powered by the TES 2520 and the environment. This implementation is a high temperature steam application that uses a TES-CHP providing electricity to the heat pump (steam outlet).

Figure 26:
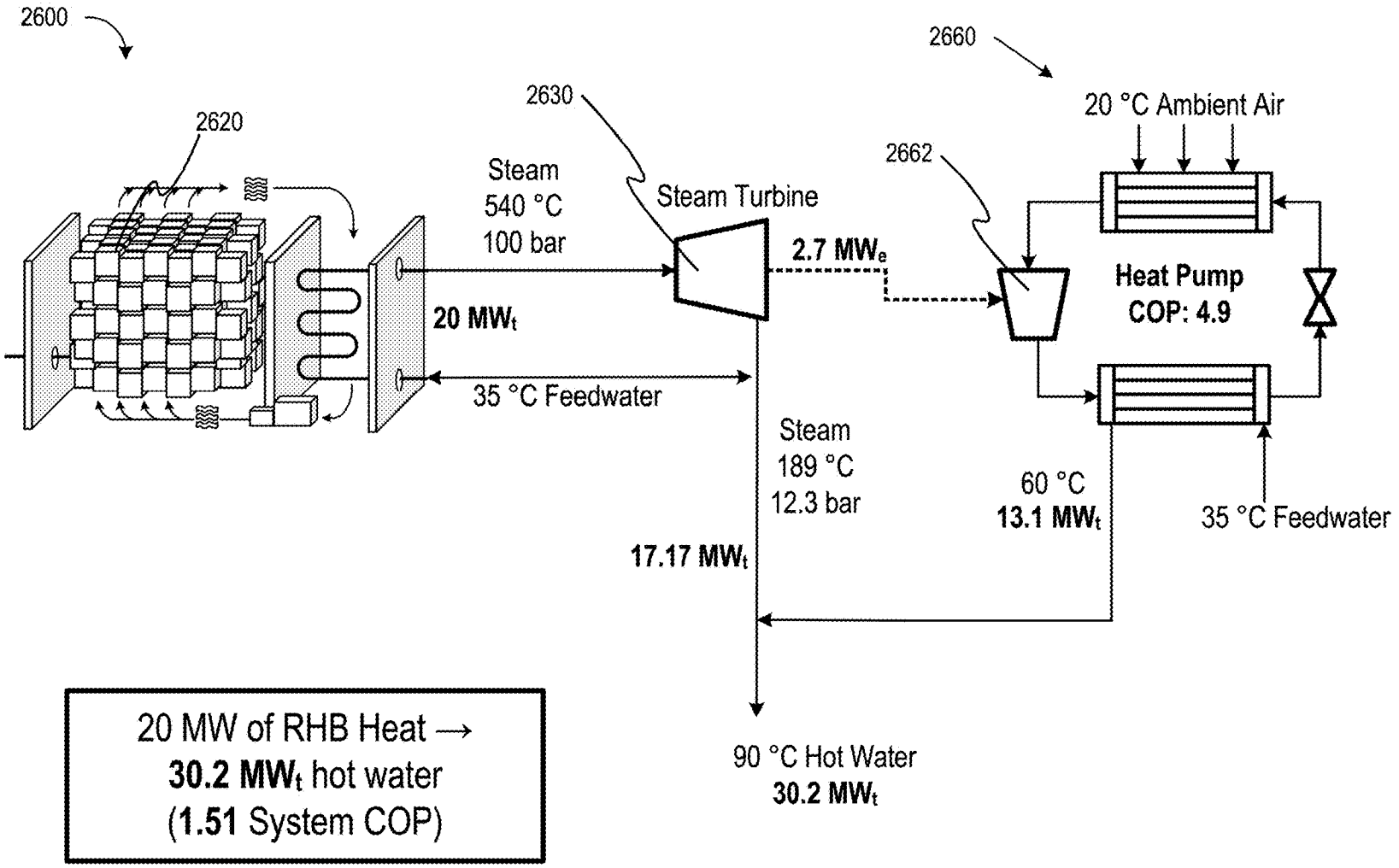
FIG. 26 illustrates a schematic diagram of a TES system where the thermal output of a turbine and a heat pump are combined according to the example implementations.

FIG. 26 shows one implementation of a thermal energy system 2600 that provides high pressure superheated steam to a steam turbine 2630 where steam is expanded to ~12 bar to generate power. The outlet steam is attemperated to saturated steam. The turbine 2630 powers a compressor 2662 of a heat pump 2660 to generate 60° C. hot water. The 60° C. water is mixed with the turbine 2630 outlet steam to produce a combined flow of 90° C. water. This integration can deliver low grade heat at a COP>1 entirely powered by the TES 2620 and the environment. This implementation is a low temperature water application that uses a TES-CHP combination to provide electricity and heat to the heat pump 2660.

Figure 27:
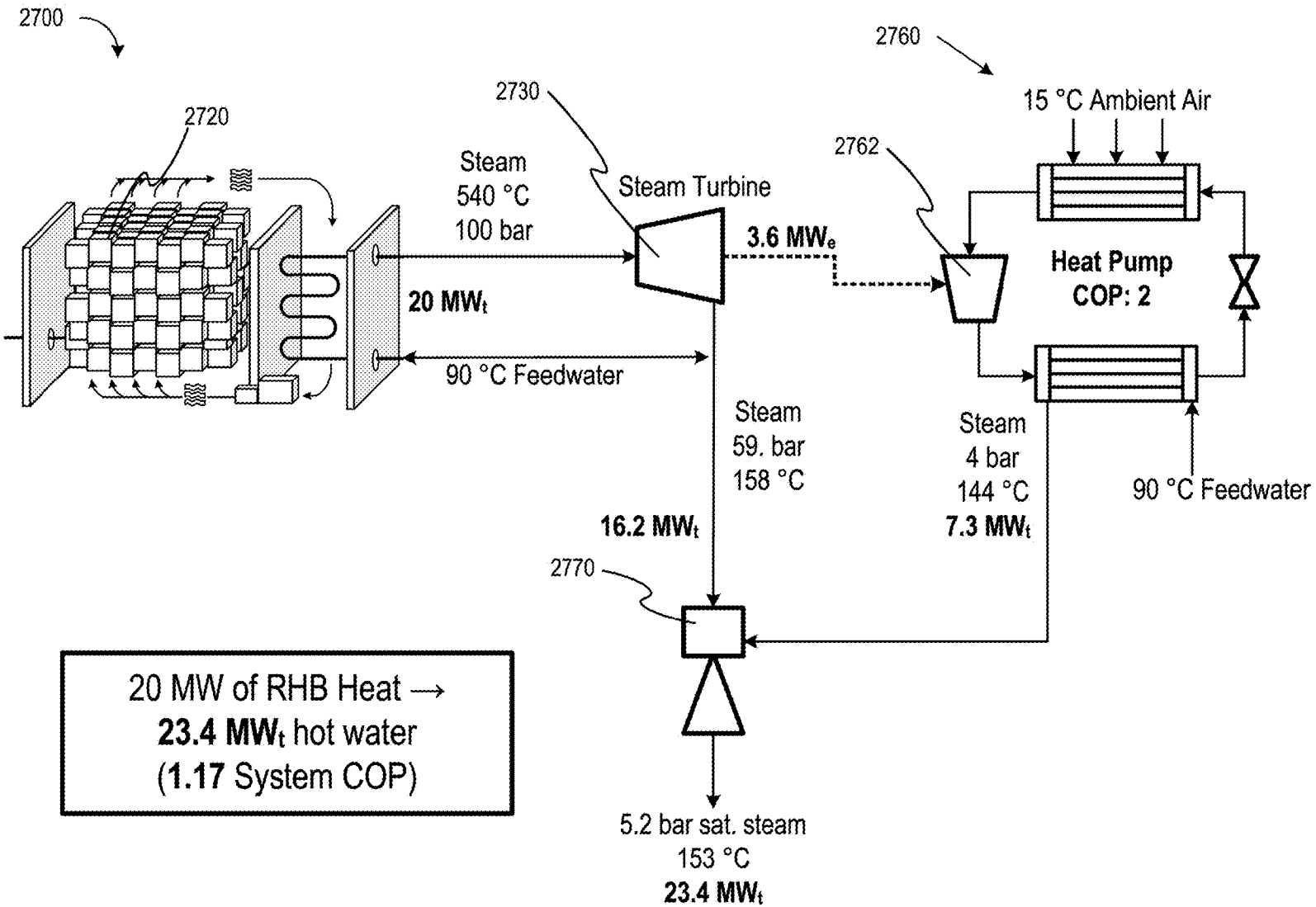
FIG. 27 illustrates a schematic diagram of a TES system where the thermal output of a turbine and a heat pump are combined in a steam jet compressor according to the example implementations.

FIG. 27 shows one implementation of a thermal energy system 2700 that provides high pressure superheated steam to a steam turbine 2730 where steam is expanded to ~6 bar to generate power. The outlet steam is attemperated to saturated steam. The turbine 2730 powers a compressor 2762 of a heat pump 2760 to generate 4 bar saturated steam. The 4 bar steam is mixed with the turbine 2730 outlet steam in a steam jet compressor 2770 to produce a combined steam flow of higher temperature and pressure than the heat pump outlet. This integration can deliver low grade heat at a COP>1 entirely powered by the TES 2720 and the environment. This implementation is a high temperature steam application that uses a TES-CHP combination to provide electricity and heat to heat pump 2760 with a steam outlet.

Figure 28:
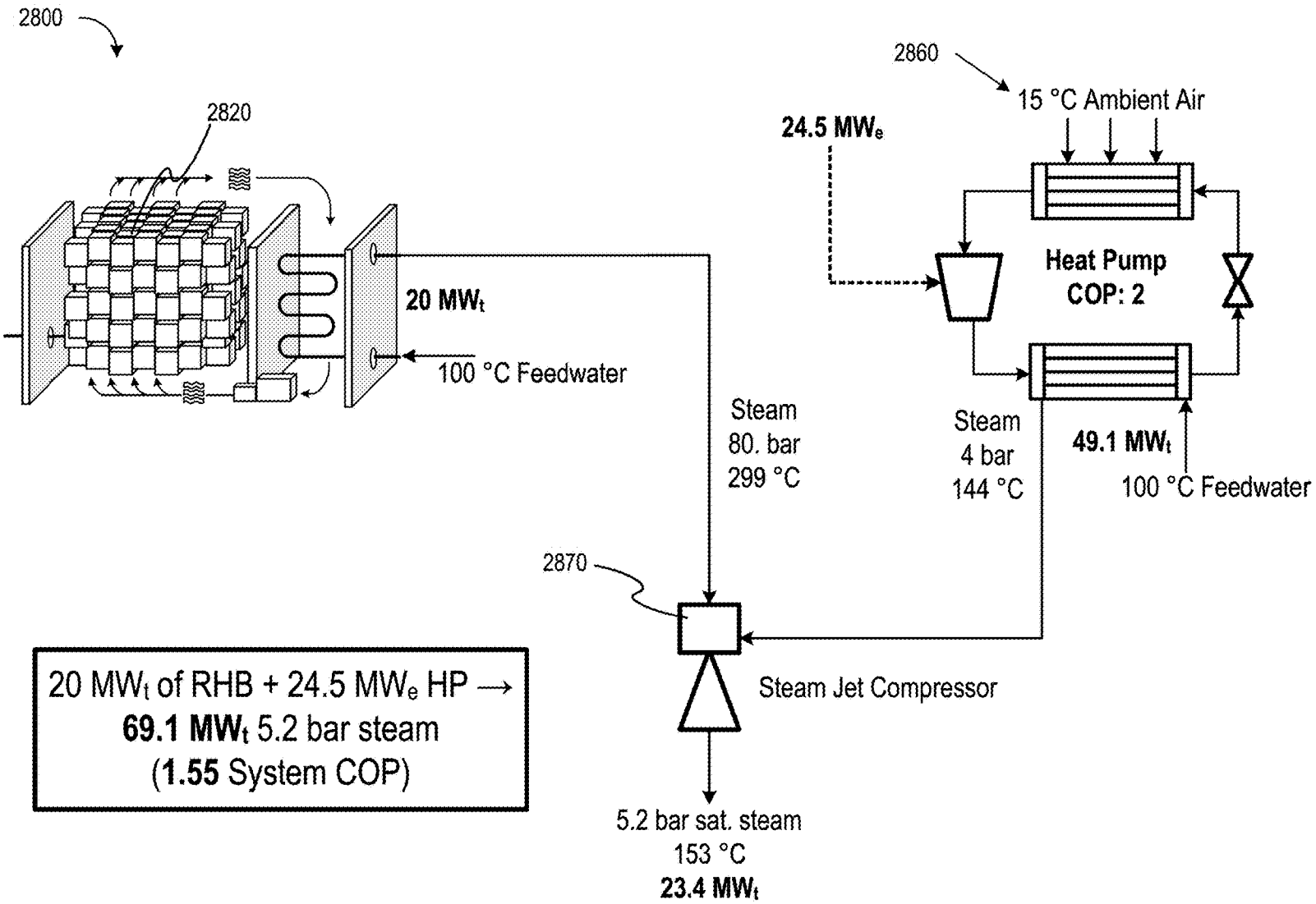
FIG. 28 illustrates a schematic diagram of a TES system where the thermal output of the TES and a heat pump are combined according to the example implementations.

FIG. 28 shows one implementation of a thermal energy system 2800 that provides high pressure steam heated by TES 2720 to a steam jet compressor 2870 where it entrains lower pressure steam produced by the heat pump 2860 to produce a combined steam flow of higher temperature and pressure than the heat pump outlet steam alone. This implementation is configured to deliver high pressure steam at a COP>1. This implementation is a high temperature steam application that uses a TES output that is thermocompressed with heat pump output steam. This is a less compression system with a higher system COP.

Figure 29:
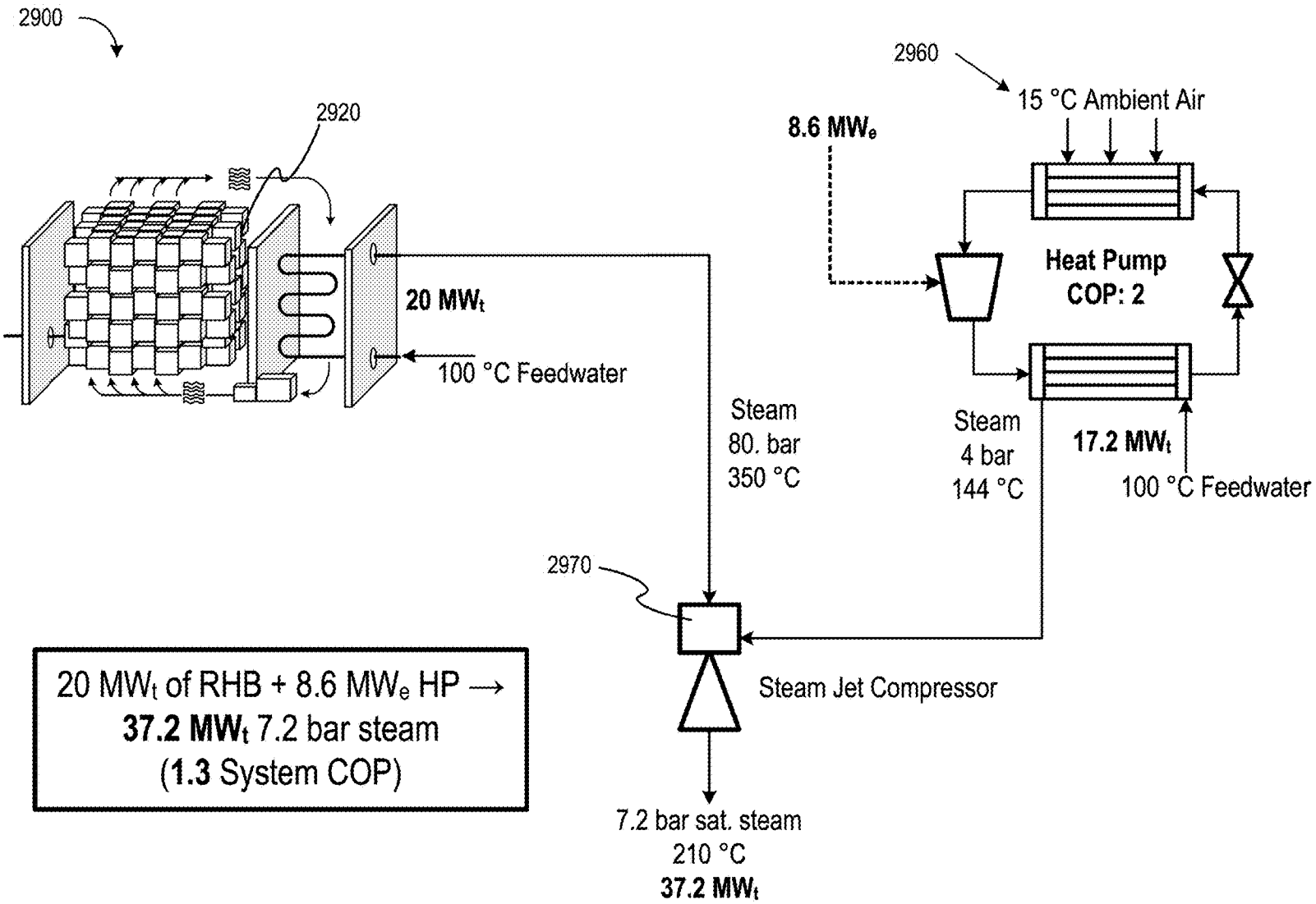
FIG. 29 illustrates a schematic diagram of a TES system where the thermal output of the TES and a heat pump are combined in a steam jet compressor according to the example implementations.

FIG. 29 shows one implementation of a thermal energy system 2900 that provides high pressure steam to a steam jet compressor 2970 where it entrains lower pressure steam produced by the heat pump 2960 to produce a combined steam flow of higher temperature and pressure than the heat pump 2960 outlet steam alone. This implementation is configured to deliver high pressure steam at a COP>1. This implementation is a high temperature steam application that uses a TES output that is thermocompressed heat pump steam. This is a more compression system with lower system COP.

Figure 30:
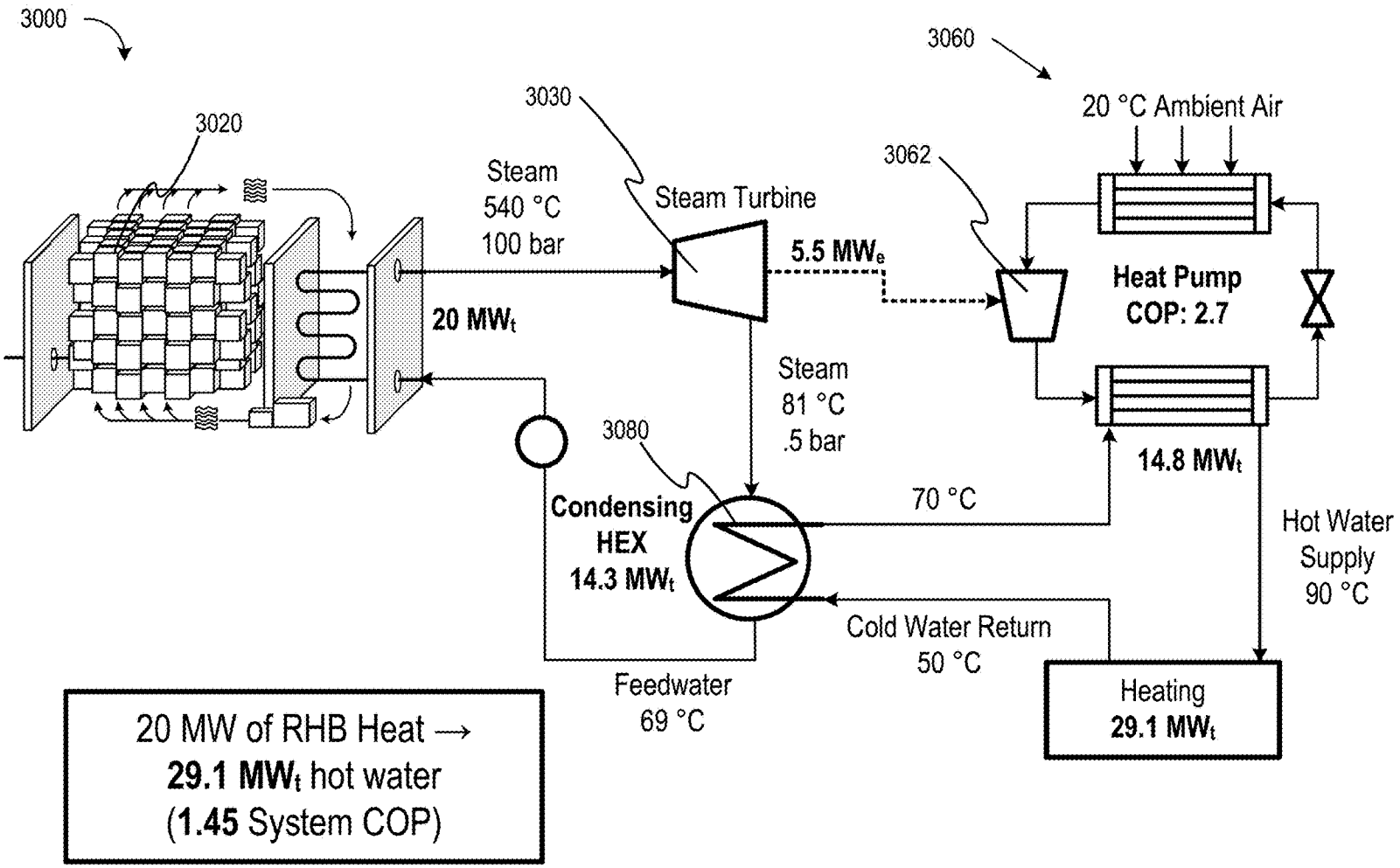
FIG. 30 illustrates a schematic diagram of a TES system including a turbine, a heat pump, and a condensing heat exchanger according to the example implementations.

FIG. 30 shows one implementation of a thermal energy system 3000 that provides high pressure superheated steam to a steam turbine 3030 where steam is expanded to sub atmospheric pressures to generate power to run a compressor 3062 of a heat pump 3060 such as an air source heat pump. The outlet steam is condensed by transferring energy to the cold water return of a district energy system. This heat exchanger (HEX) 3080 serves as heat rejection for the Rankine Cycle and preheats the district heating water before the heat pump 3060. This implementation is configured to deliver low grade heat at a COP>1 entirely powered by the TES and the environment. This implementation is a low temperature water application that uses a TES-CHP to provide electricity and heat to a heat pump 3060.

Figure 31:
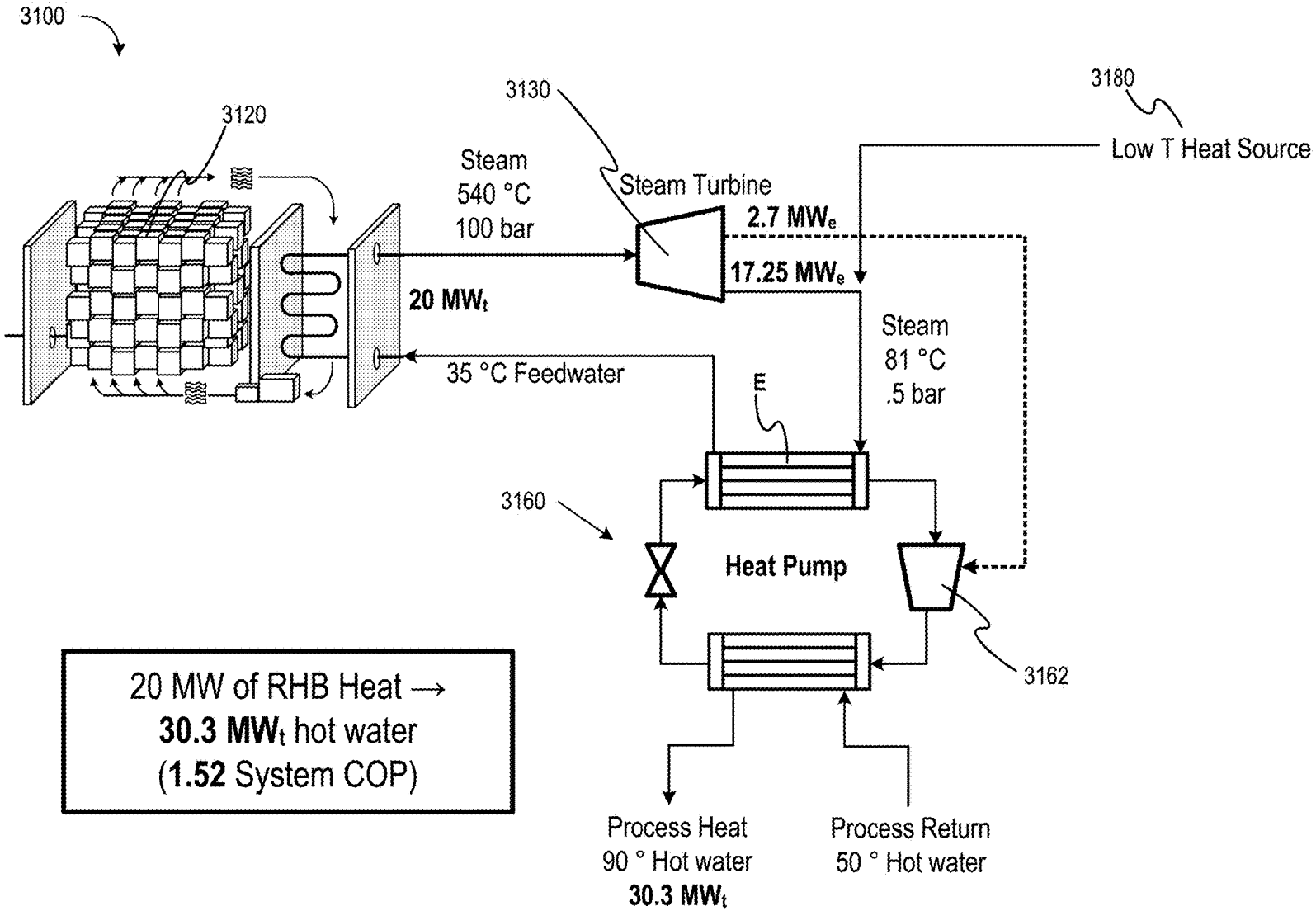
FIG. 31 illustrates a schematic diagram of a TES system including a turbine, a heat pump, and a low temperature heat source according to the example implementations.

FIG. 31 shows one implementation of a thermal energy system 3100 that provides both steam and electricity to a heat pump system 3160. In this implementation, the thermal energy storage system 3120 provides steam to a steam turbine 3130 which provides power to a heat pump compressor 3162. Additionally, the steam turbine 3130 also provides waste heat to the heat pump system 3160 such that it increases the temperature of the existing low-temperature heat source 3180 used by the heat pump. If the TES 3120 and steam turbine 3130 were not integrated into the heat pump system, the heat pump 3160 would operate with the existing low-temperature heat source. By increasing the temperature of the low-temperature heat source 3180, the heat pump COP is increased and otherwise waste energy from the Rankine cycle is utilized such that the condenser for the Rankine Cycle is at least partially acting as the evaporator for the heat pump. This implementation is configured to deliver low grade heat from a TES at a COP>1. This implementation uses a TES-CHP combination to provide electricity and heat to combine with a heat pump source.

Figure 32:
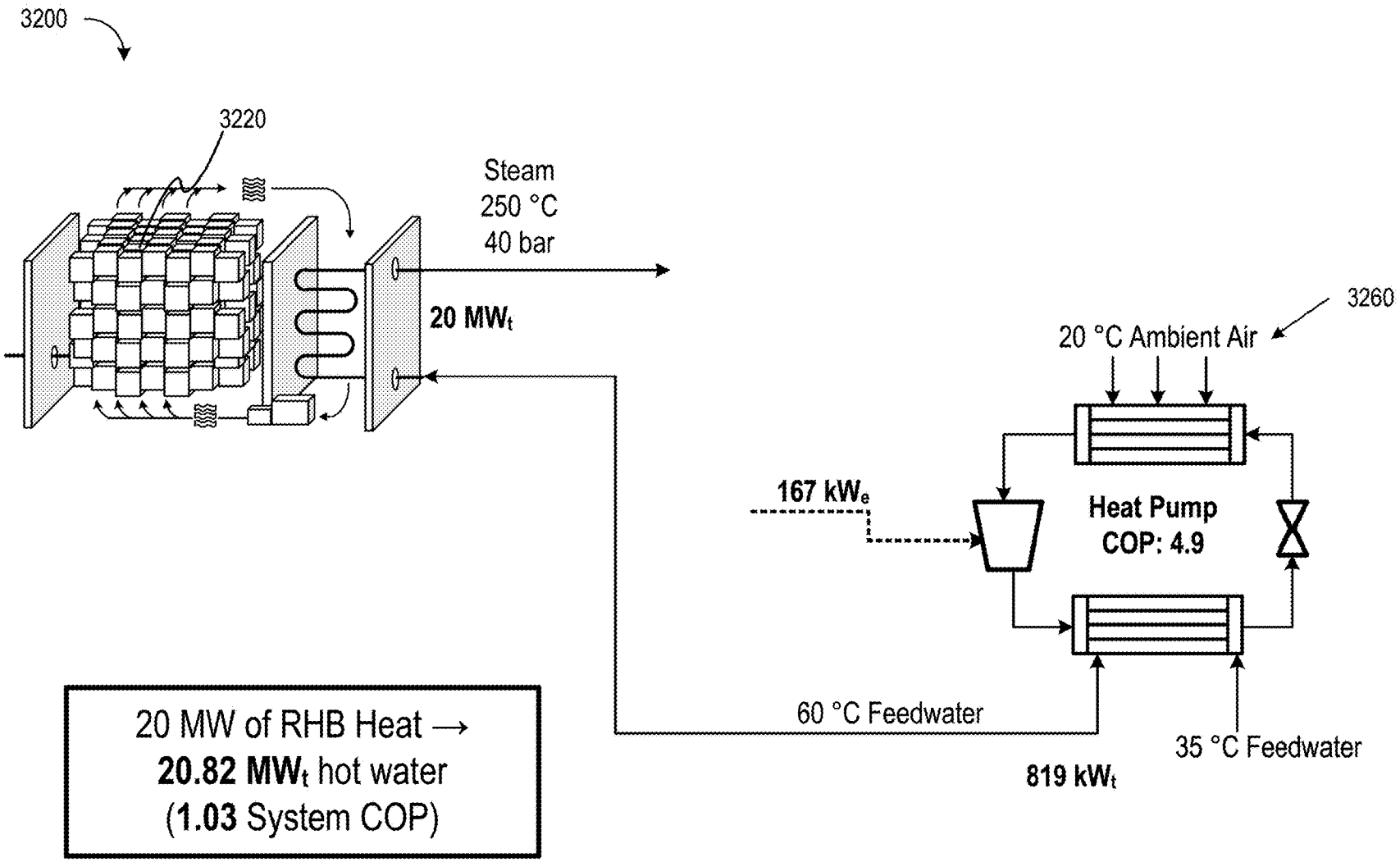
FIG. 32 illustrates a schematic diagram of a TES system where a heat pump is used to preheat feedwater for the TES according to the example implementations.
Figure 33:
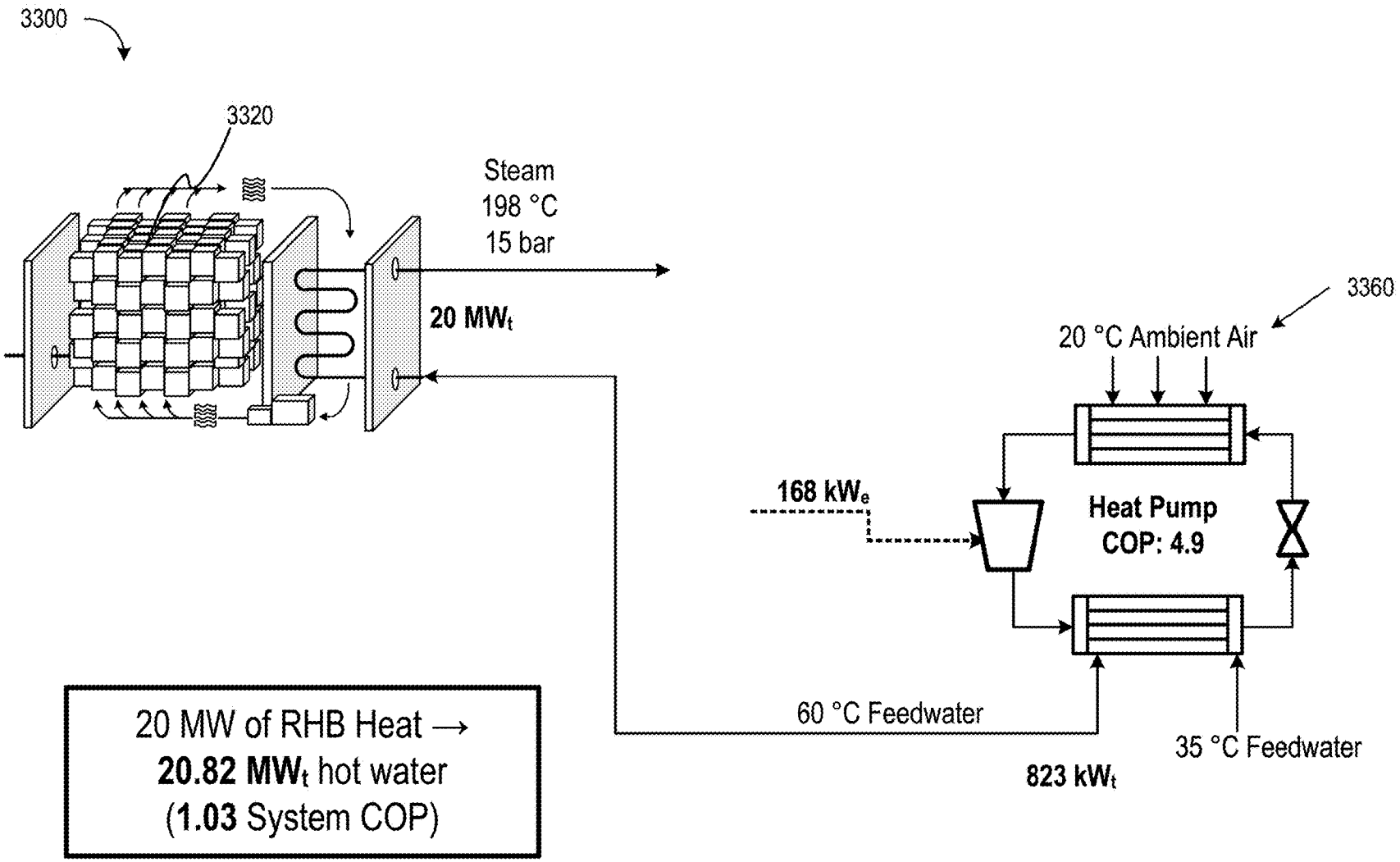
FIG. 33 illustrates a schematic diagram of a TES system where a heat pump is used to preheat feedwater for the TES according to the example implementations.

FIGS. 32 and 33 implement a heat pump system for preheating feed water for the TES steam generator.

FIG. 32 shows one implementation of a thermal energy system 3200 for use with a heat pump 3260 such as, but not limited to, an air source heat pump that heats that water to 60° C. at a high COP. The thermal energy storage system 3220 further heats the boiler feedwater to generate medium to high pressure steam. This implementation is configured to deliver high grade steam at COP>1 by using a heat pump to preheat feedwater for the TES 3229. This implementation is a high temperature steam application that uses a heat pump to preheat TES boiler feedwater.

FIG. 33 shows one implementation of a thermal energy storage system 3300 for use with a heat pump 3360 such as, but not limited to, a heat pump 3360 that heats water to 60° C. at a high COP. The thermal energy storage system 3360 further heats the boiler feedwater to generate medium to high pressure steam. This implementation is configured to deliver high grade steam at COP>1 by using a heat pump to preheat feedwater for the TES. This implementation is a high temperature steam application that uses the heat pump to preheat TES 3320 boiler feedwater.

Figure 34:
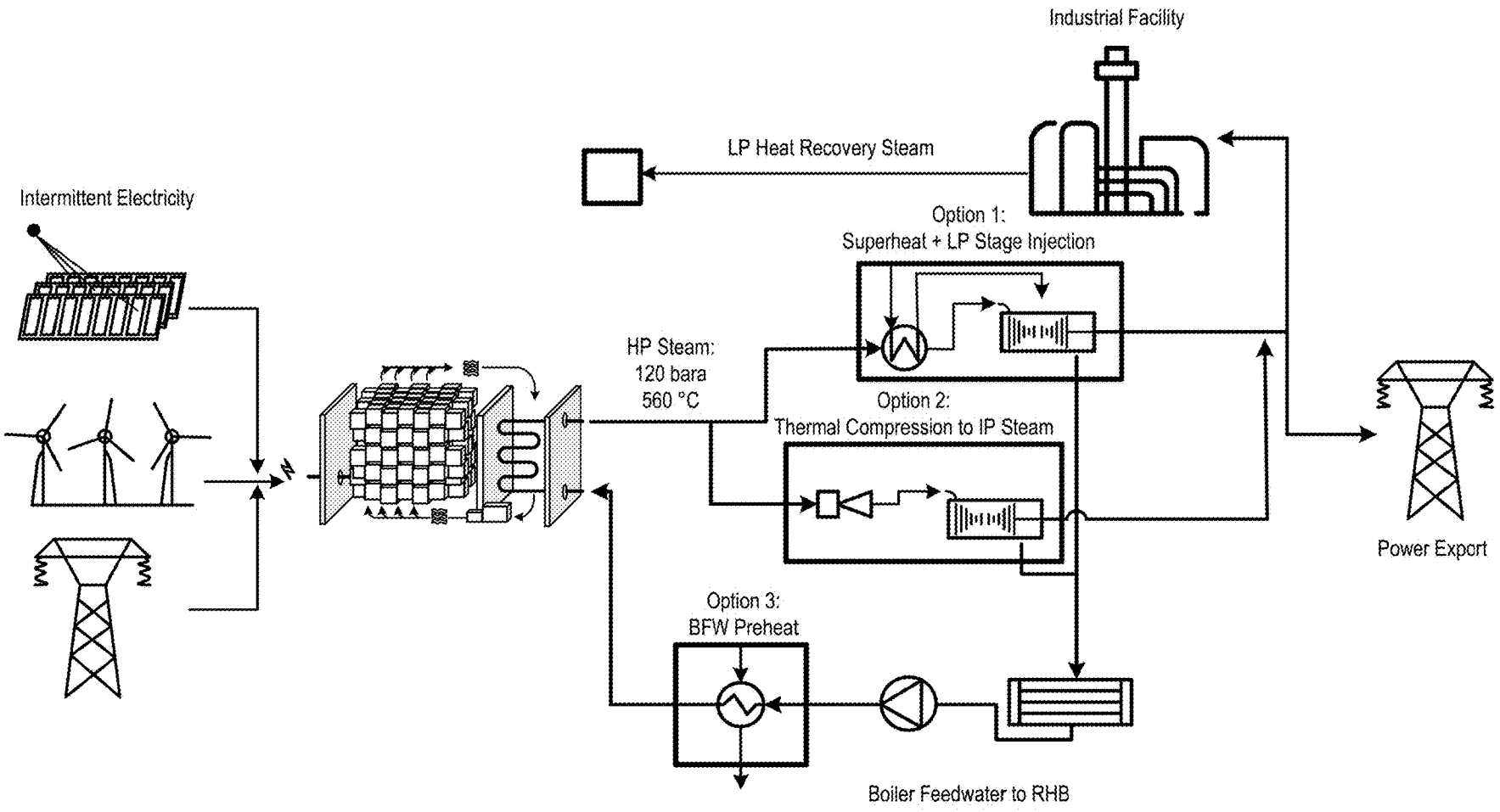
FIG. 34 illustrates a schematic diagram of a TES system according to the example implementations.

FIG. 34 shows one implementation of a thermal energy storage system that supplies high exergy steam to a Rankine cycle where waste heat is integrated to improve effective cycle efficiency. This implementation is configured to enable a higher efficiency conversion of waste heat to firm power. This implementation enables waste heat recovery.

In these implementations, the systems may all use electric heat pumps. These heat pump systems use electricity from a source such as a steam turbine, and then transform low-temperature heat into high-temperature heat. In at least some of these implementations, the electric heat pumps are completely powered by electricity distributed from a thermal energy storage system. Additionally, although some examples herein show that the heat pump may be an air source heat pump, these implementations are applicable to all types of suitable heat pumps. Generally, a heat pumps primary advantage is that it can provide heating at COPs of greater than 1 although they require continuous power for continuous heating. The primary advantage of thermal energy storage is that you can intermittently charge and store large amounts of energy and store for continuous use at a far lower cost than electrochemical alternatives. When the two technologies are integrated into a system, the system realizes the primary advantages of both: A system that can provide continuous heating and/or cooling at COPs greater than 1 from an intermittent energy supply.

Furthermore, these implementations may be configured to improve overall heat pump performance. Configurations 1A and 2A in FIGS. 24 and 26 are exemplary implementations. In Configuration 1A, the system has a 20° C. ambient air temperature inlet, and the heat pump has a 90° C. outlet. The temperature of the heat sink outlet (about 90° C.) and the temperature of the heat source inlet (about 20° C.) are the main drivers in the coefficient of performance (COP) of the heat pump. At the current conditions, this heat pump system that heats from about 20° C. to 90° C. might have a COP of 2.7. If this integration is configured such that the heat pump output is now delivering at only 60° C. with energy from the thermal energy storage system increasing up to the desired 90° C., this heat pump may be able to operate at a higher COP of 4.9, as an example. The COP is typically sensitive to changes in the heat pump system configuration. In this example, the system outlet temperature drops from 90° C. to 60° C., and the COP increased from 2.7 to 4.9. Optionally, the system can be configured to blend hotter steam from the steam turbine outlet to the 60° C. output, to ultimately deliver the 90° C. heat to the customer. A heat exchanger may also be used to indirectly heat the heat pump outlet to 90° C.

Some benefits of the implementations include providing systems powered entirely by intermittent electricity and using exhaust heat from the turbine to heat the heat pump outlet stream to benefit heat pump performance. Configuration 1B is similar to 1A, except that it uses a steam generating heat pump rather than water. Configuration 2B is similar to 2A, but adding a steam jet compressor to entrain the low-pressure steam, which provides increased pressure in addition to increased temperature. It should be understood that in some implementation, alternative technologies can be used in place of or in conjunction with a steam jet compressor. Some implementations may use one or more of the following: centrifugal compressors that use a spinning impeller to accelerate the gas, which then expands through a diffuser to increase pressure; axial flow compressors that use a spinning rotor to accelerate the gas, which then expands through a stator to increase pressure; or other suitable technology for combining thermal outputs.

Another benefit of these implementations is that the final output of the heat pump system does not place limitations on the maximum output temperature. Heat pump systems are typically temperature-limited based on the refrigerant being used in the heat pump. For example, a heat pump may have a maximum output temperature of 140° C. based on the type of refrigerant used. At least some implementations herein can achieve a higher outlet temperature than with the heat pump alone by processing the output with heat from the TES or steam from the steam turbine. For example, in configuration 2B, the system can output a higher temperature than the heat pump alone by combining with heat from the steam turbine and/or TES.

Configuration 3 affords a third benefit of providing increased temperature or pressure of the heat pump output. In this implementation, the heat pump system operates at its standard conditions. The system increases the pressure using a separate device. The system uses higher pressure steam from the TES system to achieve a higher degree of compression. In Configuration 3b, the 200° C. 7.2 bar steam is not achievable by existing commercial heat pump systems alone. The heat pump provides its standard output, and then the TES provides additional heat to achieve a desired output temperature and/or pressure.

FIG. 31 is an implementation using a TES 3120 to preheat the inlet water. FIG. 31 uses a water source rather than air, where there is an existing low-temperature heat source. In FIG. 31, the evaporator E at least partially acts as the condenser for the TES thermal power cycle but is also the evaporator E for the heat pump system 3160. The existing low-temperature heat source 3180 would combine with the flow to be condensed from the TES steam turbine 3130, such that the overall temperature introduced at the condenser for the TES power cycle/evaporator E for the heat pump is higher than it would be from the low temperature heat source alone. As a result, the heat pump operates at a higher coefficient of performance, and some of the power to run it would come from the steam turbine powered by the TES.

FIG. 30 shows a system that has a thermal power cycle condenser integrated into the heat pump, but instead of adding heat at the evaporator, the system preheats incoming feed water 3064 on the heat side of the heat pump 3060. This preheat can increase the output of the heat pump or decrease the size of the heat pump. This system captures heat that is otherwise lost in a pure Rankine cycle.

Summary of Claim Areas for Inventive Implementations

In one implementation, a system for providing cooling and power, including: a thermal energy storage (TES) device configured to charge intermittently from electrical energy; a combined heat and power (CHP) system configured to receive output thermal energy and electricity from stored energy from the TES; a thermally driven chiller configured to use the thermal energy to provide cooling; and a heat rejection system configured to reject heat from the chiller.

The system may include one or more of the following features. Optionally, the heat rejection system includes a cooling tower. Optionally, the system further includes a heat load, wherein the heat rejection system is configured to send the rejected heat to the heat load. Optionally, the heat load includes a residential and/or commercial heating network. Optionally, the CHP system includes a high-pressure and high-temperature steam turbine configured to direct exhaust steam from the steam turbine to a heat input of the thermally driven chiller. It should be understood that high-pressure Optionally, the steam turbine includes a noncondensing steam turbine. Optionally, the CHP system includes a high-pressure and high-temperature gas turbine configured to direct exhaust gas from the steam turbine to a heat input of the thermally driven chiller heat input. Optionally, the CHP system is sized to provide an entire energy demand of the chiller, such that a cooling load is entirely powered by stored energy from the TES. Optionally, the CHP system is sized to provide at least a majority of energy demand of the chiller, such that a cooling load is substantially powered by stored energy from the TES. Optionally, the cooling load includes a data center. Optionally, the cooling load includes a district cooling network. Optionally, the cooling load includes a refrigeration system. Optionally, the CHP is configured to provide a portion of CHP turbine output as input to power auxiliary loads operably coupled to the chiller. Optionally, the system is configured to provide a portion of CHP turbine work as input to power mechanical or electrical auxiliary loads. Optionally, the system is configured to provide at least a portion of the CHP turbine power to one user of a cooling duty provided by the chiller. Optionally, the system is configured to export at least a portion of the CHP turbine power to a different user than a user of a cooling duty provided by the chiller. Optionally, the system is configured to export at least a portion of the CHP turbine power to an electrical grid.

In one implementation, a method is provided for cooling and power, including: intermittently, electrically charging a thermal energy storage (TES) device; using a combined heat and power (CHP) system to output thermal energy and electricity from the energy stored in the TES; using the thermal energy to provide cooling with a thermally driven chiller; and rejecting heat from the chiller using a heat rejection system.

The method may include one or more of the following features. Optionally, rejecting heat from the chiller includes rejecting heat to the environment with a cooling tower. Optionally, rejecting heat from the chiller includes sending heat to a heat load. Optionally, the heat load is a residential and/or commercial heating network. Optionally, generating thermal energy using the CHP system includes using a high pressure/temperature steam turbine with exhaust steam to chiller input heat. Optionally, generating thermal energy using the CHP system includes using a high pressure/temperature noncondensing steam turbine with exhaust steam to chiller input heat. Optionally, generating thermal energy using the CHP system includes using a high pressure/temperature gas turbine with exhaust gas to chiller heat input. Optionally, the method further includes sizing the TES/CHP system to provide an entire energy demand of the chiller, such that a cooling load is entirely powered by stored energy from the TES. Optionally, sizing the TES/CHP system to provide a majority of energy demand of the chiller, such that a cooling load is substantially powered by stored energy from the TES.

In one implementation, a system is provided for cooling, including: a thermal energy storage (TES) device configured to charge intermittently from electrical energy; a thermally driven chiller configured to use thermal energy from the TES device to provide cooling; and. a heat rejection system configured to reject heat from the chiller.

The system may include one or more of the following features. Optionally, the heat rejection system includes a cooling tower. Optionally, the heat rejection system is configured to send the heat to a heat load. Optionally, the heat load includes a residential and/or commercial heating network. Optionally, the TES device is sized to provide an entire energy demand of the chiller, such that a cooling load is entirely powered by energy stored in the TES from intermittent electricity. Optionally, the TES device is sized to provide at least a majority of an energy demand of the chiller, such that a cooling load is substantially powered energy stored in the TES from intermittent electricity. Optionally, the cooling load includes a data center. Optionally, the cooling load includes a district cooling network. Optionally, the cooling load includes a refrigeration system.

In one implementation, a method is provided for cooling, including: intermittently electrically charging a thermal energy storage (TES) device; using thermal energy from the TES device to provide cooling with a thermally driven chiller; and rejecting heat from the chiller using a heat rejection system.

The method may include one or more of the following features. Optionally, rejecting heat from the chiller includes rejecting heat to the environment with a cooling tower. Optionally, rejecting heat from the chiller includes sending heat to a heat load. Optionally, rejecting heat from the chiller includes sending heat to a heat load, which includes a residential and/or commercial heating network. Optionally, sizing the TES device to provide an entire energy demand of the chiller, such that the cooling load is entirely powered by stored energy from the TES. Optionally, cooling a data center with cooling from the chiller. Optionally, cooling a district cooling network with cooling from the chiller. Optionally, cooling a refrigeration system with cooling from the chiller.

In one implementation, a system is provided for heating and power, including: a thermal energy storage (TES) device configured to be intermittently heated by electricity to store thermal energy; a combined heat and power (CHP) system configured to use thermal energy from the TES device to generate high temperature heat; and a thermally driven heat pump configured to use the high temperature heat from the CHP system to provide heating.

The system may include one or more of the following features. Optionally, the heat pump has a low temperature heat source that is at least in part from the environment. Optionally, the heat pump has a low temperature heat source that is at least in part from waste heat of an adjacent industrial process. Optionally, the heat pump has a low temperature heat source that is at least in part from waste heat of an adjacent cooling process, and the adjacent process is a data center cooling system. Optionally, the CHP system is configured to direct high pressure/temperature steam to a noncondensing steam turbine with exhaust steam directed to a heat pump heat input. Optionally, the CHP system is configured to direct high pressure/temperature steam to an extraction condensing steam turbine such that a first portion of high temperature steam is extracted from the steam turbine at within a desired range of temperature and pressure. Optionally, the Rankine Cycle condenser is configured to utilize at least a portion of the reject heat as low temperature heat input to the heat pump system.

In one implementation, a method is provided for heating and power, including: intermittently using electricity to heat a thermal energy storage (TES) device; using thermal energy from the TES device to generate high temperature heat with a combined heat and power (CHP) system; and using the high temperature heat from the CHP system to provide heating with a thermally driven heat pump.

The method may include one or more of the following features. Optionally, the high temperature heat is at least about 250° C. or higher. Optionally, the high temperature heat is at least about 500° C. or higher. Optionally, using the high temperature heat from the CHP system includes using exhaust gas from a gas turbine as input to the heat pump. Optionally, using the high temperature heat from the CHP system includes extracting steam from an extraction condensing steam turbine at necessary temperature and pressure. Optionally, utilizing at least a portion of the reject heat as low temperature heat input to the heat pump system. Optionally, utilizing at least a portion of the reject heat as feedwater preheating to the heat pump system. Optionally, using the high temperature heat from the CHP system includes using exhaust steam from a noncondensing steam turbine as input to the heat pump. Optionally, the method includes providing heating and power to an adjacent industrial process. Optionally, using a thermocompressor to receive high-temperature fluid from the TES device and low-pressure output from the heat pump, and producing a combined output at a second temperature and pressure.

In one implementation, a system is provided for heating and/or cooling, including: a thermal energy storage (TES) device configured to charge intermittently from electrical energy; a Rankine Cycle power generation system configured to generate electricity from the TES device; and. an electrically driven heat pump configured to use the electricity generated by the Rankine Cycle power generation system to provide heating or cooling.

The system may include one or more of the following features. Optionally, the heat pump is configured to provide both heating and cooling. Optionally, the TES power generation system is sized to provide full electrical demand for the heat pump. Optionally, the CHP system is configured to direct high pressure/temperature steam from the TES to a condensing steam turbine to generate electricity, and wherein heat rejection from the thermal power cycle provides a heat source for the heat pump. Optionally, thermal power cycle heat rejection is configured to utilize at least a portion of the reject heat as low temperature heat input to the heat pump system. Optionally, the primary purpose of the heat pump is to provide heating, and the thermal power cycle heat rejection is configured to utilize at least a portion of the reject heat as feedwater preheating to the heat pump system. Optionally, the TES and CHP system is configured to direct high pressure/temperature gas to a gas turbine with exhaust gas to heat pump heat input.

In one implementation, a method is provided for heating and/or cooling, including: intermittently electrically charging a thermal energy storage (TES) device; generating electricity from the TES device using a Rankine Cycle power generation system; and using the generated electricity to power an electrically driven heat pump to provide heating or cooling.

The method may include one or more of the following features. Optionally, the heat pump is configured to provide both heating and cooling. Optionally, the TES power generation system is sized to provide full electrical demand for the heat pump. Optionally, generating electricity from the TES device includes using high pressure/temperature steam in a condensing steam turbine to generate electricity, and integrating heat rejection of the thermal power cycle to serve as a heat source for the heat pump. Optionally, the primary purpose of the heat pump is to provide heating, and the method includes utilizing at least portion. Optionally, using a thermocompressor to receive high-temperature fluid from the TES device and low-pressure output from the heat pump, and producing a combined output at a second temperature and pressure.

In one implementation, a system is provided for boosting heat pump output, including: a thermal energy storage (TES) device configured to be heated intermittently by electricity; an electrically driven heat pump configured to provide output heat at a first temperature and pressure; and a thermocompressor configured to receive high-temperature fluid from the TES device and low-pressure output from the heat pump, and configured to produce a combined output at a second temperature and pressure.

The system may include one or more of the following features. Optionally, the heat pump is configured to provide output heat at a first temperature T1 and a first pressure P1, and the thermocompressor is configured to boost the output to a second temperature T2 and a second pressure P2. Optionally, the TES device provides high-temperature fluid at a third temperature T3 and a third pressure P3, and the thermocompressor is configured to entrain the low-pressure output of the heat pump with the high-pressure fluid from the TES device. Optionally, the heat pump has a first coefficient of performance (COP) that is greater than a second COP of a heat pump without the thermocompressor integration. Optionally, the thermocompressor is configured to boost the output of the heat pump to steam conditions that may not be achievable by the heat pump alone. Optionally, the TES device is configured to be charged intermittently with electrical energy, and the heat pump is configured to operate continuously or substantially continuously. Optionally, the TES device is configured to be charged intermittently with electrical energy, and the heat pump is configured to operate semi-continuously.

In one implementation, a method is provided for boosting heat pump output, including: intermittently electrically charging a thermal energy storage (TES) device; operating an electrically driven heat pump to provide output heat at a first temperature and pressure; and using a thermocompressor to receive high-temperature fluid from the TES device and low-pressure output from the heat pump, and producing a combined output at a second temperature and pressure.

The method may include one or more of the following features. Optionally, including operating the heat pump to provide output heat at a first temperature T1 and a first pressure P1, and using the thermocompressor to boost the output to a second temperature T2 and a second pressure P2. Optionally, using the TES device to provide high-temperature fluid at a third temperature T3 and a third pressure P3, and using the thermocompressor to entrain the low-pressure output of the heat pump with the high-pressure fluid from the TES device. Optionally, the heat pump has a coefficient of performance (COP) that is greater than a COP of a heat pump operating between the heat source and sink without a temperature boost from the thermocompressor. Optionally, using the thermocompressor to boost the output of the heat pump to steam conditions that may not be achievable by the heat pump alone. Optionally, charging the TES device intermittently with electrical energy and the heat pump.

In one implementation, a system is provided for preheating feedwater, including: a thermal energy storage (TES) device configured to store thermal energy intermittently; a heat pump configured to utilize a low-temperature resource to provide feedwater heating at an elevated Coefficient of Performance (COP); and. a feedwater path configured to direct the heated feedwater from the heat pump to the TES for further heating or steam generation.

The system may include one or more of the following features. Optionally, the heat pump is configured to be electrically driven and powered by a power source external to the system. Optionally, the heat pump is configured to be thermally driven and at least a portion of the driving energy for the heat pump is provided by the TES thermal output. Optionally, at least a portion of the TES thermal output is high-pressure/temperature steam that is configured to be sent to a steam turbine, and at least a portion of the steam is extracted to provide driving thermal energy for the thermally driven heat pump. Optionally, at least a portion of the generated mechanical/electrical power from the turbine is configured to be used to power thermal-driven heat pump aux loads or directed to another use. Optionally, the heat pump is an electrically drive heat pump and the TES is configured to provide at least a portion of its thermal discharge as high-temperature/pressure steam to a turbine, and at least a portion of generated electric power is directed to the electrically driven heat pump to power it. Optionally, the condenser of the Rankine Cycle is configured such that at least a portion of reject heat is captured and used to provide at least a portion of the heat pump's low-temperature heat source.

In one implementation, a method is provided for preheating feedwater, including: utilizing a low-temperature resource to drive a heat pump; providing feedwater heating at an elevated Coefficient of Performance (COP) using the heat pump; and directing the heated feedwater from the heat pump to a thermal energy storage (TES) for further heating or steam generation.

The method may include one or more of the following features. Optionally, the method includes using electricity for powering the heat pump. Optionally, using thermal energy to drive the heat pump and at least a portion of the driving energy for the heat pump is provided by the TES thermal output. Optionally, directing at least a portion of the TES thermal output as high-pressure/temperature steam that is sent to a steam turbine, and extracting at least a portion of the steam to provide driving thermal energy for thermally driving the heat pump. Optionally, using at least a portion of mechanical and/or electrical power generated from the turbine to power thermal-driven heat pump aux loads or directed to another use. Optionally, using to the TES to provide at least a portion of its thermal discharge as high-temperature and high pressure steam to a turbine, and directing at least a portion of generated electric power to the electrically driven heat pump to power it. Optionally, using the condenser of the Rankine Cycle to capture at least a portion of reject heat and to provide at least a portion of the heat pump's low-temperature heat source.

In one embodiment, a system for thermal energy storage and delivery includes a thermal storage assembly charging intermittently from at least one electricity source; a turbine configured to convert thermal energy from the thermal storage assembly to electrical (and/or mechanical) work and heat, wherein the electricity is directed to a load facility that uses the electricity and generates return heat as a byproduct of electricity use; a heat pump system configured to provide an outbound fluid stream at a first temperature and to receive an inbound fluid stream at a second temperature that is lower than the first temperature; and a thermal recovery system configured to direct the heat and the return heat to the heat pump system; wherein the return heat from the load facility and the heat from the generator are applied by the heat pump system sequentially or simultaneously to heat the inbound fluid stream from the second temperature to the first temperature.

In another embodiment, a system for thermal energy storage and delivery includes a thermal storage assembly charging intermittently from at least one electricity source; a turbine configured to convert thermal energy from the thermal storage assembly to electricity and waste heat, wherein the electricity is directed to a load facility that uses the electricity and generates return heat as a byproduct of electricity use; a heat transfer system configured to provide an outbound fluid stream at a first temperature and to receive an inbound fluid stream at a second temperature; and a thermal recovery system configured to direct the waste heat and the return heat to the heat transfer system; wherein one of the return heat from the load facility or the waste heat from the turbine is applied the inbound fluid stream and the other one of the return heat or waste heat is applied by the heat transfer system to heat the inbound fluid stream such that the outbound fluid stream leaves the heat transfer system at the first temperature which is higher than the second temperature. Optionally, the heat transfer system uses a heat pump. Optionally, the heat transfer system uses a sorption chiller.

In a still further embodiment, a system for thermal energy storage and delivery includes a thermal storage assembly including: a thermal storage medium configured for storing thermal energy, at least one heating element, and a fluid movement system configured to direct a stream of fluid through the thermal storage medium; a turbine and generator assembly configured to convert the thermal energy to electricity and waste heat, a load facility that uses the electricity from the generator and creates return heat; a heat pump system configured to provide an outbound fluid stream at a first temperature and to receive an inbound fluid stream at a second temperature lower than the first temperature; a first heat recovery system configured to direct said waste heat from the generator assembly to the heat pump system; and a second heat recovery system configured to direct return heat from the load facility to the heat pump system. The return heat may be applied to the inbound fluid stream to heat the inbound fluid stream to a third temperature higher than the second temperature. The waste heat may be applied to the inbound fluid to heat the inbound fluid from a third temperature to the first temperature which is higher than the third temperature.

Optionally, any of the embodiments herein may have one or more of the following features. For example, the generator assembly may be a steam turbine. Optionally, the generator assembly includes a condensing steam turbine. Optionally, the generator assembly includes a non-condensing steam turbine. Optionally, the load facility comprises a data center having at least one computer server therein. Optionally, the heat pump system uses an electric heat pump. Optionally, the heat pump system uses a thermal heat pump. Optionally, the system further comprises a district heating system in fluid communication with the heat pump system. Optionally, the return heat has a return heat temperature between about 30° C. to about 40° C. Optionally, the first temperature of the outbound fluid stream is between about 65° C. to about 80° C. Optionally, the second temperature of the inbound fluid stream is between about 28° C. to about 32° C.

In another embodiment, a method for thermal energy storage and delivery includes storing energy in a thermal storage assembly from at least one intermittent renewable energy source; converting energy from the thermal storage assembly to electricity and waste heat; directing the electricity to a load facility that uses the electricity and generates return heat as a byproduct of electricity use; using a heat transfer system configured to provide an outbound fluid stream at a first temperature and to receive an inbound fluid stream at a second temperature; and directing the waste heat or the return heat to the heat transfer system; applying one of the return heat from the load facility or the waste heat to the inbound fluid stream; and applying the other one of the return heat or waste heat to the heat transfer system to heat the inbound fluid stream such that the outbound fluid stream leaves the heat transfer system at the first temperature which is higher than the second temperature.

In another embodiment, a method for thermal energy storage and delivery includes storing energy in a thermal storage assembly from at least one intermittent renewable energy source; converting energy from the thermal storage assembly to electricity and waste heat; directing the electricity to a load facility that uses the electricity and generates return heat as a byproduct of electricity use; using a heat pump system configured to provide an outbound fluid stream at a first temperature and to receive an inbound fluid stream at a second temperature; and applying one of the return heat from the load facility or the waste heat to the inbound fluid stream; and applying the other one of the return heat or waste heat to heat the inbound fluid stream such that the outbound fluid stream leaves the heat pump system at the first temperature which is higher than the second temperature; wherein the return heat is a third temperature lower than the first temperature but higher than the second temperature.

Optionally, any of the embodiments herein includes at least one technical feature from any of the features described herein. Optionally, any of the embodiments herein includes at least two technical features from any of the features described herein. Optionally, a system for thermal energy storage is described herein. Optionally, a method for thermal energy storage is described herein. Optionally, the thermal energy storage system includes at least one technical feature from any of the features described herein. Optionally, the thermal energy storage system includes at least two technical features from any of the features described herein. Optionally, the method for thermal energy storage includes at least one technical feature from any of the features described herein. Optionally, a method for thermal energy storage includes at least two technical features described herein.

The claimable subject matter also includes:

A thermal energy storage system.

A method for thermal energy storage.

A thermal energy storage system including at least one technical feature from any of the prior claims or claimable subject matter.

A thermal energy storage system including at least any two technical features from any of the prior claims or claimable subject matter.

A method for thermal energy storage including at least one technical feature from any of the prior claims or claimable subject matter.

A method for thermal energy storage including at least any two technical features from any of the prior claims or claimable subject matter.

Terminology

To the extent a term used in a claim is not defined below, it should be given the broadest definition persons in the pertinent art have given that term as reflected in printed publications and issued patents at the time of filing. For example, the following terminology may be used interchangeably, as would be understood to those skilled in the art:

A Amperes
AC Alternating current
CBPD Cement kiln bypass duct
DAC Direct air capture
DC Direct current
DFB Dual Fluidized Bed
EOR Enhanced Oil Recovery
EV Electric vehicle
GT Gas turbine
HRSG Heat recovery steam generator
kV kilovolt
kW kilowatt
MEA monoethanolamine absorption
MED Multi-effect desalination
MPPT Maximum power point tracking
MSF Multi-stage flash MW megawatt
OTSG Once-through steam generator
PEM Proton-exchange membrane
PV Photovoltaic
RSOC Reversible solid oxide cell
SCM Supplementary cementitious material
SOEC Solid oxide electrolyzer cell
SOFC Solid oxide fuel cell
SPHE Single pass heat exchanger
ST Steam turbine
TES Thermal Energy Storage
TSS Thermal storage system
TSU Thermal Storage Unit
VRE Variable renewable electricity Additionally, the term "heater" is used to refer to a conductive element that generates heat. For example, the term "heater" as used in the present example implementations may include, but is not limited to, a wire, a ribbon, a tape, or other structure that can conduct electricity in a manner that generates heat. The composition of the heater may be metallic (coated or uncoated), ceramic or other composition that can generate heat.

While foregoing example implementations may refer to "air", including $CO_2$, the inventive concept is not limited to this composition, and other fluid streams may be substituted therefor for additional industrial applications. For example but by way of limitation, enhanced oil recovery, sterilization related to healthcare or food and beverages, drying, chemical production, desalination and hydrothermal processing (e.g. Bayer process.) The Bayer process includes a calcination step. The composition of fluid streams may be selected to improve product yields or efficiency, or to control the exhaust stream.

In any of the thermal storage units, the working fluid composition may be changed at times for a number of purposes, including maintenance or re-conditioning of materials. Multiple units may be used in synergy to improve charging or discharging characteristics, sizing or case of installation, integration or maintenance. As would be understood by those skilled in the art, the thermal storage units disclosed herein may be substituted with other thermal storage units having the necessary properties and functions; results may vary, depending on the manner and scale of combination of the thermal storage units.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided with respect to certain example implementations herein is intended merely to better illuminate the example implementation and does not pose a limitation on the scope of the example implementation otherwise claimed. No language in the specification should be construed as indicating any non-claimed element essential to the practice of the example implementation.

Groupings of alternative elements or example implementations of the example implementation disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all groups used in the appended claims.

In the specification, reference may be made to the spatial relationships between various components and to the spatial orientation of various aspects of components as the devices are depicted in the attached drawings. However, as will be recognized by those skilled in the art after a complete reading of the present application, the devices, members, devices, etc. described herein may be positioned in any desired orientation. Thus, the use of terms such as "above," "below," "upper," "lower," "first", "second" or other like terms to describe a spatial relationship between various components or to describe the spatial orientation of aspects of such components should be understood to describe a relative relationship between the components or a spatial orientation of aspects of such components, respectively, as the device described herein may be oriented in any desired direction.

In interpreting the specification, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refer to at least one of something selected from the group consisting of A, B, C . . . and N, the text should be interpreted as requiring only one element from the group, not A plus N, or B plus N, etc.

While the foregoing describes various example implementations of the example implementation, other and further example implementations of the example implementation may be devised without departing from the basic scope thereof. The scope of the example implementation is determined by the claims that follow. The example implementation is not limited to the described example implementations, versions or examples, which are included to enable a person having ordinary skill in the art to make and use the example implementation when combined with information and knowledge available to the person having ordinary skill in the art.

While embodiments described in this disclosure may be susceptible to various modifications and alternative forms, specific embodiments thereof are shown by way of example in the drawings and will herein be described in detail. It should be understood, however, that the drawings and detailed description thereto are not intended to limit the embodiments to the particular form disclosed, but on the contrary. the intention is to cover all modifications, equivalents and alternatives falling within the spirit and scope of the appended claims.

The invention claimed is:

1. A system for providing cooling and power, including:
a thermal energy storage (TES) device including a solid thermal storage medium configured to charge intermittently from electrical energy;

a combined heat and power (CHP) system configured to receive output thermal energy and electricity from stored energy from the TES;

a thermally driven chiller configured to use the thermal energy to provide cooling; and a heat rejection system configured to reject heat from the chiller.

2. The system of claim 1, wherein the heat rejection system includes a cooling tower.

3. The system of claim 1, further including a heat load, wherein the heat rejection system is configured to send the rejected heat to the heat load.

4. The system of claim 3, wherein the heat load includes a residential and/or commercial heating network.

5. The system of claim 1, wherein the CHP system includes a high-pressure and high-temperature steam configured to direct exhaust steam from the steam turbine to a heat input of the thermally driven chiller.

6. The system of claim 5, wherein the steam turbine includes a noncondensing steam turbine.

7. The system of claim 5, wherein the CHP system includes a high-pressure and high-temperature gas turbine configured to direct exhaust gas from the steam turbine to a heat input of the thermally driven chiller heat input.

8. The system of claim 1, wherein the CHP system is sized to provide an entire energy demand of the chiller, such that a cooling load is entirely powered by stored energy from the TES.

9. The system of claim 1, wherein the CHP system is sized to provide at least a majority of energy demand of the chiller, such that a cooling load is substantially powered by stored energy from the TES.

10. A system for providing cooling and power, including:

a thermal energy storage (TES) device including a solid thermal storage medium configured to charge intermittently from electrical energy;

a combined heat and power (CHP) system configured to receive output thermal energy and electricity from stored energy from the TES;

a thermally driven chiller configured to use the thermal energy to provide cooling; and a heat rejection system configured to reject heat from the chiller;

wherein the CHP system is sized to provide at least a majority of energy demand of the chiller, such that a cooling load is substantially powered by stored energy from the TES;

wherein the cooling load includes a data center.

11. The system of claim 9, wherein the cooling load includes a district cooling network.

12. The system of claim 9, wherein the cooling load includes a refrigeration system.

13. The system of claim 5, wherein the CHP is configured to provide a portion of CHP turbine output as input to power auxiliary loads operably coupled to the chiller.

14. The system of claim 1, configured to provide a portion of CHP turbine work as input to power mechanical or electrical auxiliary loads.

15. The system of claim 1, configured to provide at least a portion of the CHP turbine power to one user of a cooling duty provided by the chiller.

16. The system of claim 1, configured to export at least a portion of the CHP turbine power to a different user than a user of a cooling duty provided by the chiller.

17. The system of claim 1, configured to export at least a portion of the CHP turbine power to an electrical grid.

18. A method for providing cooling and power, including:

intermittently electrically charging a thermal energy storage (TES) device including a solid thermal storage medium;

outputting thermal energy from the TES to a combined heat and power (CHP) system;

using the thermal energy to provide cooling with a thermally driven chiller; and rejecting heat from the chiller using a heat rejection system.

19. The method of claim 18, wherein rejecting heat from the chiller includes rejecting heat to an ambient environment with a cooling tower.

20. The method of claim 18, wherein rejecting heat from the chiller includes sending heat to a heat load.

21. The method of claim 20, wherein the heat load includes a residential and/or commercial heating network.

22. The method of claim 18, wherein generating thermal energy using the CHP system includes using a high-pressure and high-temperature steam turbine that provides exhaust steam to chiller input heat.

23. The method of claim 18, wherein generating thermal energy using the CHP system includes using a high-pressure and high-temperature noncondensing steam turbine that provides exhaust steam to chiller input heat.

24. The method of claim 18, wherein generating thermal energy using the CHP system includes using a high-pressure and high-temperature gas turbine with exhaust gas to chiller heat input.

25. The method of claim 18, further including sizing the TES system and the CHP system to provide an entire energy demand of the chiller, such that a cooling load is powered entirely by stored energy from the TES.

26. The method of claim 18, further including sizing the TES system and the CHP system to provide a majority of energy demand of the chiller, such that a cooling load is substantially powered by stored energy from the TES.

27. A system for providing cooling, including:

a thermal energy storage (TES) device including a solid thermal storage medium configured to charge intermittently from electrical energy;

a thermally driven chiller configured to use thermal energy from the TES device to provide cooling; and a heat rejection system configured to reject heat from the chiller.

28. The system of claim 27, wherein the heat rejection system includes a cooling tower.

29. The system of claim 27, wherein the heat rejection system is configured to send the heat to a heat load.

30. The system of claim 29 wherein the heat load includes a residential and/or commercial heating network.

31. The system of claim 27, wherein the TES device is sized to provide an entire energy demand of the chiller, such that a cooling load is entirely powered by energy stored in the TES from intermittent electricity.

32. The system of claim 27, wherein the TES device is sized to provide at least a majority of an energy demand of the chiller, such that a cooling load is substantially powered energy stored in the TES from intermittent electricity.

33. A system for providing cooling, including:

a thermal energy storage (TES) device including a solid thermal storage medium configured to charge intermittently from electrical energy;

a thermally driven chiller configured to use thermal energy from the TES device to provide cooling; and a heat rejection system configured to reject heat from the chiller;

wherein the TES device is sized to provide at least a majority of an energy demand of the chiller, such that a cooling load is substantially powered energy stored in the TES from intermittent electricity;

wherein the cooling load includes a data center.

34. The system of claim 32, wherein the cooling load includes a district cooling network.

35. The system of claim 32, wherein the cooling load includes a refrigeration system.

36. A method for providing cooling, including:

electrically charging a thermal energy storage (TES) device from an intermittent energy source, wherein the TES includes a solid thermal storage medium;

providing thermal energy from the TES device to a thermally driven chiller; and rejecting heat from the chiller using a heat rejection system.

37. The method of claim 36, wherein rejecting heat from the chiller includes rejecting heat to an ambient environment with a cooling tower.

38. The method of claim 36, wherein rejecting heat from the chiller includes sending heat to a heat load.

39. The method of claim 36, wherein rejecting heat from the chiller includes sending heat to a heat load that includes a residential and/or commercial heating network.

40. The method of claim 36, further including sizing the TES device to provide an entire energy demand of the chiller, such that the cooling load is entirely powered by stored energy from the TES.

41. A method for providing cooling, including:

electrically charging a thermal energy storage (TES) device from an intermittent energy source, wherein the TES includes a solid thermal storage medium;

providing thermal energy from the TES device to a thermally driven chiller; and rejecting heat from the chiller using a heat rejection system;

providing cooled fluid from the chiller to a data center.

42. The method of claim 37, further including the step of providing cooled fluid from the chiller to a district cooling.

43. The method of claim 37, further including the step of providing cooled fluid from the chiller to a refrigeration system.

44. A system for providing heating and power, including:

a thermal energy storage (TES) device including a solid thermal storage medium configured to be heated by electricity from an intermittent energy source to store thermal energy;

a combined heat and power (CHP) system configured to use thermal energy from the TES device to generate high temperature heat; and a thermally driven heat pump configured to use the high-temperature heat from the CHP system to provide heating.

45. The system of claim 44, wherein the heat pump has a low-temperature heat source that is at least in part from an ambient environment.

46. A system for providing heating and power, including:

a thermal energy storage (TES) device including a solid thermal storage medium configured to be heated by electricity from an intermittent energy source to store thermal energy;

a combined heat and power (CHP) system configured to use thermal energy from the TES device to generate high temperature heat; and a thermally driven heat pump configured to use the high-temperature heat from the CHP system to provide heating;

wherein the heat pump has a low temperature heat source that is at least in part from waste heat of an adjacent industrial process.

47. A system for providing heating and power, including:

a thermal energy storage (TES) device including a solid thermal storage medium configured to be heated by electricity from an intermittent energy source to store thermal energy;

a combined heat and power (CHP) system configured to use thermal energy from the TES device to generate high temperature heat; and a thermally driven heat pump configured to use the high-temperature heat from the CHP system to provide heating;

wherein the heat pump has a low-temperature heat source that is at least in part from waste heat of an adjacent cooling process, and the adjacent process includes a data center cooling system.

48. The system of claim 44, wherein the CHP system is configured to direct high-pressure and high-temperature steam to a noncondensing steam turbine with exhaust steam directed to a heat pump heat input.

49. The system of claim 44, wherein the CHP system is configured to direct high-pressure and high-temperature steam to an extraction condensing steam turbine such that a first portion of high-temperature steam is extracted from the steam turbine at within a desired range of temperature and pressure.

50. A method for providing heating and power, including:

using electricity from an intermittent energy source to heat a thermal energy storage (TES) device;

providing high-temperature thermal energy from the TES device to a combined heat and power (CHP) system;

providing the output heat from the CHP system to a thermally driven heat pump; and using a thermocompressor to receive high-temperature fluid from the TES device and low-pressure output from the heat pump, and producing a combined output at a second temperature and pressure.

51. The method of claim 50, wherein the output heat is at least about 250° C. or higher.

52. The method of claim 50, wherein the output heat is at least about 500° C. or higher.

53. The method of claim 50, further including the step of providing exhaust gas from a gas turbine of the CHP system as input to the heat pump.

54. The method of claim 50, further including the step of extracting steam from an extraction condensing steam turbine.

55. The method of claim 54, further including utilizing at least a portion of the output heat as low temperature heat input to the heat pump system.

56. The method of claim 54, further including utilizing at least a portion of the output heat as feedwater preheating to the heat pump system.

57. The method of claim 50, further including the step of providing exhaust steam from a noncondensing steam turbine as input to the heat pump.

58. The method of claim 50, further including providing heating and power to an adjacent industrial process.

59. A system for providing heating and/or cooling, including:

a thermal energy storage (TES) device including a solid thermal storage medium configured to charge using electrical energy from an intermittent energy source;

a Rankine Cycle power generation system configured to generate electricity from the TES device; and an electrically driven heat pump configured to use the electricity generated by the Rankine Cycle power generation system to provide heating and/or cooling.

60. The system of claim 59, wherein the heat pump is configured to provide both heating and cooling.

61. The system of claim 59, wherein the TES device is sized to provide full electrical demand for the heat pump.

62. The system of claim 59, wherein the TES device is configured to direct high-pressure and high-temperature steam to a condensing steam turbine to generate electricity, and wherein heat rejection from the thermal power cycle provides a heat source for the heat pump.

63. The system of claim 62, wherein thermal power cycle heat rejection is configured to utilize at least a portion of the reject heat as low temperature heat input to the heat pump system.

64. The system of claim 62, wherein the heat pump is configured to provide heating, and the TES device is configured to provide at least a portion of the reject heat as feedwater preheating to the heat pump system.

65. The system of claim 59, wherein the TES device is configured to direct high-pressure and high-temperature gas to a gas turbine and to direct exhaust gas from the gas turbine as input to the heat pump.

66. A method for providing heating and/or cooling, including:

electrically charging a thermal energy storage (TES) device from an intermittent energy source;

generating electricity from the TES device using a Rankine Cycle power generation system;

using the generated electricity to power an electrically driven heat pump to provide heating or cooling; and using a thermocompressor to receive high-temperature fluid from the TES device and low-pressure output from the heat pump, and producing a combined output at a second temperature and pressure.

67. The method of claim 66, wherein the heat pump is configured to provide both heating and cooling.

68. The method of claim 66, wherein the TES device is sized to provide full electrical demand for the heat pump.

69. The method of claim 66, wherein generating electricity from the TES device includes providing high-pressure and high-temperature steam to a condensing steam turbine to generate electricity, and integrating heat rejection of the thermal power cycle to serve as a heat source for the heat pump.

70. The method of claim 69, wherein the heat pump is configured to provide heating.

71. A system for boosting heat pump output, including:

a thermal energy storage (TES) device configured to be heated by electricity from an intermittent energy source;

an electrically driven heat pump configured to provide output heat at a first temperature and pressure; and a thermocompressor configured to receive high-temperature fluid from the TES device and low-pressure output from the heat pump, and configured to produce a combined output at a second temperature and pressure.

72. The system of claim 71, wherein the heat pump is configured to provide output heat at a first temperature T1 and a first pressure P1, and the thermocompressor is configured to boost the output to a second temperature T2 and a second pressure P2.

73. The system of claim 71, wherein the TES device provides high-temperature fluid at a third temperature T3 and a third pressure P3, and the thermocompressor is configured to entrain the low-pressure output of the heat pump with the high-pressure fluid from the TES device.

74. The system of claim 71, wherein the heat pump has a first coefficient of performance (COP) that is greater than a second COP of a heat pump without the thermocompressor integration.

75. The system of claim 71, herein the thermocompressor is configured to boost the output of the heat pump.

76. The system of claim 71, wherein the heat pump is configured to operate continuously or substantially continuously.

77. The system of claim 71, wherein the heat pump is configured to operate semi-continuously.

78. A method for boosting heat pump output, including:

electrically charging a thermal energy storage (TES) device from an intermittent energy source;

operating an electrically driven heat pump to provide output heat at a first temperature and pressure; and using a thermocompressor to receive high-temperature fluid from the TES device and low-pressure output from the heat pump, and producing a combined output at a second temperature and pressure.

79. The method of claim 78, including operating the heat pump to provide output heat at a first temperature T1 and a first pressure P1, and using the thermocompressor to boost the output to a second temperature T2 and a second pressure P2.

80. The method of claim 78, including using the TES device to provide high-temperature fluid at a third temperature T3 and a third pressure P3, and using the thermocompressor to entrain the low-pressure output of the heat pump with the high-pressure fluid from the TES device.

81. The method of claim 78, wherein the heat pump has a coefficient of performance (COP) that is greater than a COP of a heat pump operating between the heat source and sink without a temperature boost from the thermocompressor.

82. The method of claim 78, including using the thermocompressor to boost the output of the heat pump.

83. The method of claim 78, including charging the TES device with electrical energy from the intermittent energy source and with thermal output from the heat pump.

84. A system for preheating feedwater, including:

a thermal energy storage (TES) device including a solid thermal storage medium configured to store thermal energy derived from an intermittent energy source;

a heat pump configured to utilize a low-temperature resource to provide feedwater heating at an elevated Coefficient of Performance (COP); and a feedwater path configured to direct the heated feedwater from the heat pump to the TES for further heating or steam generation.

85. The system of claim 84, wherein the heat pump is configured to be electrically driven and powered by a power source external to the system.

86. The system of claim 84, wherein the heat pump is configured to be thermally driven and the TES device is configured to provide thermal energy output as at least a portion of the driving energy for the heat pump.

87. The system of claim 86, configured to provide high-pressure and high-temperature steam to a steam turbine, and to provide at least a portion of steam from the steam turbine to the thermally driven heat pump.

88. The system of claim 87, configured to provide at least a portion of generated mechanical and/or electrical power from the turbine to power the thermally driven heat pump.

89. The system of claim 84, wherein the heat pump includes an electrically drive heat pump and the TES device is configured to provide at least a portion of its thermal discharge as high-temperature and high-pressure steam to a turbine, and to direct at least a portion of generated electric power from the turbine to the electrically driven heat pump.

90. The system of claim 84, wherein the condenser of the Rankine Cycle is configured such that at least a portion of reject heat is captured and used to provide at least a portion of the heat pump's low-temperature heat source.

91. A method for preheating feedwater, including:

utilizing a low-temperature resource to drive a heat pump;

providing feedwater heating at an elevated Coefficient of Performance (COP) using the heat pump; and directing the heated feedwater from the heat pump to a thermal energy storage (TES) device for further heating or steam generation, wherein the TES includes a solid thermal storage medium.

92. The method of claim 91, including using electricity to power the heat pump.

93. The method of claim 91, including using thermal energy to drive the heat pump and at least a portion of the driving energy for the heat pump is provided by the TES thermal output.

94. The method of claim 93, including directing at least a portion of the TES thermal output as high-pressure and high-temperature steam to a steam turbine, and extracting at least a portion of output steam from the steam turbine to provide thermal energy to thermally drive the heat pump.

95. The method of claim 94, including using at least a portion of mechanical and/or electrical power generated from the turbine to power the heat pump.

96. The method of claim 92, including providing at least a portion of thermal discharge from the TES device as high-temperature and high-pressure steam to a turbine, and directing at least a portion of generated electric power to the heat pump.

97. The method of claim 91, including using the condenser of the Rankine Cycle to capture at least a portion of reject heat and to provide the reject heat as at least a portion of the heat pump's low-temperature heat source.

* * * * *